US012607426B2

(12) United States Patent
Alexander et al.

(10) Patent No.: US 12,607,426 B2
(45) Date of Patent: Apr. 21, 2026

(54) SEMI-AUTOMATIC SHOTGUN AND COMPONENTS THEREOF

(71) Applicant: Savage Arms, Inc., Westfield, MA (US)

(72) Inventors: Aaron K. Alexander, Westfield, MA (US); John Linscott, Easthampton, MA (US)

(73) Assignee: Savage Arms, Inc., Westfield, MA (US)

( * ) Notice: Subject to any disclaimer, the term of this patent is extended or adjusted under 35 U.S.C. 154(b) by 125 days.

(21) Appl. No.: 18/420,488

(22) Filed: Jan. 23, 2024

(65) Prior Publication Data

US 2024/0344789 A1 Oct. 17, 2024

Related U.S. Application Data

(63) Continuation of application No. 17/567,008, filed on Dec. 31, 2021, now Pat. No. 11,879,700, which is a (Continued)

(51) Int. Cl.
*F41A 5/28* (2006.01)
*F41A 9/72* (2006.01)

(52) U.S. Cl.
CPC . *F41A 5/28* (2013.01); *F41A 9/72* (2013.01)

(58) Field of Classification Search
CPC ..... F41A 5/18; F41A 5/26; F41A 5/28; F41A 9/72

(Continued)

(56) References Cited

U.S. PATENT DOCUMENTS 3,020,807 A 2/1962 Hailston et al.
3,127,812 A 4/1964 Into et al.

(Continued)

FOREIGN PATENT DOCUMENTS

FR 2185784 A1 5/1973
WO WO2009097551 A1 8/2009

OTHER PUBLICATIONS

Benelli Firing Pin Retaining Pin, at least as early as Jan. 1, 2016—1 page.

(Continued)

*Primary Examiner* — Jonathan C Weber
(74) *Attorney, Agent, or Firm* — Christensen, Fonder, Dardi & Herbert PLLC.; Douglas J. Christensen; Timothy J. Busse

(57) ABSTRACT

A semiautomatic shotgun comprising a receiver, a barrel, a forward gas block assembly attached to the barrel, a slider assembly rearward of the gas block assembly extending into the receiver. Upon firing a shotshell the explosive gases in the barrel are diverted through two ports into the gas block assembly, specifically into a pair of lateral pressure relief valves positioned on both sides of the barrel. The pressure relief valves further having a gas pathway from the barrel provided by clusters of holes less than a specific size and on-center with the barrel axis. A piston is forced rearwardly and engages a slider of the slider assembly that is linked to a breech block in the receiver. The breech block loads unfired shells and ejects the fired shells accomplishing the semiautomatic recycling. The dual pressure relief valves actuate to moderate and limit the gas pressure that enters the piston chamber when using shotshells of different power levels thereby providing consistency in the recycling operation. The shotgun assembled with a plurality of retention pins having uniformly sized O-rings.

19 Claims, 47 Drawing Sheets

Related U.S. Application Data continuation-in-part of application No. 17/361,573, filed on Jun. 29, 2021, now Pat. No. 11,933,574, which is a continuation-in-part of application No. 16/506,646, filed on Jul. 9, 2019, now Pat. No. 11,047,635, which is a continuation of application No. 15/847,822, filed on Dec. 19, 2017, now Pat. No. 10,345,062.

(60) Provisional application No. 63/132,791, filed on Dec. 31, 2020, provisional application No. 62/436,346, filed on Dec. 19, 2016.

(58) Field of Classification Search
USPC ..... 89/191.01, 191.02, 193
See application file for complete search history.

(56) References Cited

U.S. PATENT DOCUMENTS 3,657,960 A 4/1972 Badali
3,780,618 A 12/1973 Sanford
3,848,511 A 11/1974 Zanoni
3,968,727 A 7/1976 Hyytinen
3,990,348 A 11/1976 Vesamaa
4,085,654 A 4/1978 Panigoni
4,102,242 A * 7/1978 Liedke ..... F41A 5/22 89/191.01
4,102,243 A 7/1978 Jennie
4,125,054 A 11/1978 Jennie
4,601,122 A 7/1986 Beretta
4,702,146 A 10/1987 Ikeda et al.
4,856,217 A 8/1989 Benelli
4,872,392 A 10/1989 Powers et al.
4,901,623 A 2/1990 Lee
5,218,163 A 6/1993 Dabrowski
5,429,034 A 7/1995 Badali et al.
5,806,228 A 9/1998 Martel et al.
5,867,928 A 2/1999 Plebani
5,872,323 A 2/1999 Norton et al.
5,918,401 A 7/1999 Rowlands
5,959,234 A * 9/1999 Scaramucci ..... F41A 5/22 89/193
6,347,569 B1 2/2002 Butler
6,382,073 B1 5/2002 Beretta
6,470,614 B1 10/2002 Johnson
6,508,160 B2 1/2003 Beretta
6,564,691 B2 5/2003 Butler
6,619,592 B2 9/2003 Vignaroli et al.
7,467,581 B2 12/2008 Botty
7,775,149 B2 8/2010 Keeney et al.
7,946,214 B2 5/2011 Stone
7,963,061 B2 6/2011 Lesenfants
8,056,280 B2 11/2011 Lesenfants et al.
8,065,949 B1 11/2011 Molinari
8,079,168 B2 12/2011 Lesenfants
8,109,194 B2 2/2012 Stone
8,230,632 B2 7/2012 Moretti
8,245,625 B2 8/2012 Winge
8,250,964 B2 8/2012 Stone
8,312,656 B2 11/2012 Lesenfants
8,443,712 B2 5/2013 Molinari
8,528,458 B2 9/2013 Windauer
8,640,598 B1 2/2014 Jackson
8,850,731 B2 10/2014 Botty et al.
8,939,060 B2 1/2015 Bassoli et al.
9,097,475 B2 8/2015 Ricks
9,212,856 B2 12/2015 Baker
9,261,314 B1 2/2016 Jackson
9,310,160 B1 4/2016 DiChario
9,383,149 B2 7/2016 Ricks
9,429,387 B1 8/2016 Barfoot et al.
D779,013 S 2/2017 Cheng et al.
9,664,479 B1 5/2017 Robinson et al.
D790,028 S 6/2017 Geissele
D795,986 S 8/2017 Frederickson et al.
9,816,768 B2 11/2017 Ricks
D840,494 S 2/2019 Storch
10,345,062 B2 7/2019 Alexander et al.
D862,629 S 10/2019 Chambless
11,047,635 B2 6/2021 Alexander et al.
11,879,700 B2 1/2024 Alexander et al.
11,933,574 B2 3/2024 Alexander et al.
2005/0241211 A1 11/2005 Swan
2005/0257681 A1 11/2005 Keeney et al.
2010/0275486 A1 11/2010 Lesenfants
2011/0271826 A1 11/2011 Molinari
2012/0198990 A1 8/2012 Brittin
2014/0013642 A1 1/2014 Larson, Jr.
2014/0096674 A1 4/2014 Bassoli et al.
2014/0150638 A1* 6/2014 Ricks ..... F41A 5/26 89/193
2014/0174285 A1* 6/2014 Baker ..... F41A 5/28 89/129.01
2015/0300786 A1 10/2015 Downing et al.
2016/0084597 A1* 3/2016 Ricks ..... F41A 3/66 89/193
2017/0023333 A1 1/2017 Faifer
2018/0142991 A1 5/2018 Rogers et al.
2018/0172376 A1 6/2018 Alexander et al.
2019/0017773 A1 1/2019 Myers
2019/0339031 A1 11/2019 Alexander et al.
2022/0042755 A1 2/2022 Alexander et al.
2022/0228826 A1 7/2022 Alexander et al.

OTHER PUBLICATIONS

Beretta Firing Pin Retaining Pin, at least as early as Jan. 1, 2016—1 page.
Extended European Search Report for European Application No. 17882462.9, dated Aug. 18, 2020, 7 pages.
PCT International Search Report and Written Opinion in International Application No. PCT/US2017/067438, dated May 8, 2018, 8 pages.

* cited by examiner

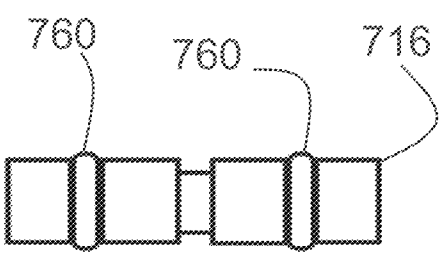
FIG. 52
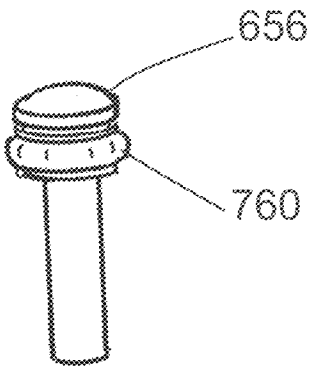
FIG. 53
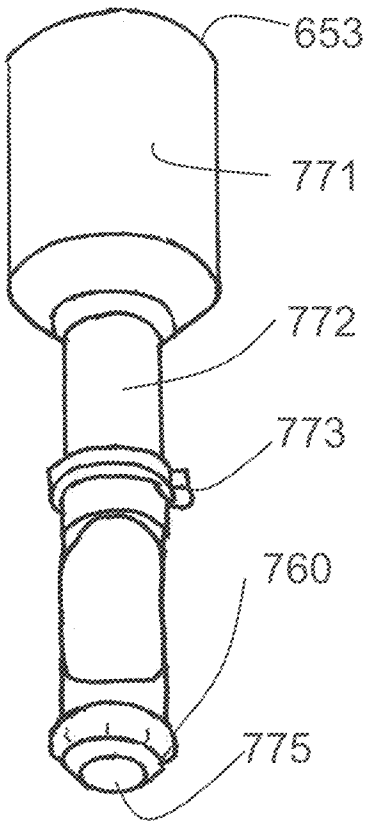
FIG. 51
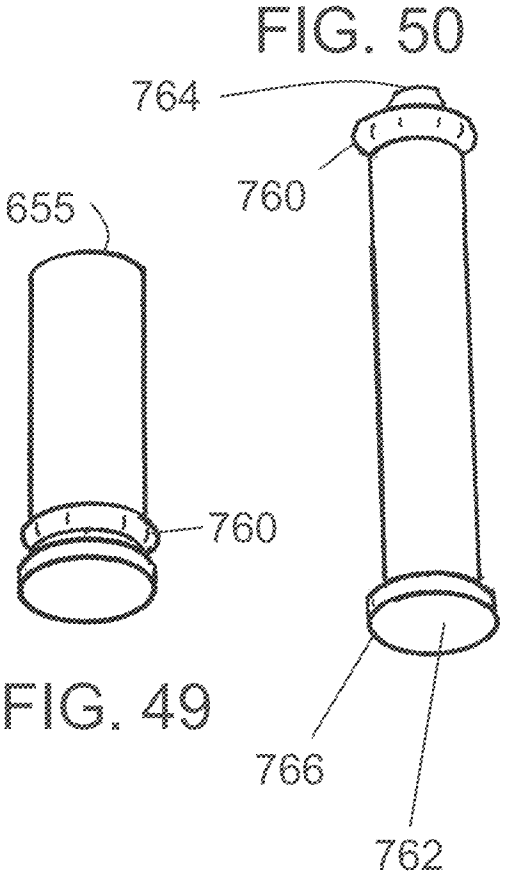
FIG. 50
FIG. 49

SEMI-AUTOMATIC SHOTGUN AND COMPONENTS THEREOF

CROSS-REFERENCE TO RELATED APPLICATIONS

This application claims priority to U.S. patent application Ser. No. 17/567,008. filed on Dec. 31, 2021, which claims priority to U.S. Provisional Application No. 63/132,791 filed on Dec. 31, 2020, and is a continuation-in-part of U.S. patent application Ser. No. 17/361,573 filed on Jun. 29, 2021, which is a continuation-in-part of U.S. patent application Ser. No. 16/506,646, filed Jul. 9, 2019, now U.S. Pat. No. 11,047,635, which is a continuation of U.S. patent application Ser. No. 15/847,822, filed Dec. 19, 2017, now U.S. Pat. No. 10,345,062, which claims the benefit of U.S. Provisional Application No. 62/436,346, filed on Dec. 19, 2016, the disclosures of all said applications are incorporated by reference herein in their entireties.

BACKGROUND OF THE DISCLOSURE

Shotguns of any particular gauge may fire different shotshell cartridges with different payloads and propellant loads. With pump action shotguns the recycling occurs after the firing of the shotshell cartridges and occurs manually. Thus, there is no relation of the type of propellant load to the recycling reliability of the shotgun. In gas operated semiautomatic shotguns, the recycling occurs by bleeding off propellant gas from the barrel to actuate a piston connected to the breech block. The reliability of the cycling can be affected by the type of shotshell cartridge fired, the maintenance of the shotgun, as well as the wear on components of the shotgun. A shotgun that reliably cycles for a magnum round that produces higher barrel pressures might not cycle for a lower powered skeet round with lower barrel pressures. And a shotgun that cycles for both a lower powered skeet round and a magnum powered round may subject the cycle mechanism components to higher forces causing premature wear and failure of components or function.

The prior art shotguns disclose attempts to provide active or passive adjustment of the gas entering the piston cylinder or cylinders. Some semiautomatic shotguns allow manual user adjustment, for example, switching between a "normal" and "heavy" load, where the heavy setting allows more gas to escape the system before entering the piston cylinder. In another prior art shotgun, see U.S. Pat. No. 8,443,712, the gas ports are positioned in the cartridge chamber region of the barrel in a manner so as to be covered or not covered depending on the cartridge length. With longer 3 and 3½ inch cartridges some of the ports are covered up by the end of the cartridge body, preventing them from taking in extra gas. This has the effect of reducing the pressure and amount of gas bleed from the barrel reducing the bolt velocity where the cartridges are longer. It does not however, strictly speaking, gauge the energy of the cartridge. It effectively groups the cartridge energy by length. While in general longer cartridges are typically higher energy, this is not always the case. For example, there are high power magnum 2¾ inch cartridges. In this system such cartridges would be "read" as lower power. The length of the cartridge does not directly determine its energy. Therefore, this system has a coarse resolution of adjustment. A finer adjustment based upon and by determining the actual power of the cartridge would be desirable.

Build-up of debris in the gas operating systems can also impact cycling reliability. Conventional gas operated shotguns bleed gas pressure from the barrel through ports, conventional ports can shave polymer from the cartridge wads causing reliability issues with the gas operating system. This can be minimized by angling the ports, but this is difficult and expensive in a manufacturing environment. Improvement in versatility, reliability, and simplicity of semiautomatic shotguns when used with different powered shotshell cartridges would be welcomed by the shooting public. Improvements in manufacturing techniques that are cost effective would be welcomed by firearm manufacturers.

SUMMARY

A gas operated semiautomatic shotgun has features for faster and more reliable cycling over a wide range of differently powered ammunition and that provides less recoil as compared to conventional semiautomatic shotguns. Additionally, features are provided for more robust mechanisms requiring less cleaning and/or maintenance than conventional gas operated semiautomatic shotguns. Additionally, features are provided for quick, simple, and essentially tool-less disassembly and assembly.

In embodiments, a semiautomatic shotgun has a receiver, a buttstock extending rearwardly, a barrel extending forwardly from the receiver, a magazine tube below the barrel, a fore stock below the barrel at a forward end of the magazine tube, trigger mechanism in the receiver, a gas block assembly at the forward end of the fore stock, a piston in the gas block, the piston engaging a slider connecting to a breech block in the receiver by way of a pair of arms. A plunger assembly extending into the buttstock with a plunger tip projecting into the receiver for engaging the rearward end of the breech block.

In embodiments, the gas block assembly including a gas block fixed to the barrel and fluidly connecting with the barrel bore through holes in the barrel. The gas block assembly including a pair of pressure relief valves. In embodiments, an annular piston in the gas block assembly is positioned in a piston cylinder defined by the magazine tube and the gas block. Upon firing the shotgun, the annular piston is in engagement with a slider on the magazine tube and pushes the slider rearwardly. In embodiments, the slider is unitary with a pair of action bars or legs, and a bolt carrier or breech block. The slider, action bars, and bolt carrier move rearwardly ejecting the spent cartridge in the chamber, re-cocking the hammer, compressing a return spring on the magazine tube, moving a new cartridge into position for chambering. The rear end of the breech block engages the tip of the plunger that extends into the receiver compressing a compressible member of the plunger assembly. In embodiments the compressible member is one or more steel coil springs. In embodiments the compressible member is a rigid polymer tube, for example, urethane. The compressible member dampens the energy of the unitary slider, action bars, and breech block. The polymer compressible member reduces the kick from the rearward traveling breech block. In embodiments, the polymer tube can be compressed about an eighth of an inch, and an interior rear surface of the receiver provides a hard stop to the breech block, action bars, and slider. At the stop point the recoil spring drives breech block, action bars, and slider forwardly loading the next cartridge into the chamber and pushing the annular piston back into the gas block assembly and putting the breech block into the in-battery position.

In embodiments, a semiautomatic shotgun has a gas operating system that includes a pair of non-adjustable pressure relief valves mounted in a gas block on the barrel positioned at a forward end of the fore stock. The pressure relief valves have conical valve seats and a conical engaging surface on an axially movable hollow valve member. The valve member with apertures proximate the conical engaging surface extending to the hollow interior of the valve member. The pressure relief valves, when activated by a predetermined gas pressure vents gas forwardly out of the open front of the valve through the hollow valve member providing a high volume and fast acting gas vent system. In embodiments, the pressure relief valves also vent laterally out of a side port in the valve housing and A plurality of rows of circumferential rib segments provide a scrubbing action inside of the pressure relief valve housing minimizing or eliminating potential carbon buildup. Longitudinal grooves on the exterior of the valve member in between the circumferential rib segments provide a vent pathway to the side port.

A semiautomatic shotgun, the shotgun comprising a barrel, a cycling piston in a cylinder defining a piston chamber below the barrel, the barrel having a propellant gas diversion from a pair of ports in the barrel, through a pair of first gas passageways, into a pair of lateral chambers positioned on both sides of the barrel, each of the chambers having pressure relief valves therein. The chambers each further having a second gas passageways to the piston chamber for recycling the shotgun.

In embodiments, the barrel may have multiple gas ports for bleeding the propellant gas into the dual regulating valve system. In embodiments, each valve can have two barrel ports providing gas thereto for regulating the pressure level entering the piston chamber. In embodiments, each valve can have four barrel ports providing gas thereto for regulating the pressure level entering the piston chamber. In embodiments, each valve can have six barrel ports providing gas thereto for regulating the pressure level entering the piston chamber. In embodiments, each valve can have eight barrel ports providing gas thereto for regulating the pressure level entering the piston chamber. The inventors have discovered that multiple ports positioned forward of the cartridge chamber has several beneficial effects. First, compared to multiple ports at the cartridge chamber, it is believed less energy for propelling the shot is lost at this location as the shot has already reached a high velocity. Second, multiple ports provide an increased area for bleeding more gas without the potential of shaving the wads as a single port with comparable area. Third, where a single port is utilized, typically the hole is drilled at a 45 degree angle (facing rearwardly) so that the polymer shotgun wads passing by are exposed to minimal sharp hole edges that can create polymer shavings. The smaller holes may be drilled at 90 degrees to the barrel axis; this is a much easier and less expensive manufacturing process than drilling barrel holes at angles to the axis. The smaller holes are, for example, less than 0.070 inches in diameter and do not appear to create any wad shavings. Moreover, the inventors have discovered that longer barrels require fewer holes for the same cycling energy. The longer barrels creating greater gas pressures rearward of the wad and shot traveling down the barrel. In embodiments, a shotgun has several interchangeable barrels of different lengths that all provide the wide range of different powered shotgun shells without any adjustment to the shotgun. The receiver may readily accept the several different barrels that perform equivalently with respect to the cycling capabilities shooting different power level of shells. The longer the barrel of the several barrels, the fewer barrel ports the barrel has. Each of the several barrels may have the same regulator with the same settings In embodiments, the propellant gas diversion is provided by two clusters of holes one cluster of holes leading to a first regulator cavity and one cluster of holes leading to a second regulator cavity. In embodiments, each cluster has at least four holes drilled in a direction perpendicular to the axis of the barrel, or at least not at a forward or rearward angle with respect to the barrel wall. In embodiments, the holes are less than 0.100 inches in diameter. In embodiments the holes are not larger than 0.067 inches in diameter. The inventors have discovered that a feature and advantage of holes on center with the axis of the barrel of such size is that abrasion or shaving of wads passing by the hole effectively does not happen, effectively eliminating debris entering the gas operating system including the pressure relief valves.

In embodiments, the second gas passageway is offset and nonlinear with the first gas pathway. The lateral chambers each having a cross sectional area greater than the first gas passageways and greater than the second gas passageways.

Embodiments of the shotgun provide a balanced reliable gas diversion system offering consistent cycling operation with different powered shotshell cartridges without the need for adjustment of the pressure relief valves, the pressure relief valves may be non-adjustable by the user.

In one or more embodiments, a semiautomatic shotgun comprises a receiver defining a receiver interior and a barrel attached to a forward portion of the receiver. The barrel has a barrel wall defining a barrel bore extending along a barrel axis of the barrel. The barrel wall defines a firing chamber that is dimensioned and configured to receiving a shell. A breech block is slidably received in the receiver interior. The breech block is movable between a forward position in which the breech block engages the breech end of the barrel for firing a chambered shell and a rearward position in which the breech block contacts a plunger of a spring loaded plunger assembly. In one or more embodiments, the spring loaded plunger assembly comprises the plunger, a first plunger spring, and a second plunger spring. In one or more embodiments, the first plunger spring defines a spring lumen and the second plunger spring is disposed inside the spring lumen defined by the first plunger spring. In one or more embodiments, a return spring provides a return force urging the breech block toward the forward position. In embodiments, the plunger assembly includes a preloaded polymer tubing segment as a spring. In an embodiment, for example, the tubing may be formed of a urethane.

In one or more embodiments, a gas operated mechanism is disposed about the magazine tube and the gas operated mechanism comprises an annular shaped piston. In one or more embodiments, combustion gasses apply pressure to a forward facing surface of the annular shaped piston, the pressure applied to the annular shaped piston creates a rearward force, and the rearward force urges the breech block toward the rearward position. In one or more embodiments, a slider is disposed about the magazine tube at a location rearward of the annular shaped piston. In one or more embodiments, a port leg and a starboard leg extend between the slider and the breach block. In one or more embodiments, combustion gasses apply pressure to a forward facing surface of the annular shaped piston, the pressure applied to the annular shaped piston creates a rearward force, and the rearward force is transferred to the breech block by the sleeve, the starboard leg and the port leg, the action bars.

In one or more embodiments, a semiautomatic shotgun comprises a receiver defining a receiver interior and a breech block that is slidably received in the receiver interior. The breech block is movable between a forward position in which the breech block engages the breech end of the barrel for firing a chambered shell and a rearward position in which the breech block is positioned rearward of the breech end of the barrel for discharging a spent shell. A barrel and a magazine tube extend forwardly from a forward portion of the receiver. The barrel has a breech end and a muzzle end. A barrel wall of the barrel extends between the breech end and the muzzle end. The barrel wall defines a barrel bore extending along a barrel axis of the barrel. The barrel wall defines a firing chamber and barrel bore, the firing chamber being dimensioned and configured to receiving a shell. The magazine tube has a rearward end and a forward end. A magazine wall of the magazine tube extends between the rearward end and the forward end. The magazine wall defines a magazine tube bore extending along a magazine axis of the magazine tube. The barrel axis and the magazine axis are parallel and define a vertical plane.

A semiautomatic shotgun in accordance with the embodiments described in the preceding paragraph may further include a gas block assembly including a gas block that is disposed about the magazine tube with the magazine tube extending through the block bore defined by the gas block. The gas block assembly includes a starboard regulator assembly and a port regulator assembly. The gas block defines a starboard regulator cavity and a port regulator cavity. The starboard regulator cavity extends along a starboard regulator axis and the port regulator cavity extends along a port regulator axis. The starboard regulator axis and the port regulator axis define a horizontal plane. In one or more embodiments, the horizontal plane defined by the starboard regulator axis and the port regulator axis is perpendicular to the vertical plane defined by the barrel axis and the magazine axis. In one or more embodiments, the starboard regulator assembly and the starboard regulator cavity are disposed starboard of the vertical plane defined by the barrel axis and the magazine axis. In one or more embodiments, the starboard regulator assembly and the starboard regulator cavity are disposed below the barrel axis and above the magazine axis. In one or more embodiments, the port regulator assembly and the port regulator cavity are disposed portward of the vertical plane defined by the barrel axis and the magazine axis. In one or more embodiments, the port regulator assembly and the port regulator cavity are disposed below the barrel axis and above the magazine axis.

A semiautomatic shotgun in accordance with the embodiments described in the preceding paragraph may further include a sleeve comprising a sleeve wall extending into the block bore defined by a gas block with a portion of the sleeve disposed between an outer surface of the magazine tube and inner surface of the gas block. In one or more embodiments, the magazine tube, the sleeve, and the gas block cooperate to define an annular volume. The annular volume communicates with the barrel bore so that combustion gasses can enter the annular volume. The starboard regulator assembly acts to release combustion gasses when the combustion gasses in the barrel bore and/or the annular volume reaches a first predetermined pressure. The port regulator assembly acts to release combustion gasses when the combustion gasses in the barrel bore and/or the annular volume reaches a first predetermined pressure. In one or more embodiments, the first predetermined pressure and the second predetermined pressure are different. In one or more embodiments, the first predetermined pressure is selected to correspond to a first shotshell load and the second predetermined pressure is selected to correspond to a second shotshell load. In one or more embodiments, the first predetermined pressure and the second predetermined pressure are substantially equal. In one or more embodiments, the first predetermined pressure and the second predetermined pressure have values within about ten percent of one another.

A semiautomatic shotgun in accordance with one or more embodiments comprises a receiver, a barrel and a magazine tube. The barrel and the magazine tube both extend forward beyond a forward end of the receiver with the magazine tube being located below the barrel. In an embodiment, a gas operated mechanism is disposed about the magazine tube. In an embodiment, the gas operated mechanism comprises a gas block assembly that including an annular shaped piston. In an embodiment, the annular shaped piston extends into a block bore defined by a gas block of the gas block assembly. In an embodiment, the block bore extends along a block bore axis. In an embodiment, the gas block assembly includes a starboard regulator housing defining starboard regulator cavity that extends along a starboard regulator axis. In an embodiment, the starboard regulator housing comprises a first starboard male thread and the first starboard male thread is disposed in threaded engagement with a first starboard female thread of the gas block. In an embodiment, a starboard valve member is disposed in the starboard regulator cavity with a seating surface of the starboard valve member is biased to seat against a complementary surface of the starboard regulator housing by a starboard spring. In an embodiment, a forward end of the starboard spring seats against the starboard valve member and a rearward end of the starboard spring seats against a starboard retainer. In an embodiment, the starboard retainer comprises a second starboard male thread and the second starboard male thread is disposed in threaded engagement with a second starboard female thread of the starboard regulator housing. In an embodiment, the gas block assembly includes a port regulator housing defining port regulator cavity that extends along a port regulator axis. In an embodiment, the port regulator housing comprises a first port male thread and the first port male thread is disposed in threaded engagement with a first port female thread of the gas block. In an embodiment, a port valve member is disposed in the port regulator cavity with a seating surface of the port valve member is biased to seat against a complementary surface of the port regulator housing by a port spring. In an embodiment, a forward end of the port spring seats against the port valve member and a rearward end of the port spring seats against a port retainer. In an embodiment, the port retainer comprises a second port male thread and the second port male thread is disposed in threaded engagement with a second port female thread of the port regulator housing. In an embodiment, the starboard regulator axis, the port regulator axis, and the block bore axis define a triangular prism comprising a first base, a second base and three side faces. In an embodiment, the starboard regulator axis and the block bore axis define a first plane and a first side face of the triangular prism lies in the first plane. In an embodiment, the port regulator axis and the block bore axis define a second plane and a second side face of the triangular prism lies in the second plane. In an embodiment, the starboard regulator axis and the port regulator axis define a third plane and a third side face of the triangular prism lies in the third plane.

A semiautomatic shotgun in accordance with one or more embodiments comprises a receiver defining a receiver interior and a barrel attached to a forward portion of the receiver. The barrel has a breech end and a muzzle end. A barrel wall of the barrel extends between the breech end and the muzzle end. The barrel wall defines a barrel bore extending along a longitudinal axis of the barrel. The barrel wall defines a firing chamber with the barrel bore, the firing chamber being dimensioned and configured to receiving a shell.

In one or more embodiments, a breech block is slidably received in the receiver interior. The breech block is movable between a forward position in which the breech block engages the breech end of the barrel for firing a chambered shell and a rearward position in which the breech block is positioned rearward of the breech end of the barrel for discharging a spent shell. A magazine tube is attached to a forward portion of the receiver. The magazine tube has a rearward end and a forward end. A magazine wall of the magazine tube extends between the rearward end and the forward end. The magazine wall defines a magazine tube bore extending along a longitudinal axis of the magazine tube.

In one or more embodiments, the semiautomatic shotgun includes a sleeve having a circular or tubular shape and comprising a sleeve wall. The sleeve wall having an outer surface and an inner surface. The inner surface of the sleeve wall defining a lumen. The sleeve is positioned so that the sleeve wall encircles the magazine tube with the magazine tube extending through the lumen. The sleeve has a rearward end and a forward end. A first sealing ring is disposed between the inner surface of the sleeve and an outer surface of the magazine tube. In embodiments addition sealing rings may be placed between the inner surface of the sleeve and an outer surface of the magazine tube. One or more second sealing rings may be disposed between the outer surface of the sleeve and an inner facing bore surface of the gas block. The space between the inner facing surface of the gas block and the outer surface of the magazine tube defining an annular expansion chamber and the sleeve defining an annular piston.

In one or more embodiments, the gas block defines a channel and an upward facing opening fluidly communicating with the channel. The barrel extends into the channel. In one or more embodiments, the gas block is fixed to the barrel. The gas block has a rearward end and a forward end. The gas block has a body extending in a forward direction from the rearward end to the forward end and extending in a rearward direction from the forward end to the rearward end. The body of the gas block defines a pair of chambers, a starboard regulator cavity and a port regulator cavity.

In one or more embodiments, the starboard regulator cavity comprises a forward starboard bore, a rearward starboard bore and a starboard step or shoulder defining a valve seat between the forward starboard bore and the rearward starboard bore. The forward starboard bore extends in the forward direction away from the starboard valve seat. The starboard rearward bore extends in the rearward direction away from the starboard valve seat. The forward starboard bore is defined by a forward bore surface of the gas block. The rearward starboard bore is defined by a rearward bore surface. The starboard valve seat comprises a starboard valve seat surface extending between the forward starboard bore surface and the starboard rearward bore surface. The forward starboard bore has a first diameter, the starboard rearward bore has a second diameter. In one or more embodiments, the second diameter is greater than the first diameter. The forward starboard bore surface meets the starboard valve seat surface at an edge. A starboard valve member is disposed in the starboard regulator cavity. A seating surface of the starboard valve member is biased to seat against the edge by a starboard spring. A starboard guide extends through a lumen defined by the starboard spring and into a starboard pocket defined by the starboard valve member.

In one or more embodiments, the starboard forward bore of the starboard regulator cavity fluidly communicates with the barrel bore via a starboard passageway defined by the gas block and a starboard hole defined by the barrel. The forward starboard bore of the starboard regulator cavity fluidly communicates with the annular volume via a starboard aperture. Upon firing a shell with the shotgun, combustion gasses within the barrel enter the annular volume via the starboard hole and the port hole to move the sleeve and a slider rearward for cycling a mechanism disposed in the receiver interior.

In one or more embodiments, the semiautomatic shotgun includes a slider comprising a slider wall. The slider wall has an outer surface and an inner surface with the inner surface defining a lumen. The slider is positioned so that the slider wall encircles the magazine tube and the magazine tube extends through the lumen. The slider having a rearward end and a forward end. The slider wall extends between the rearward end and the forward end. A slider assembly includes the slider and a starboard leg having a forward end and a rearward end. A portion of the starboard leg proximate the forward end is fixed to the slider. A portion of the starboard leg proximate the rearward end engages the mechanism disposed inside the receiver interior. The slider assembly also includes a port leg having a forward end and a rearward end. A portion of the port leg proximate the forward end is fixed to the slider. A portion of the port leg proximate the rearward end engages the mechanism disposed inside the receiver interior.

A feature and advantage of embodiments of the invention is that the two regulators can be adjusted to have different pressure relief points wherein considering restricted volumetric passages to each, one may release for a certain barrel pressure, for example for a lowered powered cartridge, and the other does not release. And wherein for a higher pressure cartridge, both regulators may release.

A feature and advantage of embodiments is a semiautomatic shotgun that reliably cycles shotshells of different propellant loads.

A feature and advantage of embodiments is a semiautomatic shotgun with non adjustable pressure relief valves.

A feature and advantage of embodiments is a semiautomatic shotgun that reliably cycles shotshells of different propellant loads. In embodiments, a one-piece unitary action bar facilitates disassembly, cleaning, and maintenance.

A feature and advantage of embodiments is a semiautomatic shotgun with pressure relief valves that are self-cleaning, non-adjustable (without breaking high strength thread lock) and highly reliable, and resist carbon buildup.

A feature and advantage of embodiments is a semiautomatic shotgun that provides dual pressure relief valves adding reliability, redundancy, and a compact form factor. Moreover, the gas from the propellant is provided to the piston in a more balanced manner than conventional gas operated shotguns.

A feature and advantage of embodiments is a semiautomatic shotgun that is "over-gassed" taking more gas out of the barrel than typical. The over-gassing provides a wider range of cycling different powered shells and is accommodated by an enhanced recoil buffer system that allows faster cycling for high powered shells while minimizing the recoil felt by the user. Additionally a one piece action bar assembly eliminates or minimizes failures of the cycling system coming apart with loosening of connectors at this high speed of recycling. In embodiments, the gas ports are at least six inches from the rearward end of the firing chamber providing sufficient gas for operating the cycling mechanism with a wide range of differently powered shells without, it is believed sacrificing any meaningful kinetic energy of the projectiles being fired. Moreover, utilizing multiple ports per valve, rather than one, provides easier less costly manufacturing.

A feature and advantage of embodiments is a semiautomatic shotgun that provides dual pressure relief valves adding reliability, redundancy, and a compact form factor. Moreover, the gas from the propellant is provided to the piston in a more balanced manner than conventional gas operated shotguns.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 49 is a perspective view of a cam pin with an O-ring.

FIG. 50 is a perspective view of a trigger mechanism retention pin with an O-ring.

FIG. 51 is a perspective view of the charging handle in accord with embodiments.

FIG. 52 is a perspective view of an interior magazine tube cap retention pin with a pair of O-rings.

FIG. 53 is a perspective view of a firing pin retention pin with an O-ring.

Figure 1A:
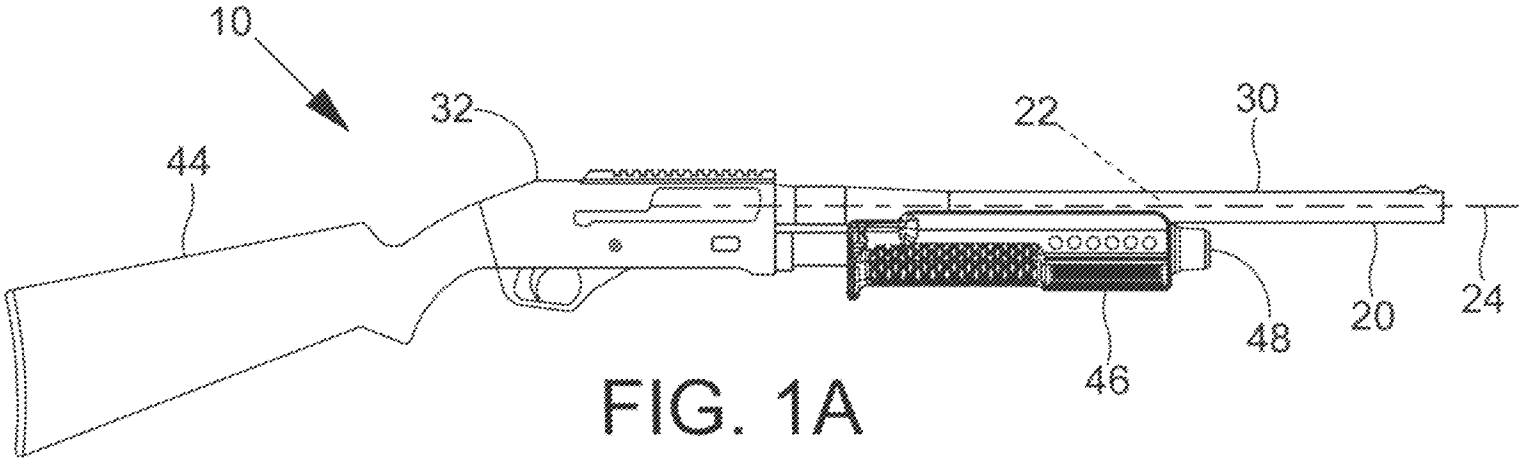
FIG. 1A is a side elevation view showing a shotgun in accordance with an embodiment described in the detailed description.
Figure 1B:
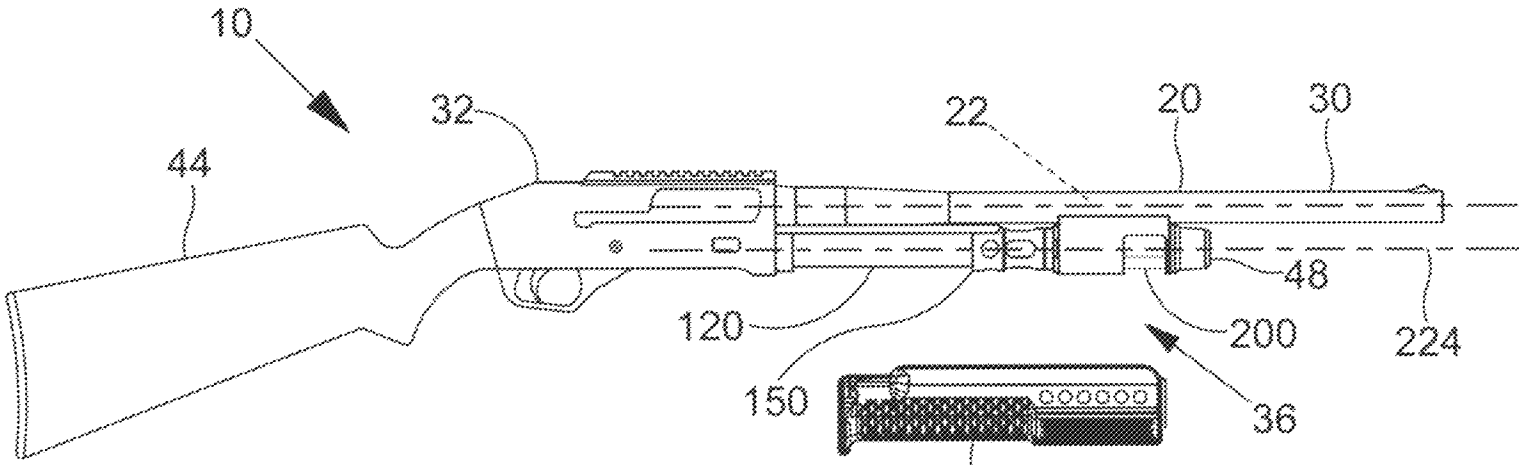
FIG. 1B is a partially exploded side view of the shotgun shown in FIG. 1A.
Figure 2:
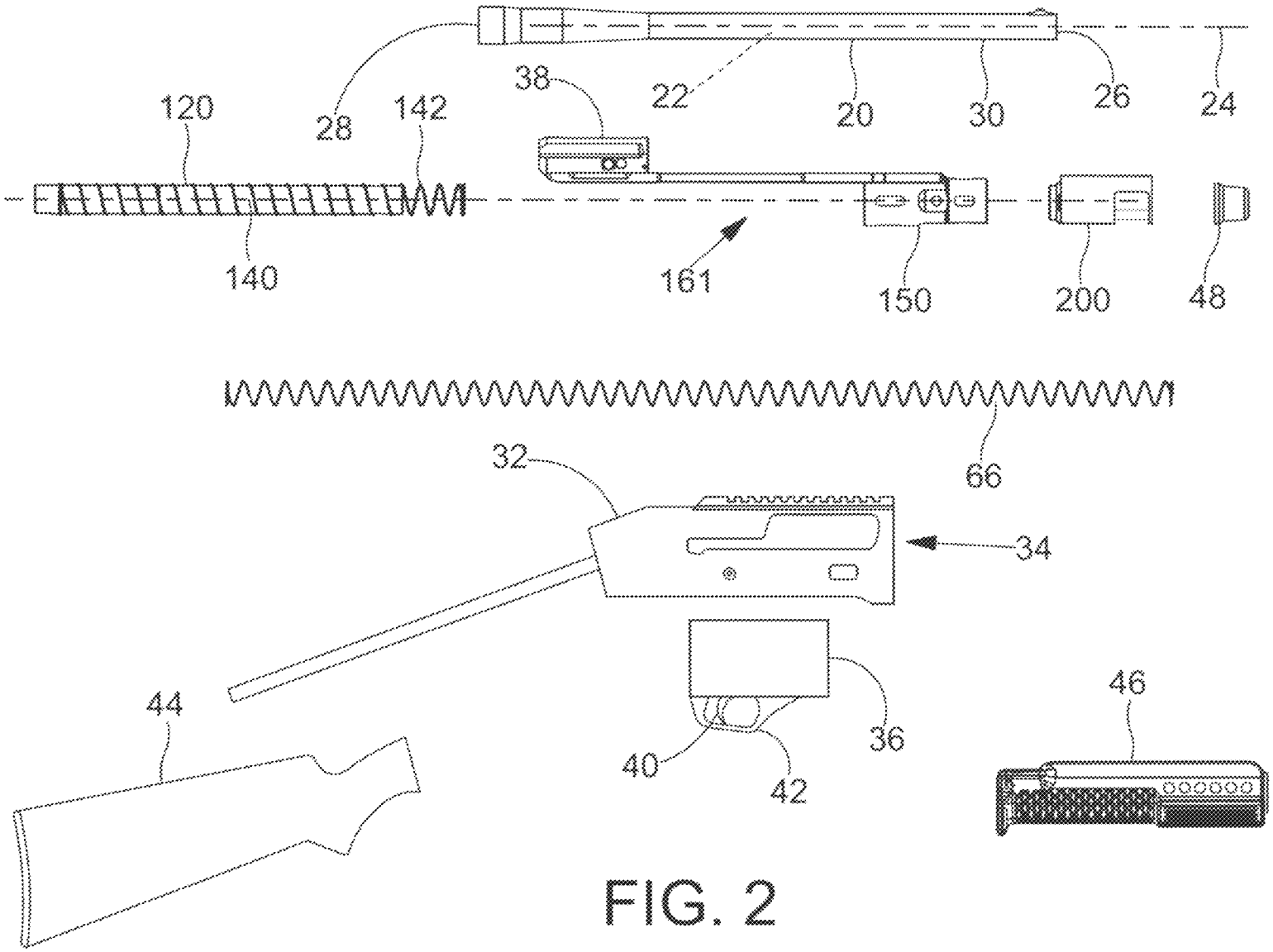
FIG. 2 is an exploded side view of the shotgun shown in FIG. 1A.
Figure 3A:
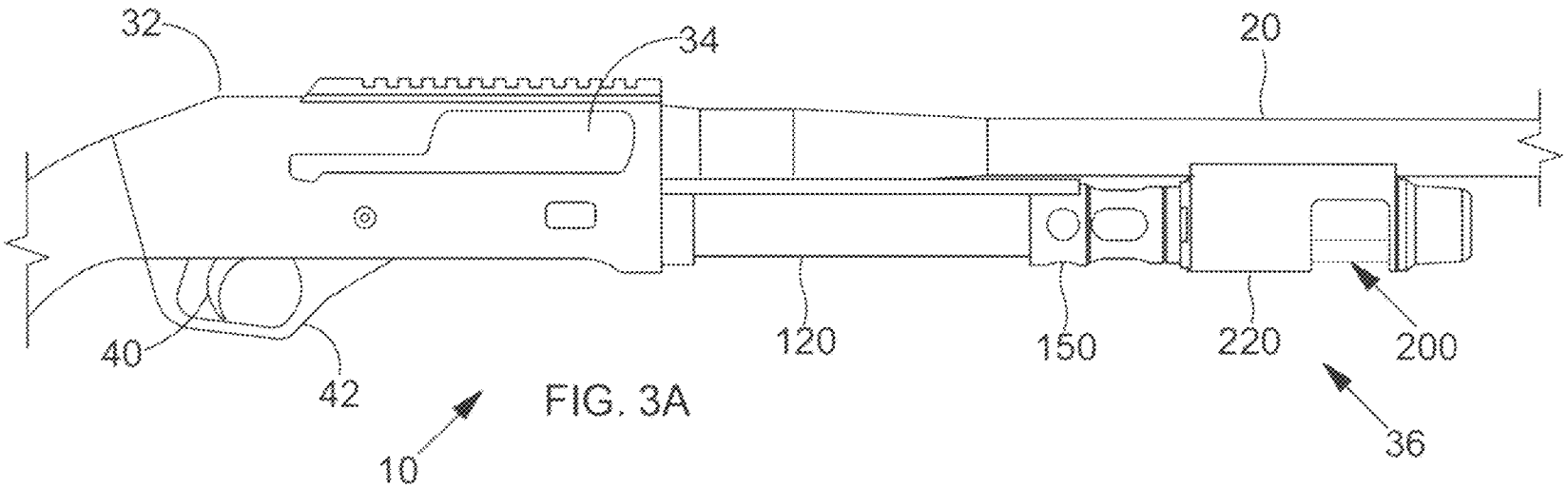
FIG. 3A is an enlarged side view of the shotgun shown in FIG. 1B.
Figure 3B:
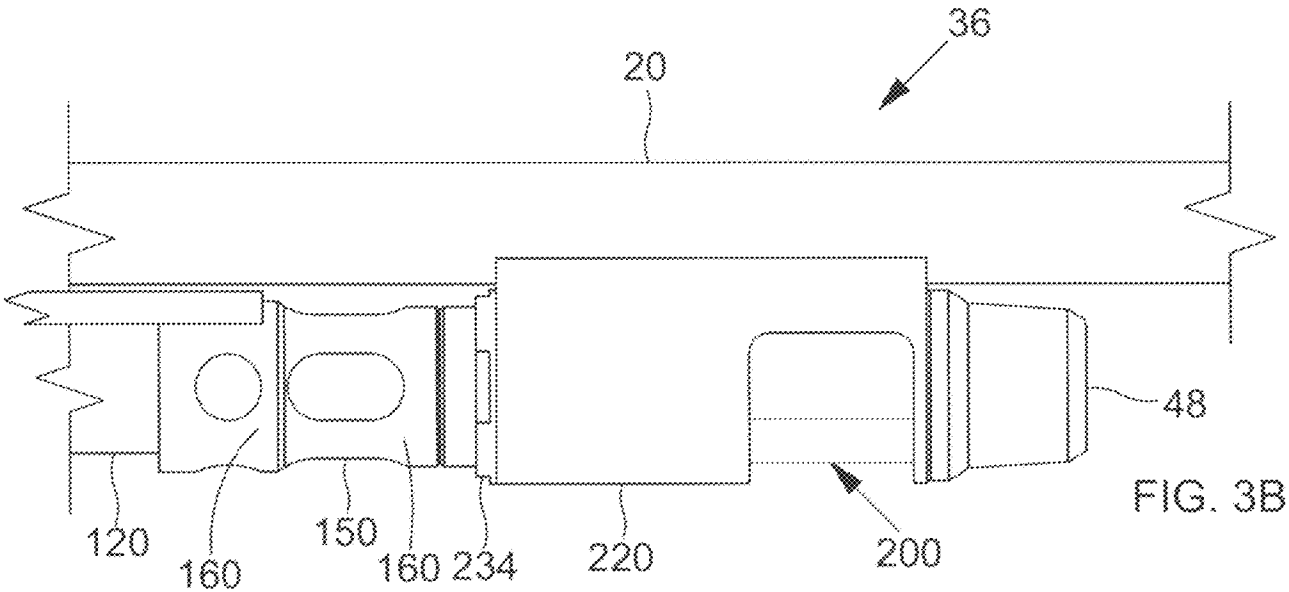
FIG. 3B is an enlarged side view further illustrating a portion of the shotgun shown in FIG. 3A.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring, for example, to FIGS. 1-3A, a semiautomatic shotgun 10 in accordance with one or more embodiments comprises a receiver 32 defining a receiver interior 34 and a breech block 38 that is slidably received in the receiver interior 34. The breech block 38 is movable between a forward position in which the breech block 38 engages the breech end 28 of the barrel 20 for firing a chambered shell and a rearward position in which the breech block 38 is positioned rearward of the breech end 28 of the barrel 20 for discharging a spent shell. A barrel 20 and a magazine tube 120 extend forwardly from a forward portion of the receiver 32. The barrel 20 has a breech end 28 and a muzzle end 26. A barrel wall 30 of the barrel 20 extends from the breech end 28 to the muzzle end 26. The barrel wall 30 defines a barrel bore 22 extending along a barrel axis 24 of the barrel 20. The barrel wall 30 defines a firing chamber and barrel bore 22, the firing chamber being dimensioned and configured to receiving a shell. The magazine tube 120 has a rearward end and a forward end. A magazine wall 130 of the magazine tube 120 extends between the rearward end and the forward end. The magazine wall 130 defines a magazine tube bore extending along a magazine axis of the magazine tube 120. The barrel axis 24 and the magazine axis 140 define a vertical plane.

Referring, for example, to FIGS. 14-20F, a semiautomatic shotgun 10 in accordance with one or more embodiments comprises a receiver 32 defining a receiver interior 34 and a barrel 20 attached to a forward portion of the receiver 32. The shotgun is particularly suited for firing shotshells 33 of different power levels. The barrel 20 has a barrel wall 30 defining a barrel bore 22 extending along a barrel axis 24 of the barrel 20. The barrel wall 30 defines a firing chamber that is dimensioned and configured to receiving the shells of different power levels. A breech block 38 is slidably received in the receiver interior 34. The breech block 38 or bolt carrier group is movable between a forward position in which the breech block 38 engages the breech end 28 of the barrel 20 for firing a chambered shell and a rearward position in which the breech block 38 contacts a plunger 52 of a plunger assembly 50.

Referring to FIGS. 20A to 20G, in one or more embodiments, the spring loaded or buffered plunger assembly 50 comprises the plunger 52, a first coil spring 82, and a second coil spring 84. In one or more embodiments, the first coil spring 82 defines a spring lumen 80 and the second coil spring 84 is disposed inside the spring lumen 80 defined by the first coil spring 82.

In one or more embodiments, a return spring 142 provides a return force urging the breech block 38 toward the forward position.

Figure 20A:
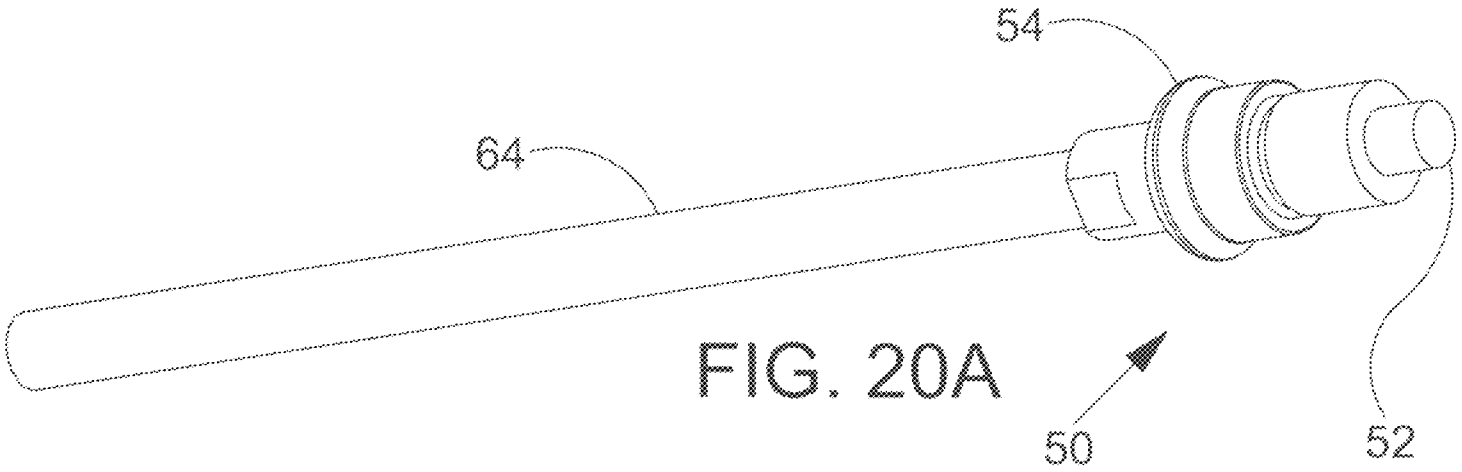
FIG. 20A is a perspective view showing an assembly including a stock rod and a spring loaded plunger assembly.
Figure 20B:
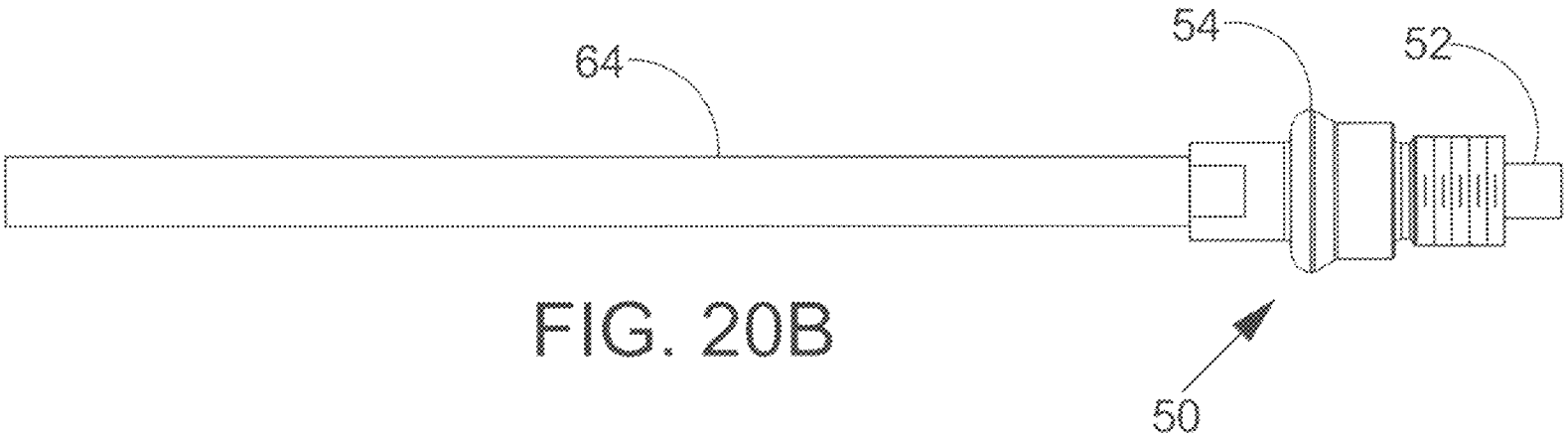
FIG. 20B is a side view showing an assembly comprising a spring loaded plunger assembly including a plunger and a plunger housing.
Figure 20C:
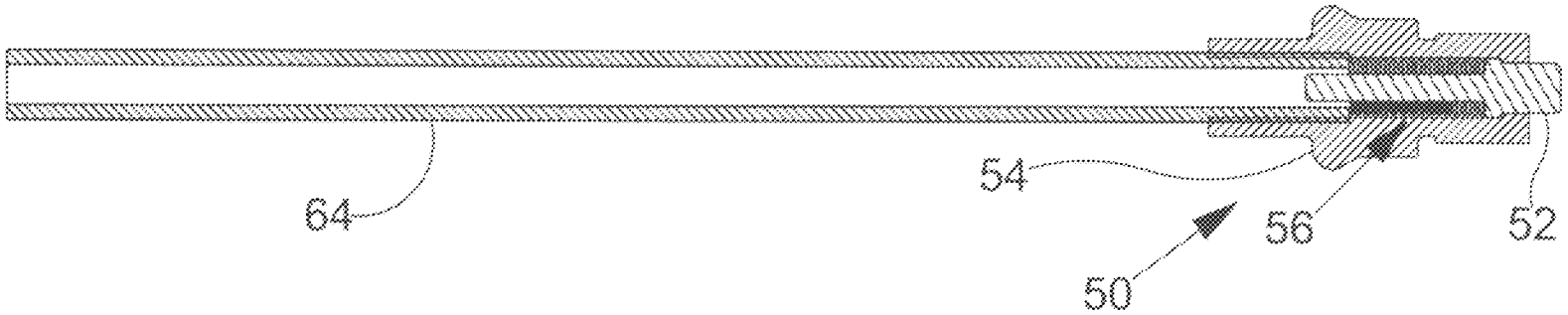
FIG. 20C is a cross-sectional view further illustrating the stock rod and the spring loaded plunger assembly shown in FIG. 20A and FIG. 20B.
Figure 20D:
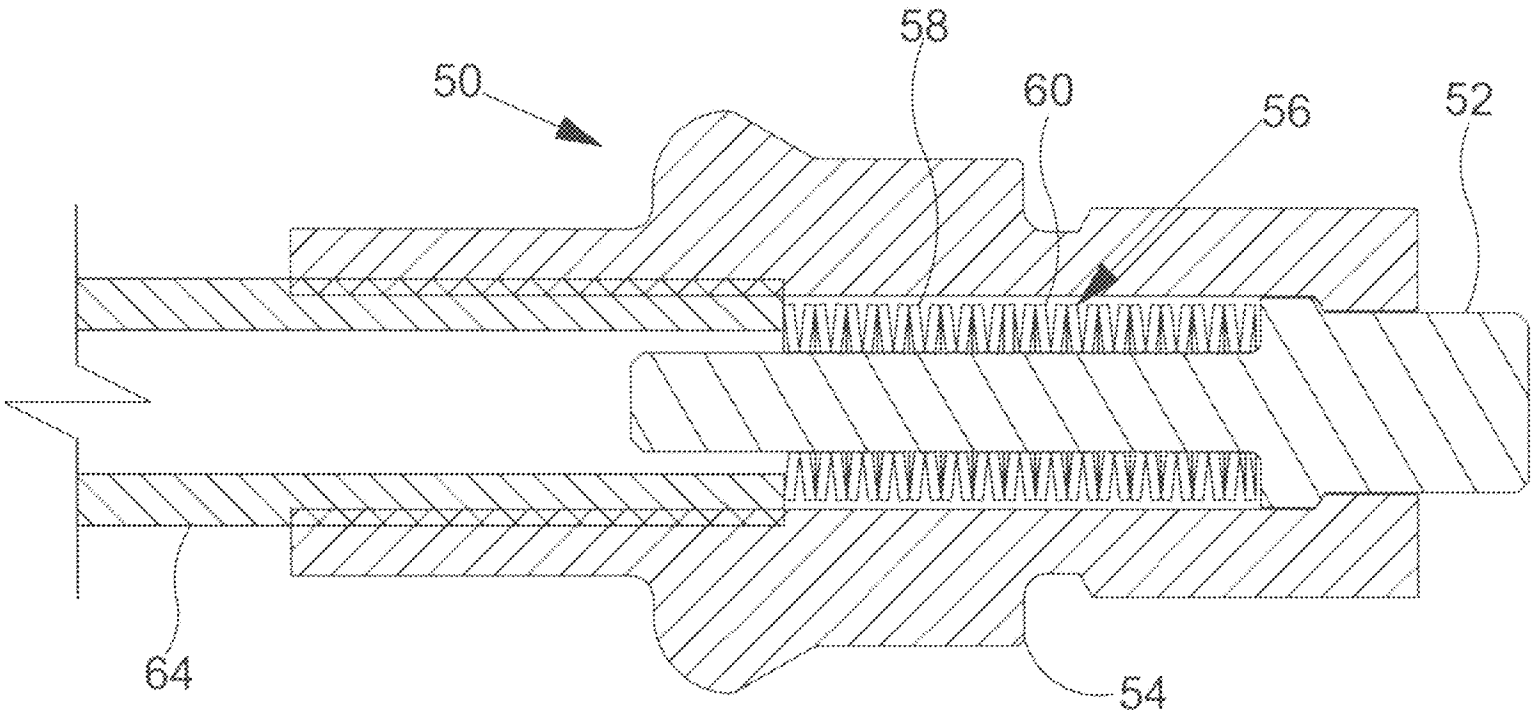
FIG. 20D is an enlarged cross-sectional view further illustrating the spring loaded plunger assembly shown in FIG. 20C.
Figure 20E:
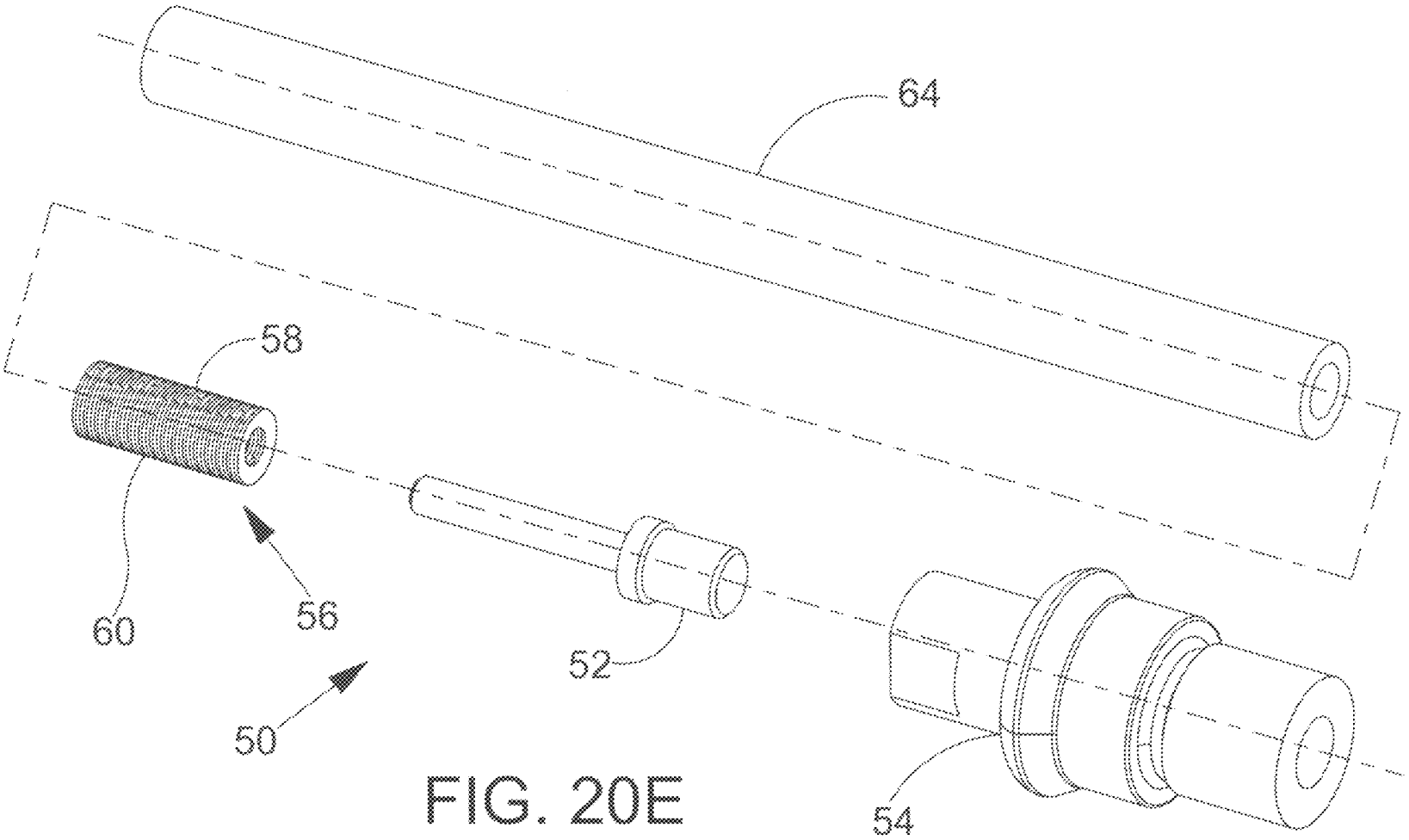
FIG. 20E is an exploded view further illustrating the stock rod and the spring loaded plunger assembly shown in FIG. 20A through FIG. 20D.
Figure 20F:
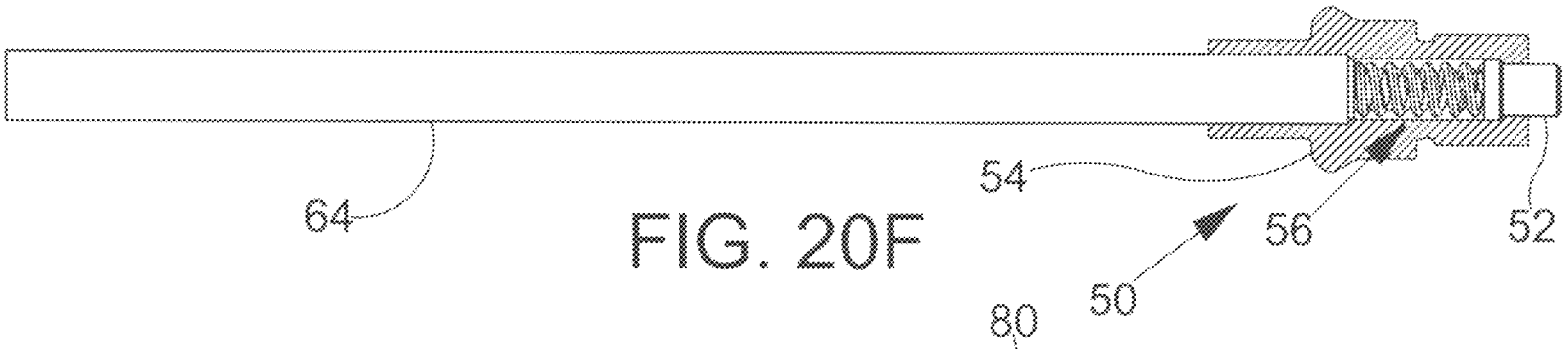
FIG. 20F is a cross-sectional view further illustrating the stock rod and the spring loaded plunger assembly in accordance with an additional embodiment.
Figure 20G:
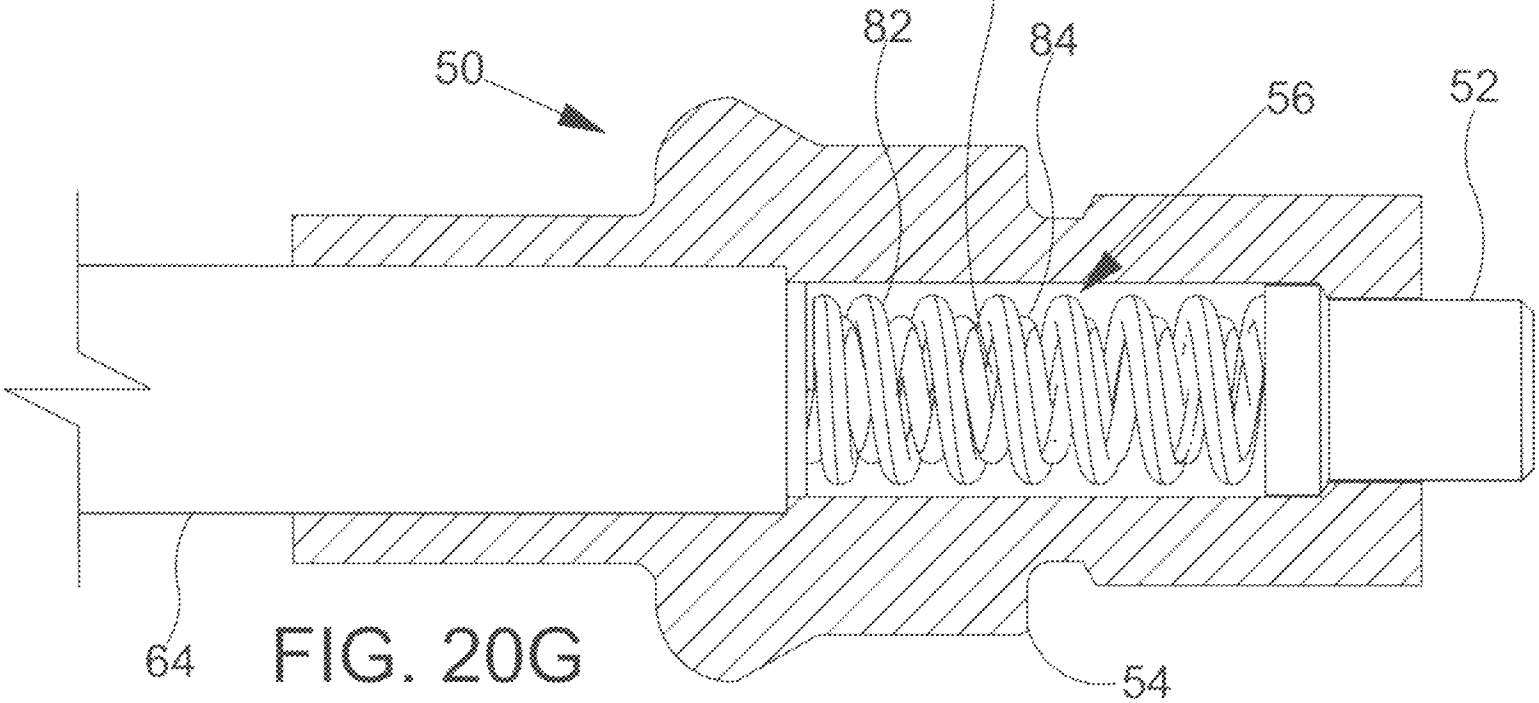
FIG. 20G is an enlarged cross-sectional view further illustrating the spring loaded plunger assembly shown in FIG. 20F.
Figure 20H:
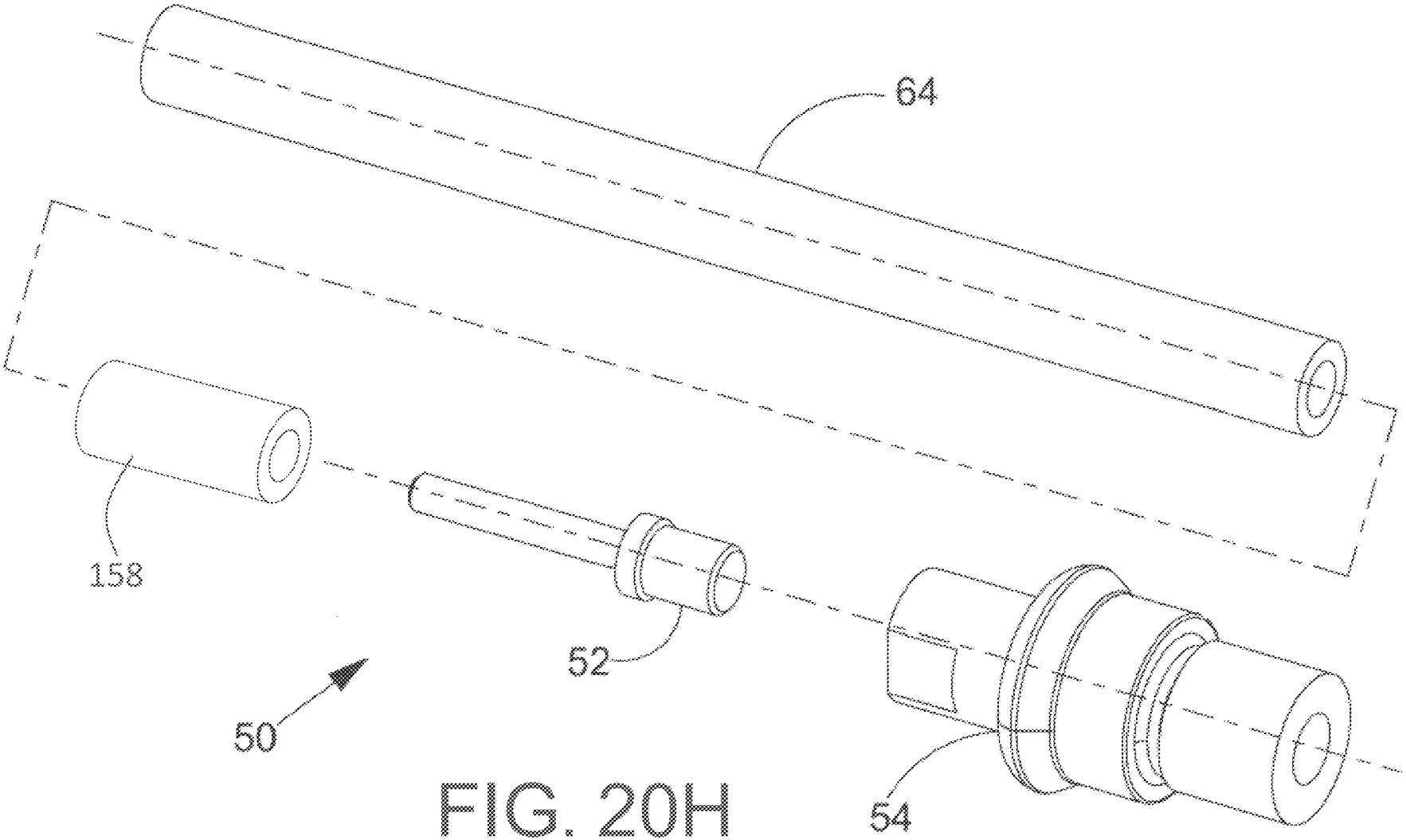
FIG. 20H is an exploded view of another plunger assembly utilizing a polymer tube to dampen.
Figure 20I:
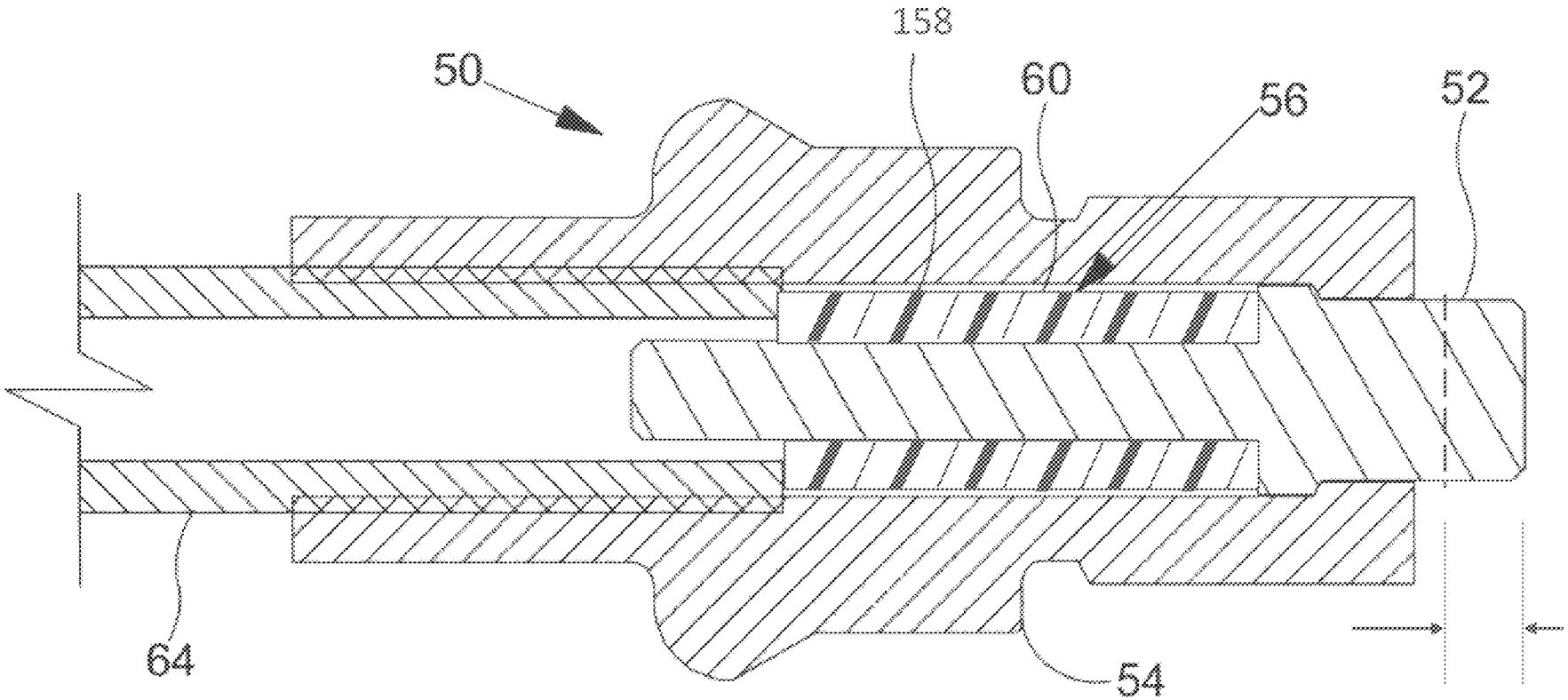
FIG. 20I is an cross sectional view of an assembled plunger assembly of the components of FIG. 20H.
Figure 21:
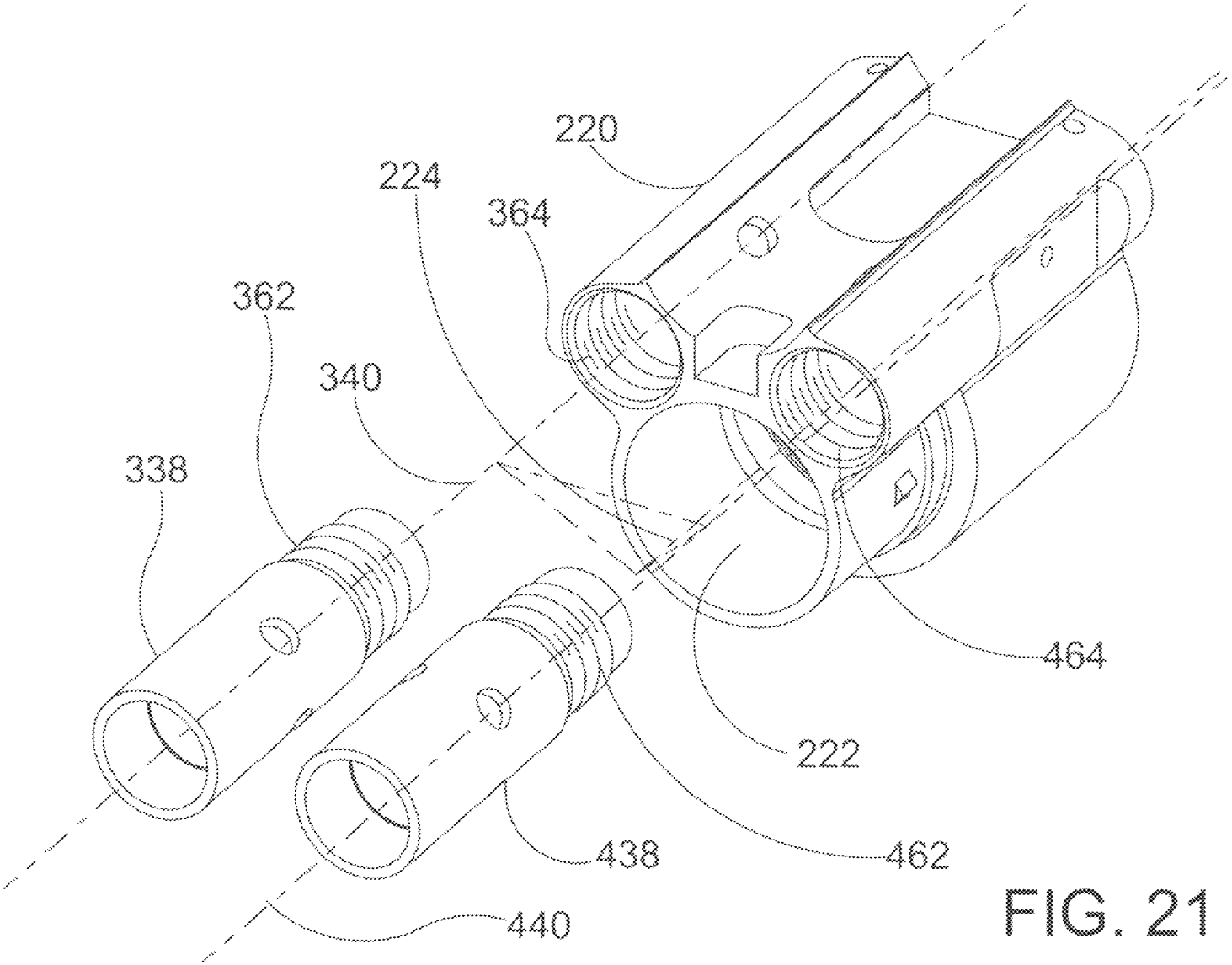
FIG. 21 is an exploded perspective view showing an assembly.
Figure 22:
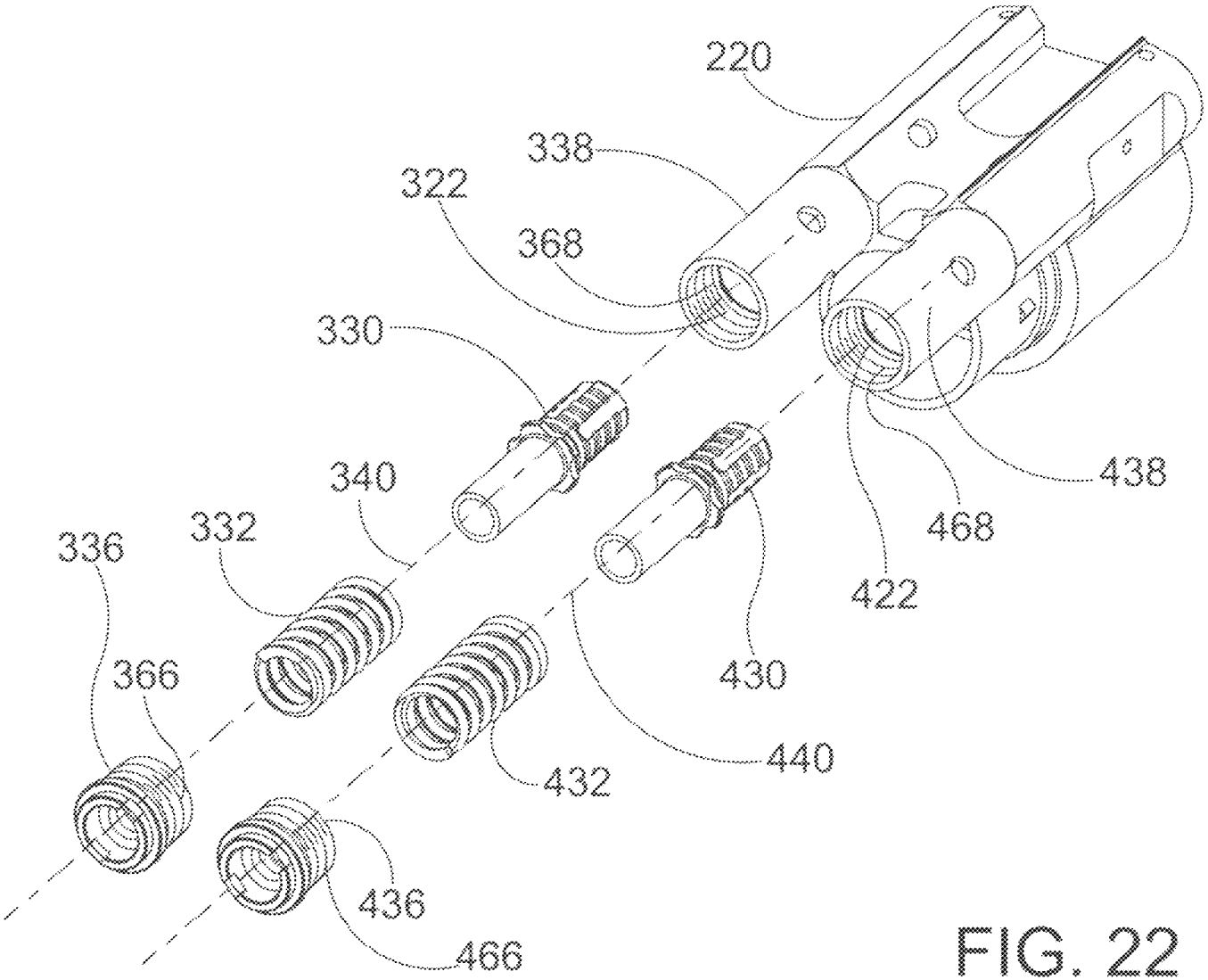
FIG. 22 is an exploded perspective view showing an assembly including the assembly of FIG. 21.
Figure 23:
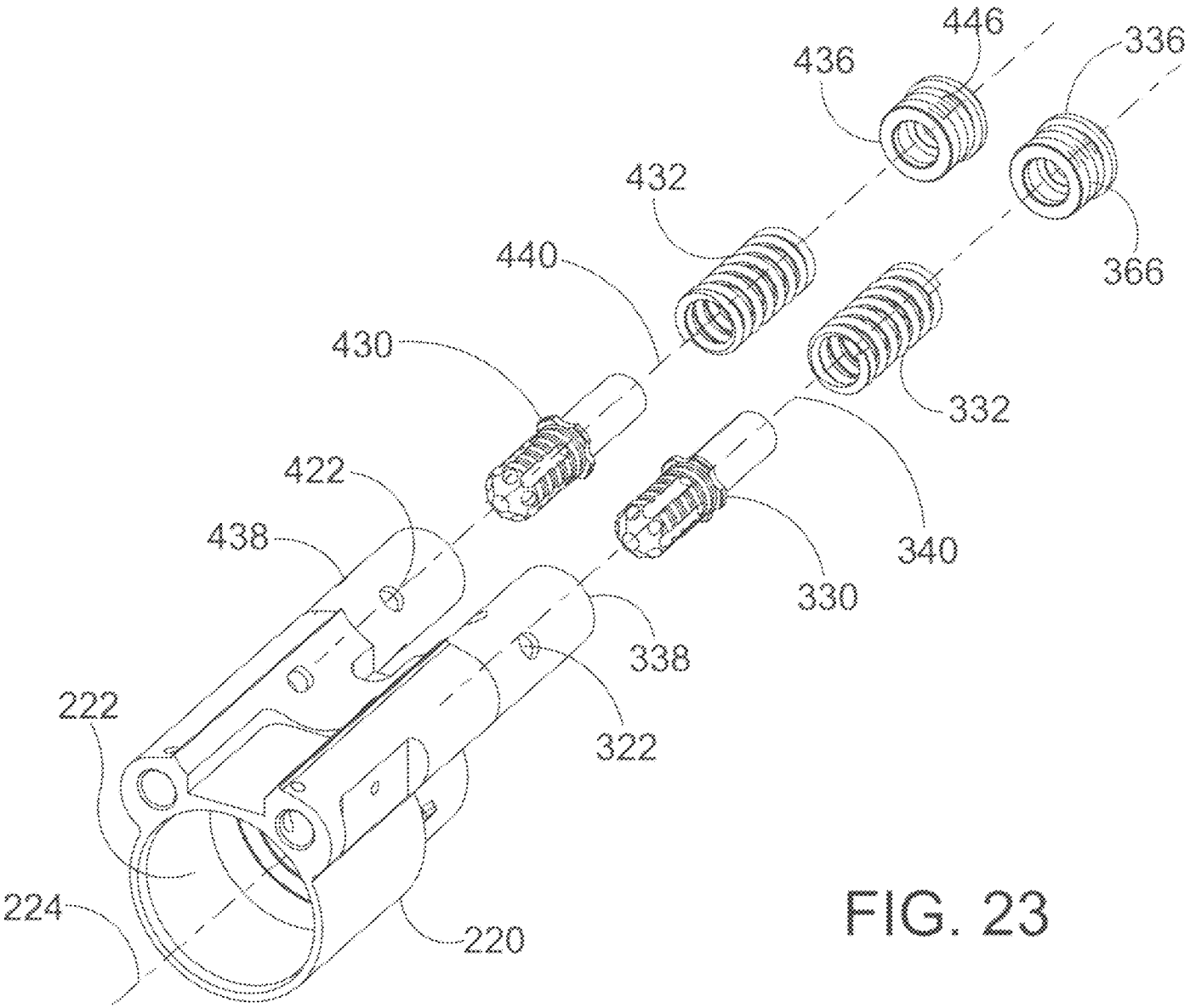
FIG. 23 is an exploded perspective view showing the assembly of FIG. 22 from another viewing angle.
Figure 24A:
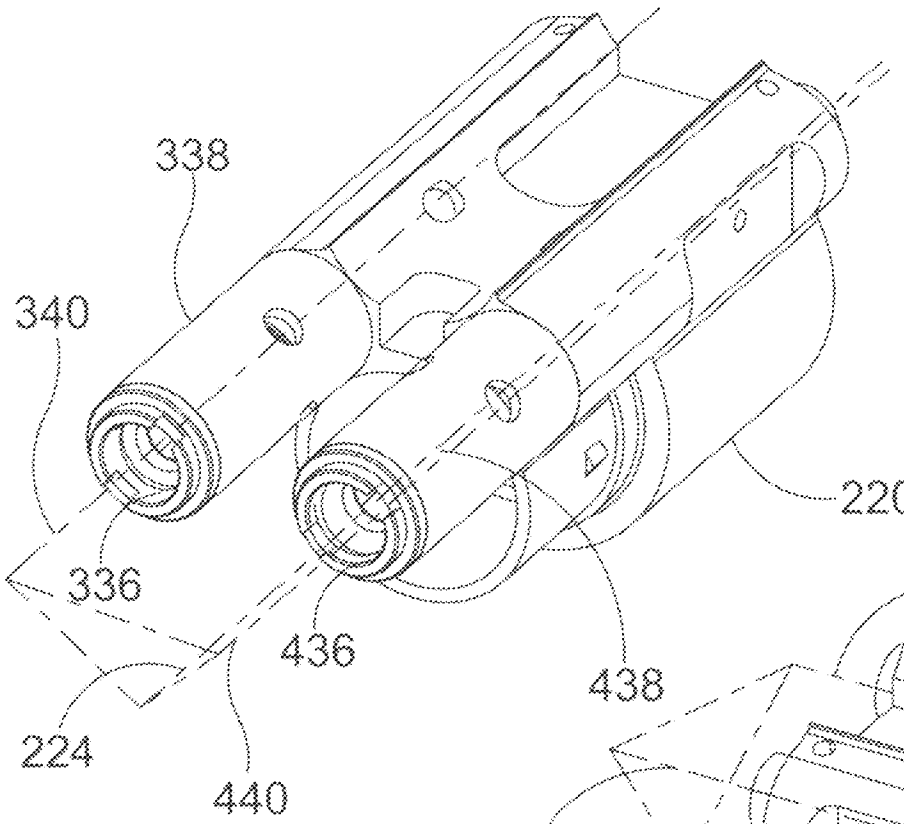
FIG. 24A is an isometric view showing an assembly.
Figure 24B:
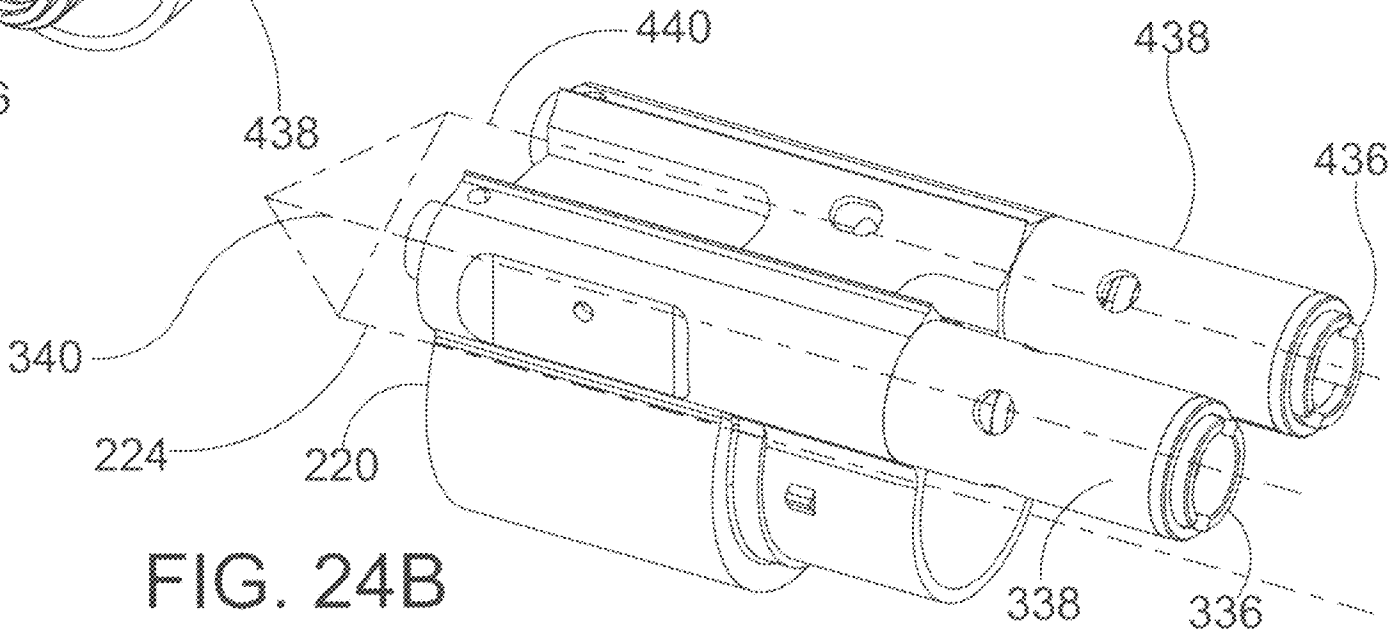
FIG. 24B is an isometric view showing an assembly.
Figures 25A, 25B, 25C:
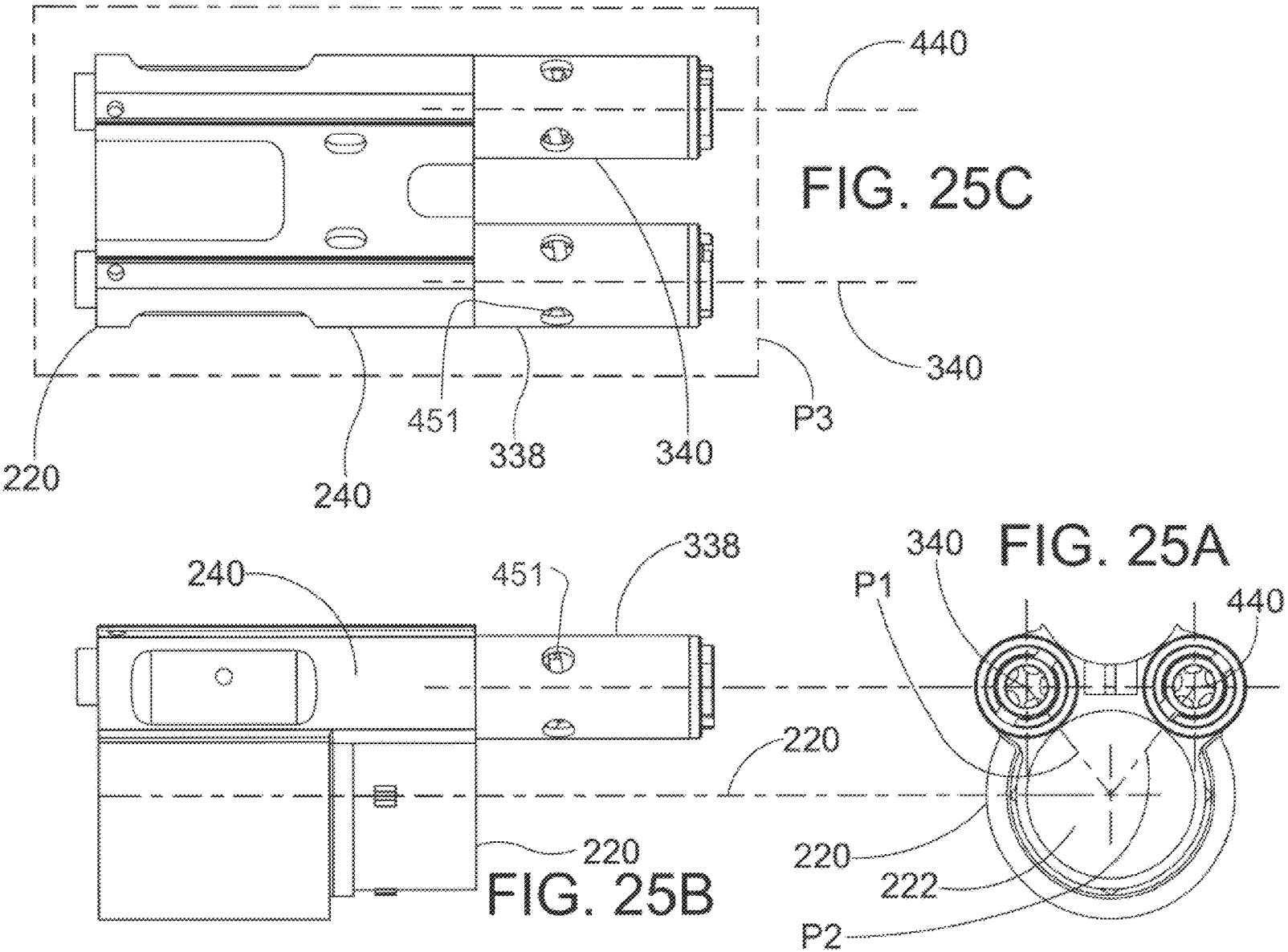
FIG. 25A is a front view showing an assembly.
FIG. 25B is a side view showing an assembly.
FIG. 25C is a top view showing an assembly.
Figures 25D, 25E:
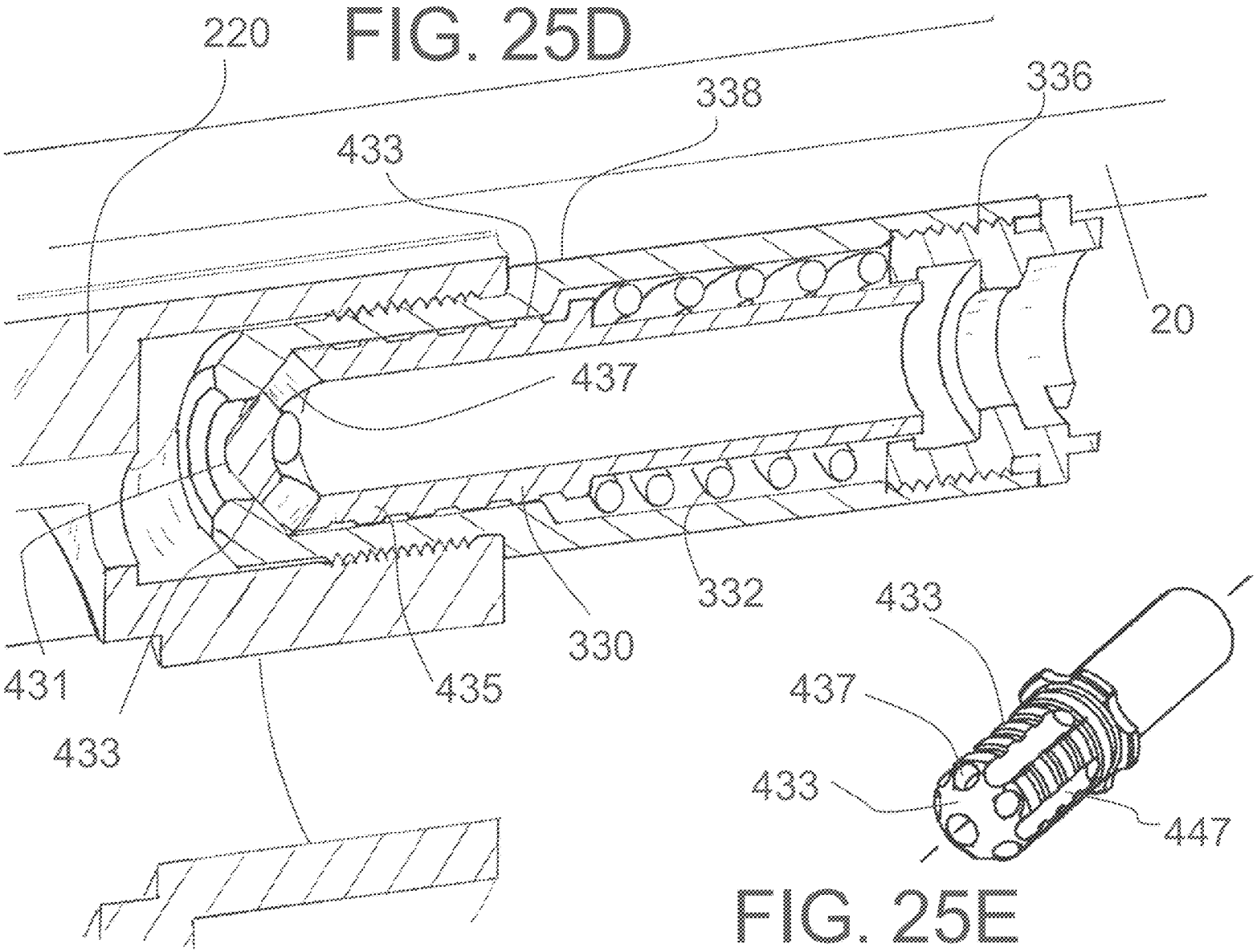
FIG. 25D is a cross sectional view of the gas block and relief valve assembly of FIGS. 21-25C on a barrel.
FIG. 25E is a perspective view of the valve member of FIG. 25D.
Figure 26:
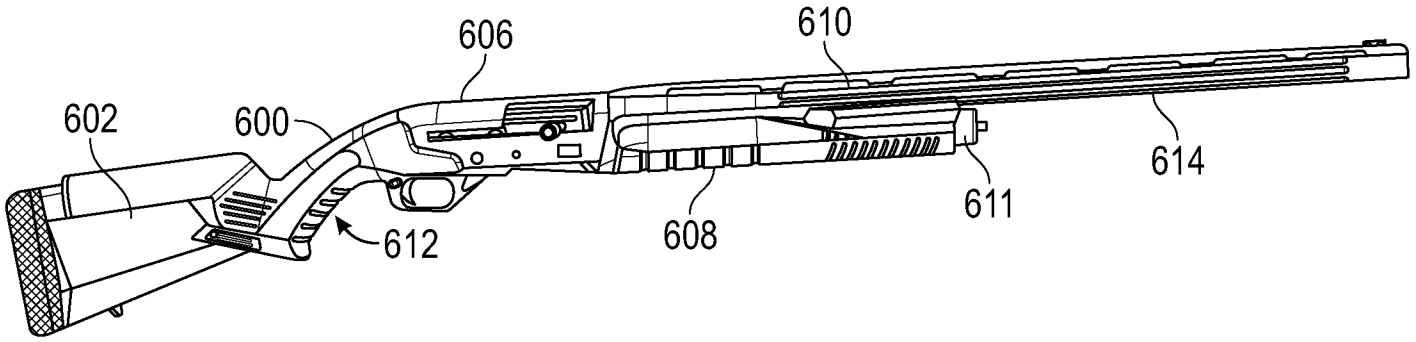
FIG. 26 is a side elevation view of a shotgun in accord with embodiments.
Figure 27:
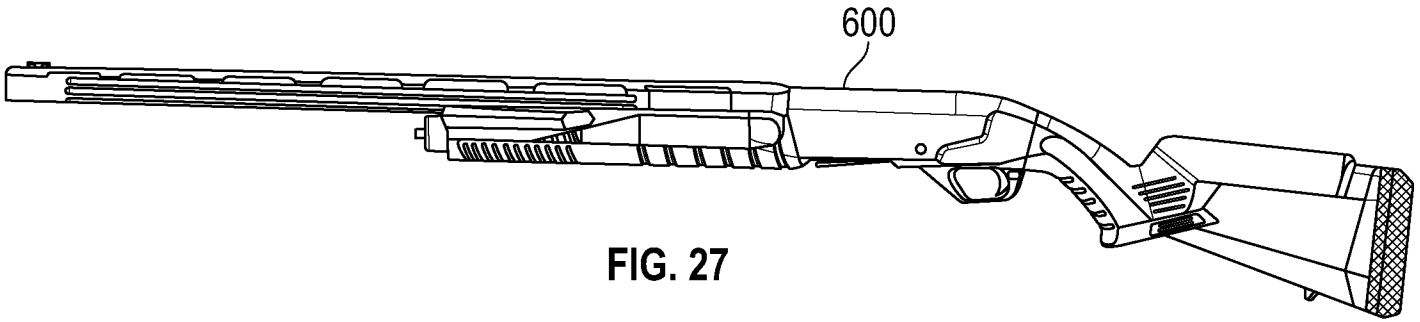
FIG. 27 is a side elevation view of the shotgun of FIG. 26 from the opposite side.

Referring to FIGS. 20H and 201, rather than a metal spring, a polymer tube 158 may be provided that provides less rebound and more shock absorption. The polymer tube may be clamped under compression before installation in the stock of the shotgun. The tip of the plunger may extend into the receiver for engagement of the breech block, or bolt assembly, to buffer the kinetic energy. Such a tube has been found to provide more absorption of the energy of the retracking breech block than conventional steel springs.

In one or more embodiments, a gas operated mechanism 36 is disposed about the magazine tube 120 and the gas operated mechanism 36 comprises an annular shaped piston 250. In one or more embodiments, combustion gasses apply pressure to a forward facing surface of the annular shaped piston 250, the pressure applied to the annular shaped piston creates a rearward force, and the rearward force urges the breech block 38 toward the rearward position. In one or more embodiments, a slider 150 configured as a sleeve is disposed about the magazine tube 120 at a location rearward of the annular shaped piston 250. In one or more embodiments, an action bar 163 comprising a port leg 166 and a starboard leg 164 extend between the slider 150 and the breach block 38. In one or more embodiments, combustion gasses apply pressure to a forward facing surface of the annular shaped piston 250, the pressure applied to the annular shaped piston creates a rearward force, and the rearward force is transferred to the breech block 38 by the sleeve, the starboard leg 164 and the port leg 166.

Referring, for example, to FIGS. 14-25C, a semiautomatic shotgun 10 in accordance with one or more embodiments comprises a receiver 32, a barrel 20 and a magazine tube 120. The barrel 20 and the magazine tube 120 both extend forward beyond a forward end of the receiver 32 with the magazine tube 120 being located below the barrel 20. A gas operated mechanism 36 is disposed about the magazine tube 120. In one or more embodiments, the gas operated mechanism 36 comprises an annular shaped piston 250 and gas block assembly 200. The gas block having a rearward body portion 240 defining a lumen and two forwardly extending tubular extensions comprising a starboard tubular extension 338 and a port tubular extension 438 defining a starboard regulator cavity 322 and a port regulator cavity 422 respectively. In one or more embodiments, the semiautomatic shotgun 10 includes a starboard regulator assembly 320 disposed in the starboard regulator cavity 322 and a port regulator assembly disposed in the port regulator cavity. The semiautomatic shotgun 10 may also include a breech block 38 that is slidably received in the receiver interior 34. In one or more embodiments, the breech block 38 is movable between a forward position in which the breech block 38 engages the breech end 28 of the barrel 20 for firing a chambered shell, and a rearward position in which the breech block 38 contacts a plunger 52 of a spring loaded plunger assembly 50. A rearward force produced by the gas block assembly 200 urges the breech block 38 toward the rearward position.

A semiautomatic shotgun in accordance with the embodiments described in the preceding paragraph may further include a gas block assembly 200 including a gas block 220 that is disposed about the magazine tube 120 with the magazine tube 120 extending through the block bore 222 defined by the gas block 220. The gas block assembly 200 includes a starboard regulator assembly 320 and a port regulator assembly 420. The gas block 220 defines a starboard regulator cavity 322 and a port regulator cavity 422. The starboard regulator cavity 322 extends along a starboard regulator axis 340 and the port regulator cavity 422 extends along a port regulator axis 440. The starboard regulator axis 340 and the port regulator axis 440 define a horizontal plane. In one or more embodiments, the horizontal plane defined by the starboard regulator axis 340 and the port regulator axis 440 is perpendicular to the vertical plane defined by the barrel axis 24 and the magazine axis 140. In one or more embodiments, the starboard regulator assembly 320 and the starboard regulator cavity 322 are disposed starboard of the vertical plane defined by the barrel axis 24 and the magazine axis 140. In one or more embodiments, the starboard regulator assembly 320 and the starboard regulator cavity 322 are disposed below the barrel axis 24 and above the magazine axis 140. In one or more embodiments, the port regulator assembly 420 and the port regulator cavity 422 are disposed portward of the vertical plane defined by the barrel axis 24 and the magazine axis 140. In one or more embodiments, the port regulator assembly 420 and the port regulator cavity 422 are disposed below the barrel axis 24 and above the magazine axis 140.

A semiautomatic shotgun in accordance with the embodiments described in the preceding paragraph may further include a sleeve 252 comprising a sleeve wall 262 extending into the block bore 222 defined by a gas block 220 with a portion of the sleeve 252 disposed between an outer surface of the magazine tube 120 and inner surface of the gas block 220. In one or more embodiments, the magazine tube 120, the sleeve 252, and the gas block 220 cooperate to define an annular volume 264. The annular volume 238 communicates with the barrel bore 22 so that combustion gasses can enter the annular volume 238. The starboard regulator assembly 320 acts to release combustion gasses when the combustion gasses in the barrel bore 22 and/or the annular volume 238 reaches a first predetermined pressure. The port regulator assembly 420 acts to release combustion gasses when the combustion gasses in the barrel bore 22 and/or the annular volume 238 reaches a first predetermined pressure. In one or more embodiments, the first predetermined pressure and the second predetermined pressure are different. In one or more embodiments, the first predetermined pressure is selected to correspond to a first shotshell load and the second predetermined pressure is selected to correspond to a second shotshell load. In one or more embodiments, the first predetermined pressure and the second predetermined pressure are substantially equal. In one or more embodiments, the first predetermined pressure and the second predetermined pressure have values within 10% of one another.

Referring, for example, to FIGS. 16A-25C, a semiautomatic shotgun 10 in accordance with one or more embodiments comprises a receiver 32, a barrel 20 and a magazine tube 120. The barrel 20 and the magazine tube 120 both extend forward beyond a forward end of the receiver 32 with the magazine tube 120 being located below the barrel 20. In an embodiment, a gas operated mechanism 36 is disposed about the magazine tube 120. In an embodiment, the gas operated mechanism 36 comprises a gas block assembly 200 that including an annular shaped piston 250. In an embodiment, the annular shaped piston 250 extends into a block bore 222 defined by a gas block 220 of the gas block assembly 200. In an embodiment, the block bore 222 extends along a block bore axis 224. In an embodiment, the gas block assembly 200 includes a starboard regulator housing 338 defining starboard regulator cavity 322 that extends along a starboard regulator axis 340. In an embodiment, the starboard regulator housing 338 comprises a first starboard male thread 362 and the first starboard male thread 362 is disposed in threaded engagement with a first starboard female thread 364 of the gas block 220. In an embodiment, a starboard valve member 330 is disposed in the starboard regulator cavity 322 with a seating surface of the starboard valve member 330 is biased to seat against a complementary surface of the starboard regulator housing 338 by a starboard spring 332. In an embodiment, a forward end of the starboard spring 332 seats against the starboard valve member 330 and a rearward end of the starboard spring 332 seats against a starboard retainer 336. In an embodiment, the starboard retainer 336 comprises a second starboard male thread 366 and the second starboard male thread 366 is disposed in threaded engagement with a second starboard female thread 368 of the starboard regulator housing 338. In an embodiment, the gas block assembly 200 includes a port regulator housing 438 defining port regulator cavity 422 that extends along a port regulator axis 440. In an embodiment, the port regulator housing 438 comprises a first port male thread 462 and the first port male thread 462 is disposed in threaded engagement with a first port female thread 464 of the gas block 220. In an embodiment, a port valve member 430 is disposed in the port regulator cavity 422 with a seating surface of the port valve member 430 is biased to seat against a complementary surface of the port regulator housing 438 by a port spring 432. In an embodiment, a forward end of the port spring 432 seats against the port valve member 430 and a rearward end of the port spring 432 seats against a port retainer 436. In an embodiment, the port retainer 436 comprises a second port male thread 466 and the second port male thread 466 is disposed in threaded engagement with a second port female thread 468 of the port regulator housing 438. In an embodiment, the starboard regulator axis 340, the port regulator axis 440, and the block bore axis 224 define a triangular prism comprising a first base, a second base and three side faces. In an embodiment, the starboard regulator axis 340 and the block bore axis 224 define a first plane P1 and a first side face of the triangular prism lies in the first plane P1. In an embodiment, the port regulator axis 440 and the block bore axis 224 define a second plane P2 and a second side face of the triangular prism lies in the second plane P2. In an embodiment, the starboard regulator axis 340 and the port regulator axis 440 define a third plane P3 and a third side face of the triangular prism lies in the third plane P3

The semiautomatic shotgun 10 includes a gas block assembly 200 with regulators or pressure relief valves 202, 204. The gas block 220 defining a block bore 222. The magazine tube 120 extends through the block bore 222 defined by the gas block 220. The block bore 222 may extend along a block bore axis 224. The sleeve 252 extends into the block bore 222 defined by a gas block 220 with a portion of the sleeve 252 being disposed between an outer surface of the magazine tube 120 and inner surface of the gas block 220. A second sleeve ring 232 is disposed between an outer surface of the sleeve 252 and an inner surface of the gas block 220. The second sleeve ring 232 defining a slot 242. The magazine tube 120, the sleeve 252, and the gas block 220 cooperate to define an annular volume 264. A stop ring 234 is received in the lumen defined by the sleeve wall 262.

Figure 12:
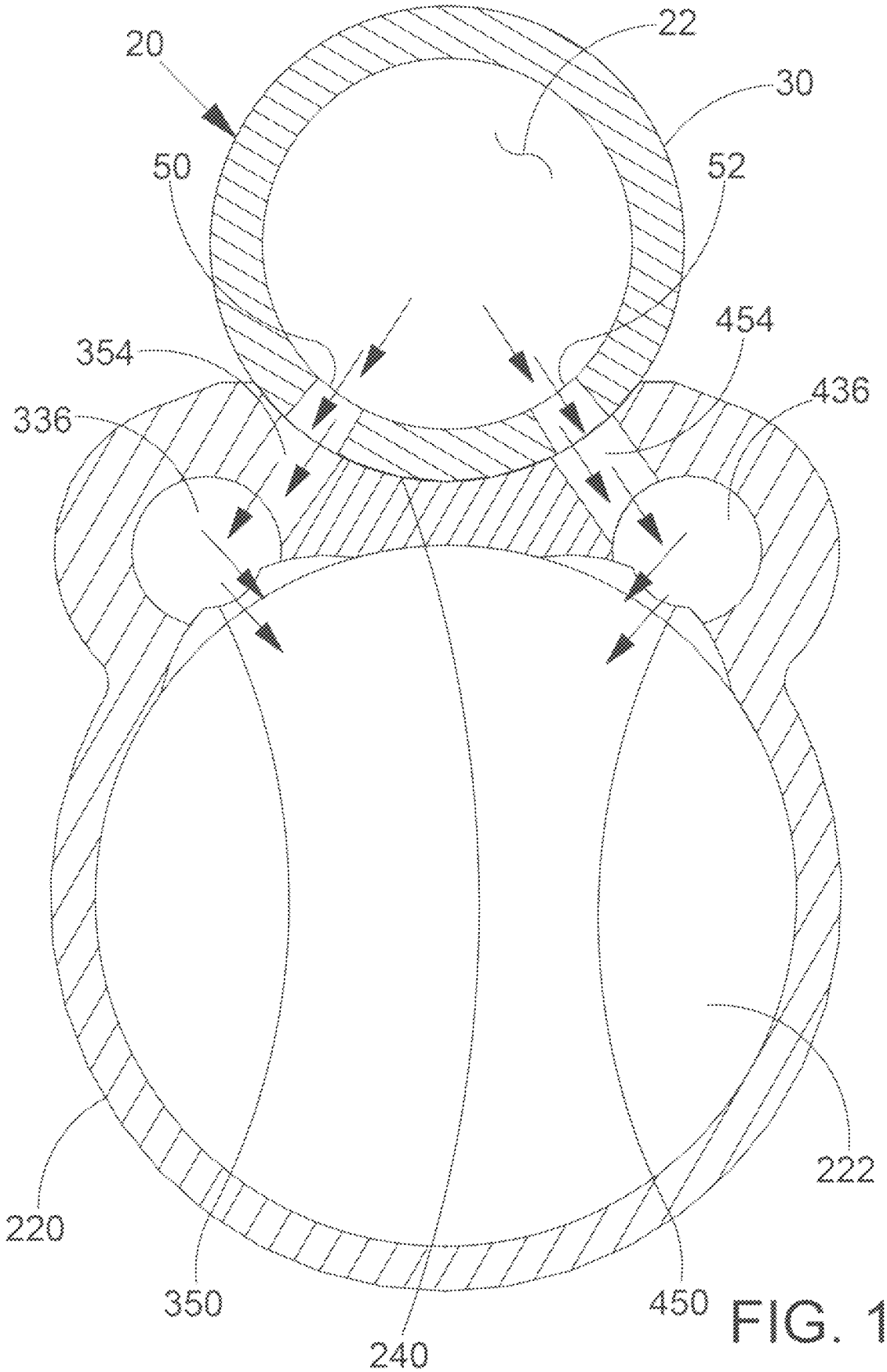
FIG. 12 is a cross-sectional view of a barrel and a gas block in accordance with an embodiment described in the detailed description.
Figure 12A:
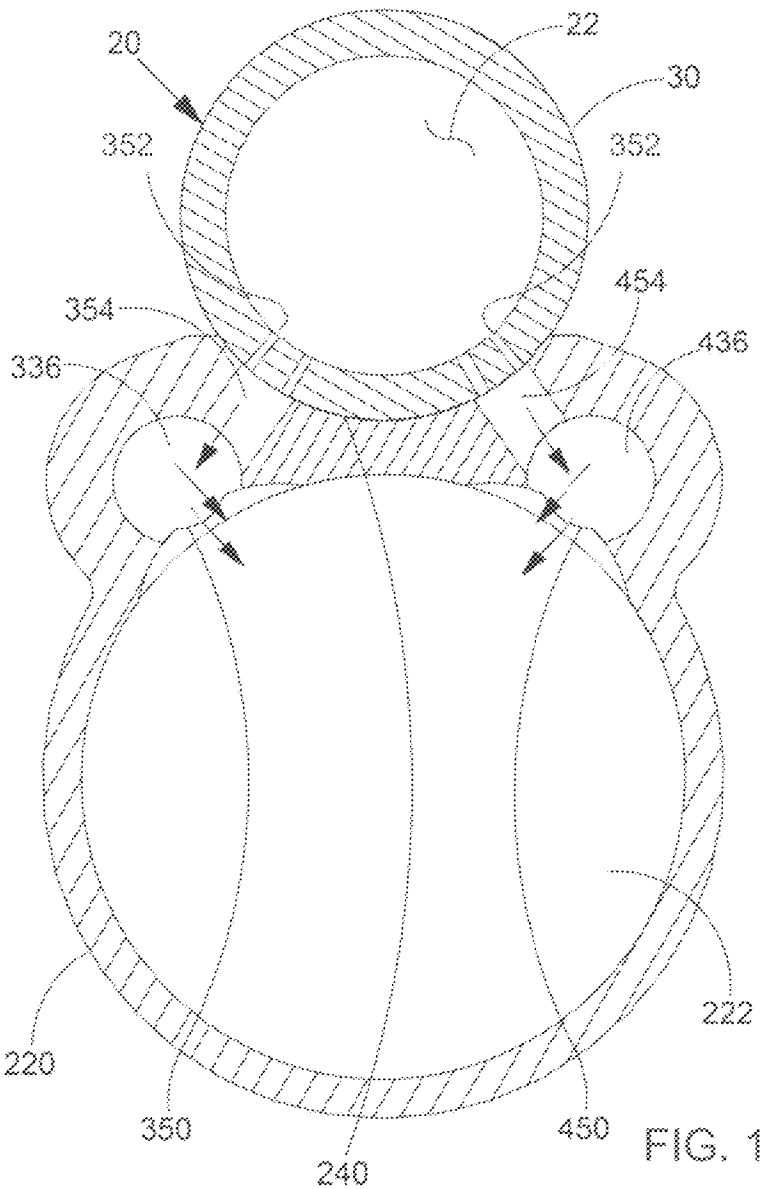
FIG. 12A is a cross-sectional view of a barrel and a gas block in accordance with an embodiment described in the detailed description.
Figure 13A:
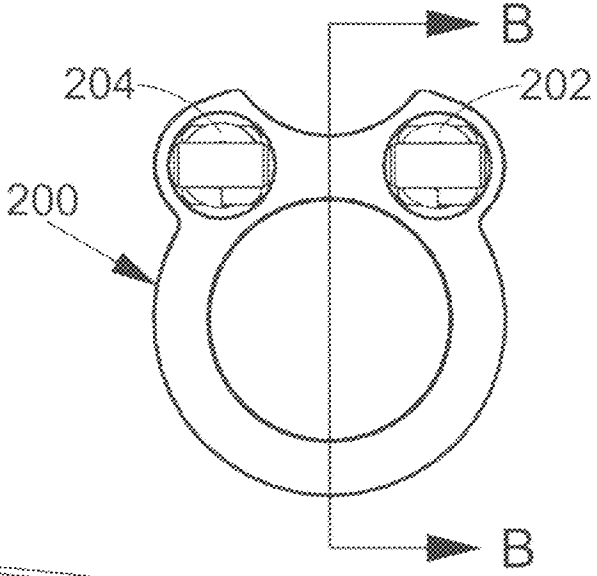
FIG. 13A is a front view showing a gas block assembly and a section line.
Figure 13B:
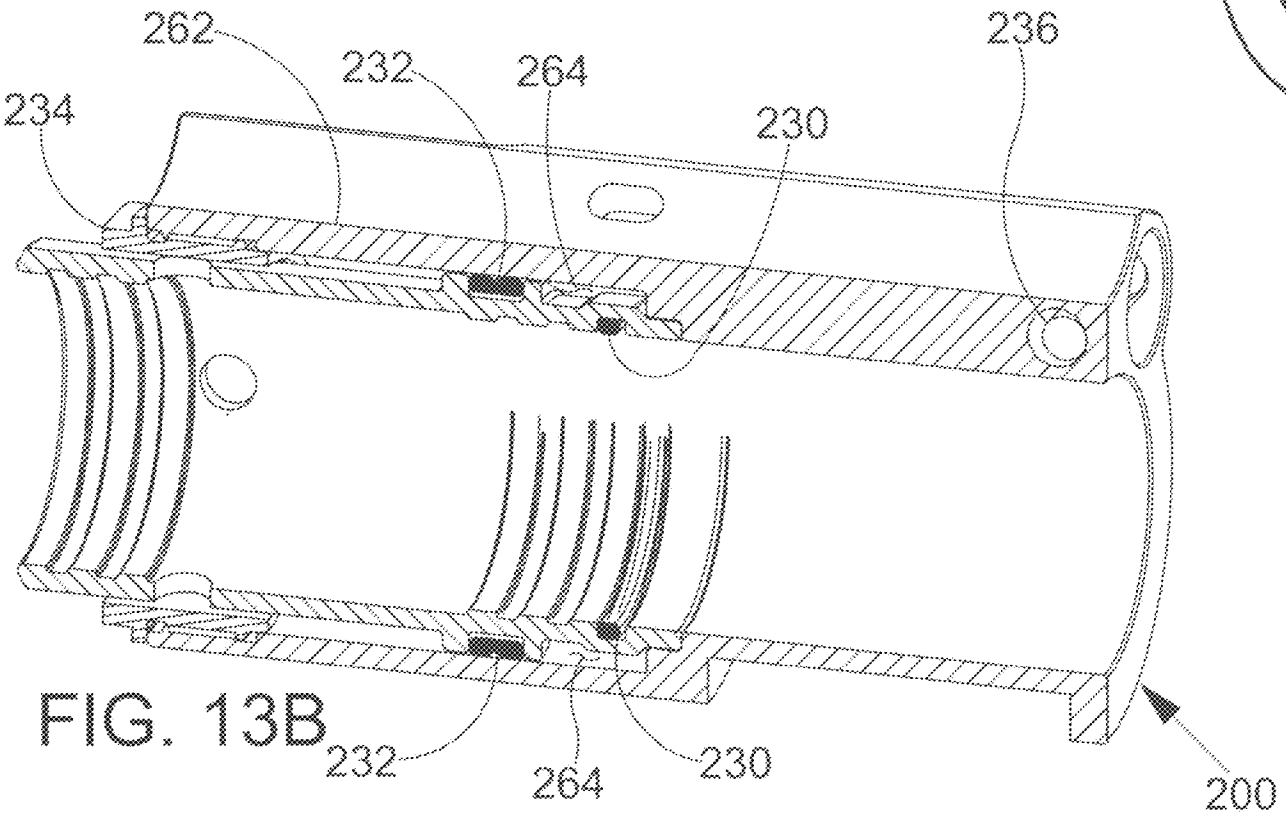
FIG. 13B is a cross-sectioned perspective view of the gas block assembly shown in FIG. 13A with the cross-sectioning being performed along the section line shown in FIG. 13A.
Figure 13C:
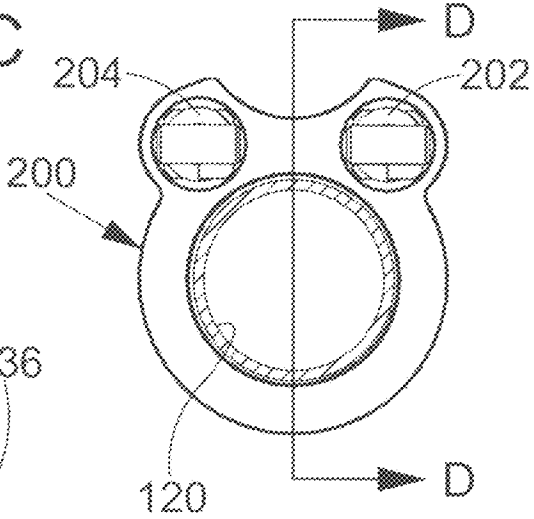
FIG. 13C is a front view showing a gas block assembly and a section line.
Figure 13D:
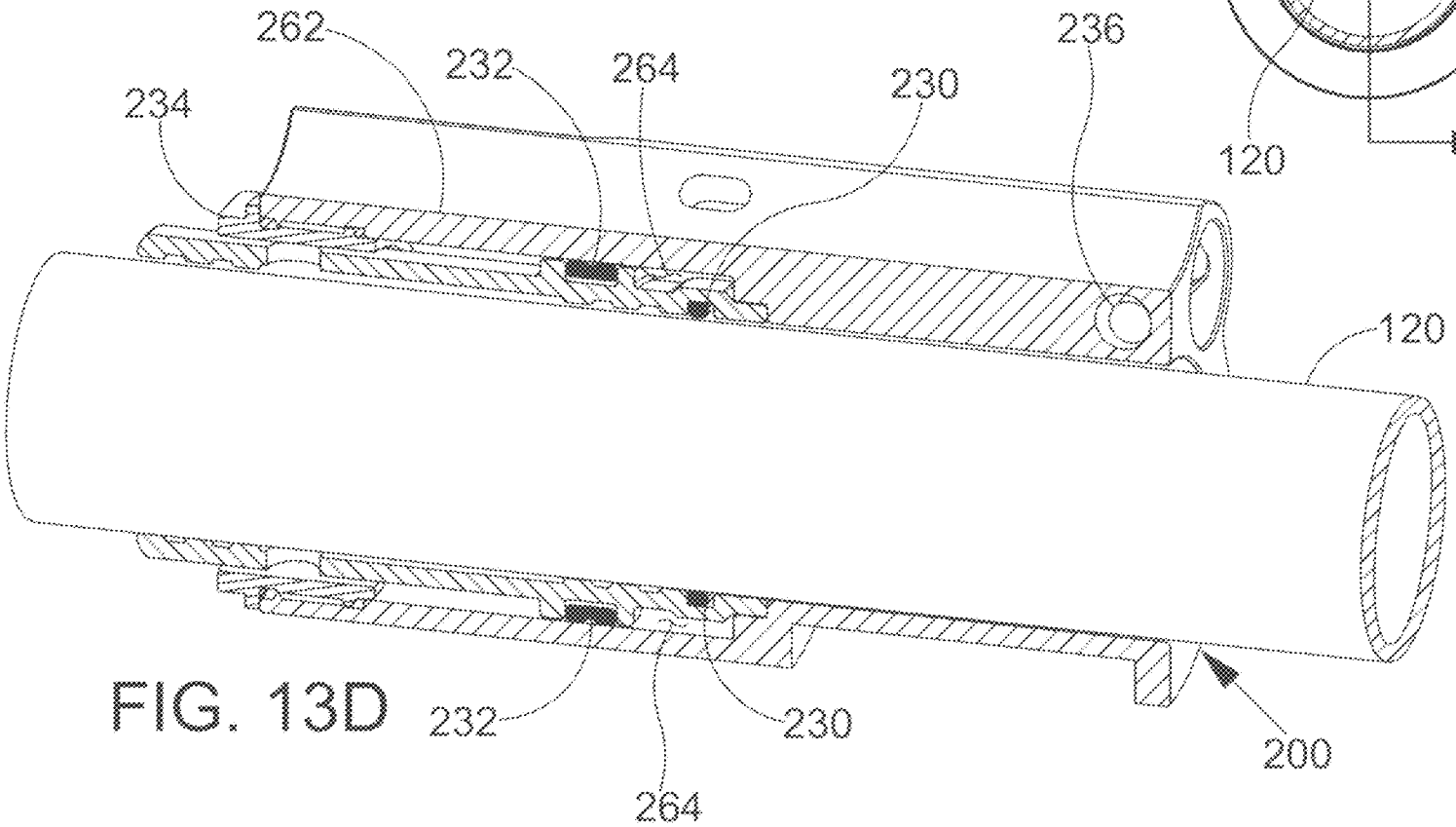
FIG. 13D is a cross-sectioned perspective view of the gas block assembly shown in FIG. 13C with the cross-sectioning being performed along the section line shown in FIG. 13C.
Figure 14:
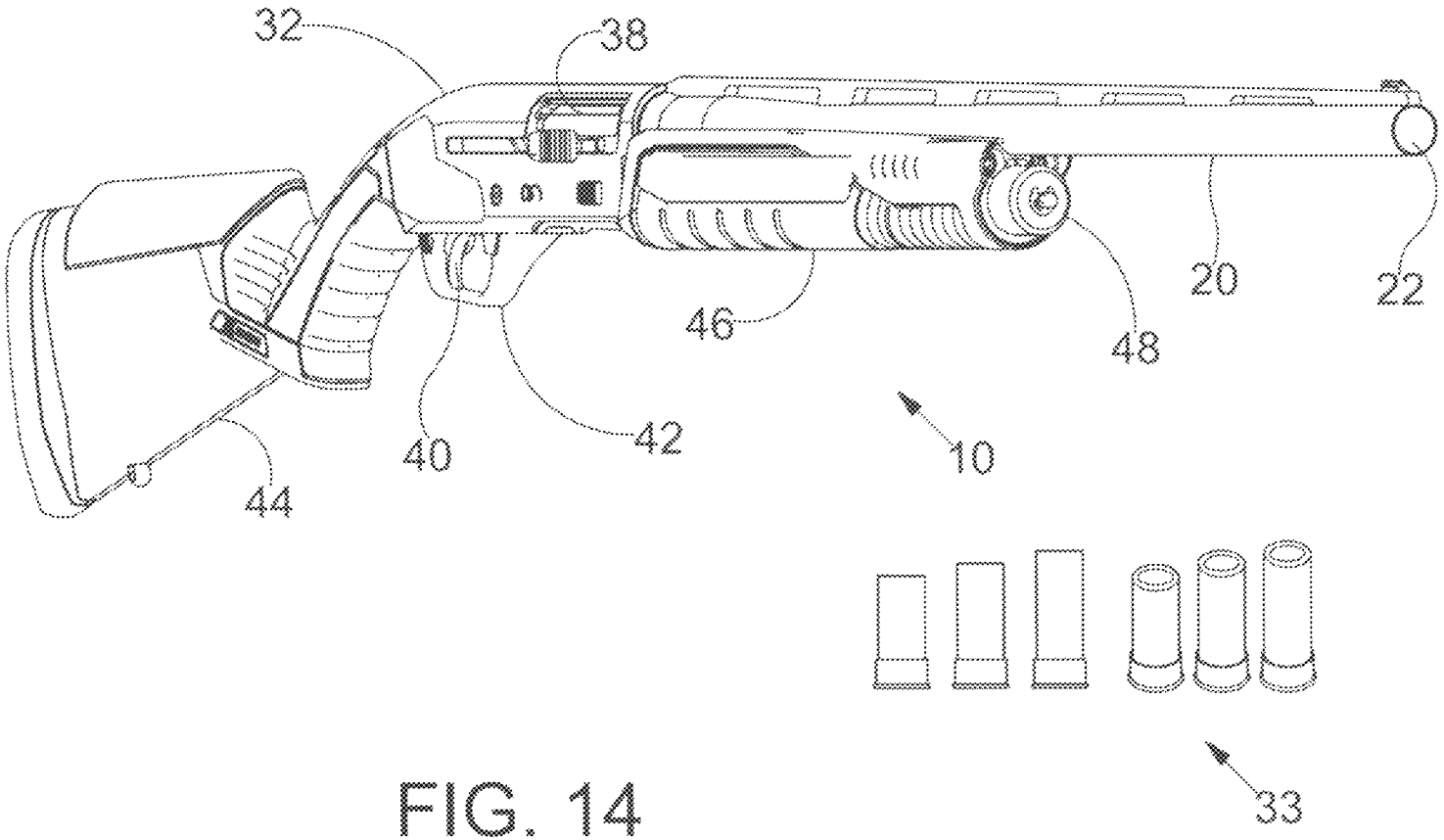
FIG. 14 is a perspective view showing a shotgun in accordance with an embodiment described in the detailed description.

FIG. 12A represents a cross sectional view of the barrel and gas block, the fluidic pathway to the pressure regulators may be by a plurality of holes segregated into clusters, a cluster for each gas regulator. In embodiments, each hole 352 is less than about 0.070 inches in diameter and may advantageously be drilled on center to the axis of the barrel.

The gas block 220 defines a channel 240 and an upward facing opening fluidly communicating with the channel 240. The barrel 20 extends into the channel 240. In one or more embodiments, the gas block 220 is fixed to the barrel 20. The gas block 220 has a rearward end and a forward end. The gas block 220 has a body 246 extending in a forward direction from the rearward end to the forward end and extending in a rearward direction from the forward end to the rearward end. The body 246 of the gas block 220 defines a starboard regulator cavity 322 and a port regulator cavity 422.

The starboard regulator cavity 322 comprises a forward starboard bore 335, a rearward starboard bore 338 and a starboard valve seat 346 disposed between the forward starboard bore 335 and the rearward starboard bore 338. The forward starboard bore 335 extends in the forward direction away from the starboard valve seat 346. The rearward starboard bore 338 extends in the rearward direction away from the starboard valve seat 346. The forward starboard bore 335 is defined by a forward starboard bore surface 340 of the gas block 220. The rearward starboard bore 338 is defined by a rearward starboard bore surface 342. The starboard valve seat 346 comprises a starboard valve seat surface 348 extending between the forward starboard bore surface 340 and the rearward starboard bore surface 342. The forward starboard bore 335 has a first diameter, the rearward starboard bore 338 has a second diameter. In one or more embodiments, the second diameter is greater than the first diameter. The forward starboard bore surface 340 meets the starboard valve seat surface 348 at a starboard edge 344. A starboard valve member 330 is disposed in the starboard regulator cavity 322. A seating surface of the starboard valve member 330 is biased to seat against the starboard edge 344 by a starboard spring 332. A starboard guide 334 extends through a lumen defined by the starboard spring 332 and into a starboard valve member pocket 352 defined by the starboard valve member 330.

The forward starboard bore 335 of the starboard regulator cavity 322 fluidly communicates with the barrel bore 22 via a starboard first passageway 354 defined by the gas block 220 and a starboard hole 50 defined by the barrel 20. The forward starboard bore 335 of the starboard regulator cavity 322 fluidly communicates with the annular volume 264 via a starboard aperture 350. Upon firing a shell with the shotgun, combustion gasses within the barrel 20 enter the annular volume via the starboard hole 50 and the port hole 52 to move the sleeve 252 and a slider 150 rearward for cycling a mechanism 36 disposed in the receiver interior 34.

The slider 150 comprising a slider wall 160. The slider wall 160 has an outer surface and an inner surface with the inner surface defining a lumen sized for the magazine tube 120. The slider 150 is positioned so that the slider wall 160 encircles the magazine tube 120 and the magazine tube 120 extends through the lumen. The slider 150 having a rearward end and a forward end. The slider wall 160 extends between the rearward end and the forward end. A slider assembly 161 includes the slider 150 and a starboard leg 162 having a forward end and a rearward end. A portion of the starboard leg 162 proximate the forward end is fixed to the slider 150. A portion of the starboard leg 162 proximate the rearward end engages the mechanism 36 disposed inside the receiver interior 34. The slider assembly 161 also includes a port leg 164 having a forward end and a rearward end. A portion of the port leg 164 proximate the forward end is fixed to the slider 150. A portion of the port leg 164 proximate the rearward end engages the mechanism 36 disposed inside the receiver interior 34. The semiautomatic shotgun 10 also includes a trigger 40, a trigger guard 42, a buttstock 44, a fore stock 46 and a cap 48.

The port regulator cavity 422 comprises a forward port bore 435, a rearward port bore 438 and a port valve seat 446 disposed between the forward port bore 435 and the rearward port bore 438. The forward port bore 435 extends in the forward direction away from the port valve seat 446. The rearward port bore 438 extends in the rearward direction away from the port valve seat 446. The forward port bore 435 is defined by a forward port bore surface 440 of the gas block 220. The rearward port bore 438 is defined by a rearward port bore surface 442. The port valve seat 446 comprises a port valve seat surface 448 extending between the forward port bore surface 440 and the rearward port bore surface 442. The forward port bore 435 has a first diameter, the rearward port bore 438 has a second diameter. In one or more embodiments, the second diameter is greater than the first diameter. The forward port bore surface 440 meets the port valve seat surface 448 at a port edge 444. A port valve member 430 is disposed in the port regulator cavity 422. A seating surface of the port valve member 430 is biased to seat against the port edge 444 by a port spring 432. A port guide 434 extends through a lumen defined by the port spring 432 and into a port valve member pocket 452 defined by the port valve member 430.

The forward port bore 435 of the port regulator cavity 422 fluidly communicates with the barrel bore 22 via a port passageway 454 defined by the gas block 220 and a port hole 52 defined by the barrel 20. The forward port bore 435 of the port regulator cavity 422 fluidly communicates with the annular volume 264 via a port aperture 450. Upon firing a shell with the shotgun, combustion gasses within the barrel 20 enter the annular volume via the port hole 52 and the port hole 52 to move the sleeve 252 and a slider 150 rearward for cycling a mechanism 36 disposed in the receiver interior 34.

In embodiments, the semiautomatic shotgun operates as follows. Cartridges of different power levels may be fired without adjusting of modifying the shotgun. Shotshells are loaded conventionally in the magazine. A shell is chambered by retracting the breech block. Upon firing the shell in the chamber explosive gases pass through the two ports in the barrel into the gas block assembly. A pair of passageway extends to the pair of valve chambers and then to the piston chamber. The passage ways to the piston chamber are selected to be a suitable size to restrict the passage of the gas that is to cause a pressure drop. If the pressure in the valve chambers is above a certain predetermined level, the relief valves open to lower the pressure lever. The valves open by the valve members lifting off of their respective valve seats. The pressure level transferred to the piston is then suitable for reliable and long-lasting operation of the recycling mechanism.

In embodiments the piston and piston chamber may be differently configured and still have the advantageous dual regulator arrangement. For example the piston could be cylindrical and engage a tubular cylinder forward of the ammunition chamber or above the ammunition chamber.

In one or more embodiments, the semiautomatic firearm 10 includes a spring 66 that is disposed inside a space defined by the magazine tube. In one or more embodiments, the semiautomatic firearm 10 includes a flange part 62.

FIG. 20A is a perspective view showing an assembly including a stock rod 64 and a spring loaded plunger assembly 50. The spring loaded plunger assembly 50 includes a plunger 52 and a plunger housing 54. In one or more embodiments, the plunger housing 54 has a male thread and a female thread. The male thread of the plunger housing 54 may threadingly engage a threaded hole in the receiver of a firearm. The female thread of the plunger housing 54 may threadingly engage one end of the stock rod 64. The stock rod 64 may extend into the buttstock of a firearm.

FIG. 20B is a side view showing an assembly comprising a spring loaded plunger assembly 50 including a plunger 52 and a plunger housing 54. A male thread of the plunger housing is visible in FIG. 20B. The male thread of the plunger housing 54 may threadingly engage a threaded hole in the receiver of a firearm. The assembly of FIG. 20B also includes a stock rod 64 may extend into the buttstock of a firearm. The female thread of the plunger housing 54 may threadingly engage one end of the stock rod 64.

FIG. 20C is a cross-sectional view further illustrating the stock rod 64 and the spring loaded plunger assembly 50 shown in FIG. 20A and FIG. 20B. The spring loaded plunger assembly 50 includes a plunger 52, a plunger housing 54, and an elastic element 56. In the embodiment of FIG. 20C, the elastic element 56 comprises a plurality of Belleville washers 60 arranged to form a stack 58.

FIG. 20D is an enlarged cross-sectional view further illustrating the spring loaded plunger assembly 50 shown in FIG. 20C. With reference to FIG. 20D, it will be appreciated that the Belleville washers 60 in the stack 58 are disposed in a series arrangement. In the example embodiment of FIG. 20D, the orientation of adjacent Belleville washers 60 alternates. A portion of plunger 52 can be seen extending into a lumen defined by the stock rod 64 in FIG. 20D.

FIG. 20E is an exploded view further illustrating the stock rod 64 and the spring loaded plunger assembly 50 shown in FIG. 20A through FIG. 20D. The spring loaded plunger assembly 50 includes a plunger 52 and an elastic element 56 that may be received in a plunger housing 54. In the embodiment of FIG. 20E, the elastic element 56 comprises a plurality of Belleville washers 60 arranged to form a stack 58. A portion of plunger 52 may be inserted into a lumen defined by the stock rod 64 in the embodiment of FIG. 20E. One end of the stock rod 64 may threadingly engage a female thread of the plunger housing 54.

FIG. 20F is a cross-sectional view further illustrating the stock rod 64 and the spring loaded plunger assembly 50 in accordance with an additional embodiment. The spring loaded plunger assembly 50 includes a plunger 52, a plunger housing 54, and an elastic element 56. In the embodiment of FIG. 20F, the elastic element 56 comprises a first coil spring 82 and a second coil spring 84.

FIG. 20G is an enlarged cross-sectional view further illustrating the spring loaded plunger assembly 50 shown in FIG. 20F. With reference to FIG. 20G, it will be appreciated that the second coil spring 84 is disposed inside a spring lumen 60 defined by the first coil spring 82. One end of the stock rod 64 may threadingly engage a female thread of the plunger housing 54.

Referring to FIGS. 20H and 20J, a stock rod and buffer assembly where, rather than utilizing a metallic spring as illustrated in the embodiments of FIGS. 20C-20G, a polymer tube is utilized that absorbs and dampens the shock from the impact of the breech block or the bolt assembly.

FIGS. 22-25E illustrate an embodiment with valve members 330, 430 that have a forward head end 431 that faces rearward, has a sealing surface (ring shaped) 433 and that engages a valve seat 434 defined in the valve housing 338. A tubular portion 435 extends from the head in a forward direction with respect to the shotgun. Holes 437 forward of the sealing surface provide a gas pathway to the interior of the tubing portion which then opens forwardly at the front of the regulator assembly 439. Circumferential rib segments 443 provide a cleaning action in the tubular housings. Axial grooves 447 provide an alternate gas pathway when the valve opens. Apertures 449 in the tubular housing 451 allow a lateral pathway of the pressurized excess gas out of the regulator assembly.

FIGS. 26-32 illustrate a semiautomatic shotgun 600 in accord with embodiments. The shotgun having a rear stock 602, a receiver 606, a fore stock 608, barrel 610, and magazine tube 611. Referring to FIGS. 28-32, in embodiments, the shotgun 600 may be readily separated into a receiver portion 612 and a barrel portion 614 by removal of the threaded magazine cap 619 from the threaded end 622 of the magazine tube 611. An action bar assembly 620 includes a one piece assembly 620 comprising a slider 628, action bars or legs 621, and bolt carrier 646. The action bar assembly 620 is exposed on the magazine tube 611 after the receiver portion is separated from the barrel portion, as well as a return spring 624. See, in particular, FIG. 29. The bolt carrier holds the bolt 651 and charging handle 653. The bore of the slider 628 is sized for close sliding engagement with the magazine tube.

Figure 28:
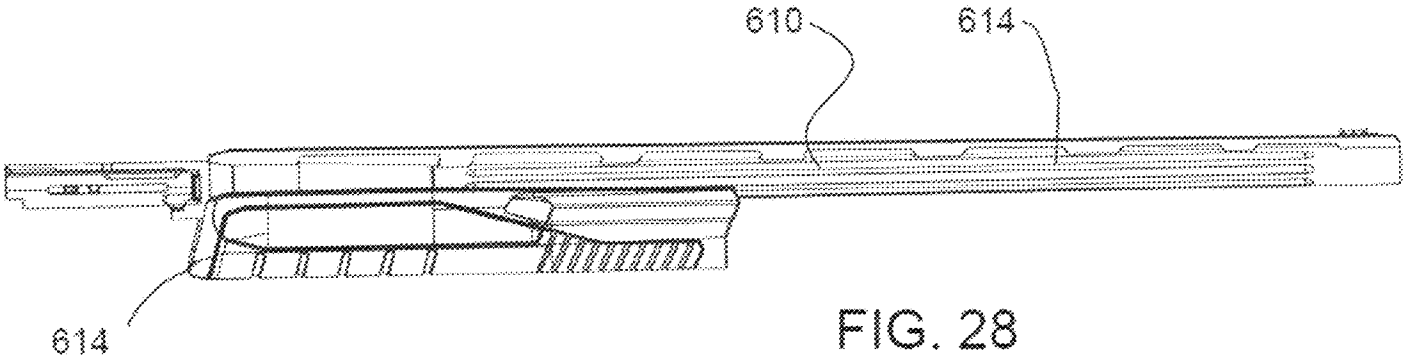
FIG. 28 is the barrel and fore stock of the shotgun of FIGS. 25 and 25 after manual, removal of the magazine tube cap, without tools, such that the barrel and fore stock may be removed forwardly and separated from the receiver.
Figure 29:
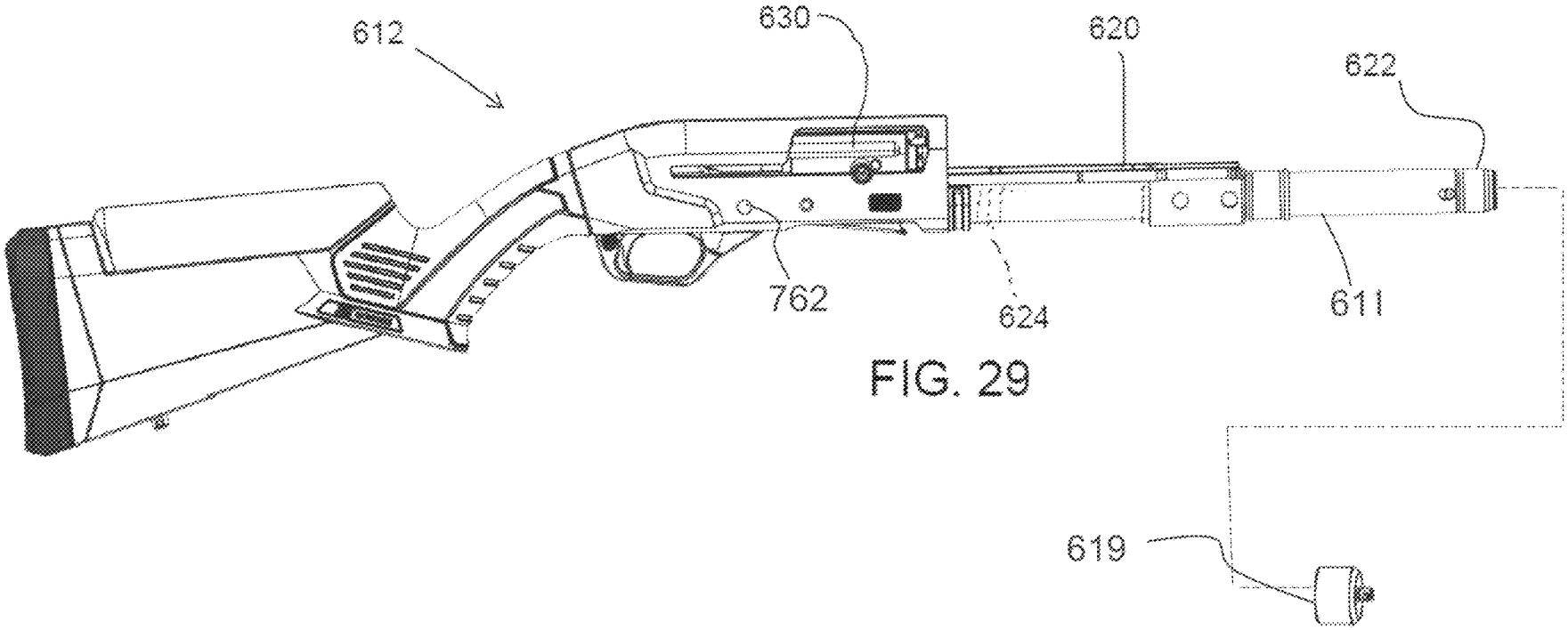
FIG. 29 is the receiver, stock, magazine tube and a one piece action bar assembly.
Figure 30:
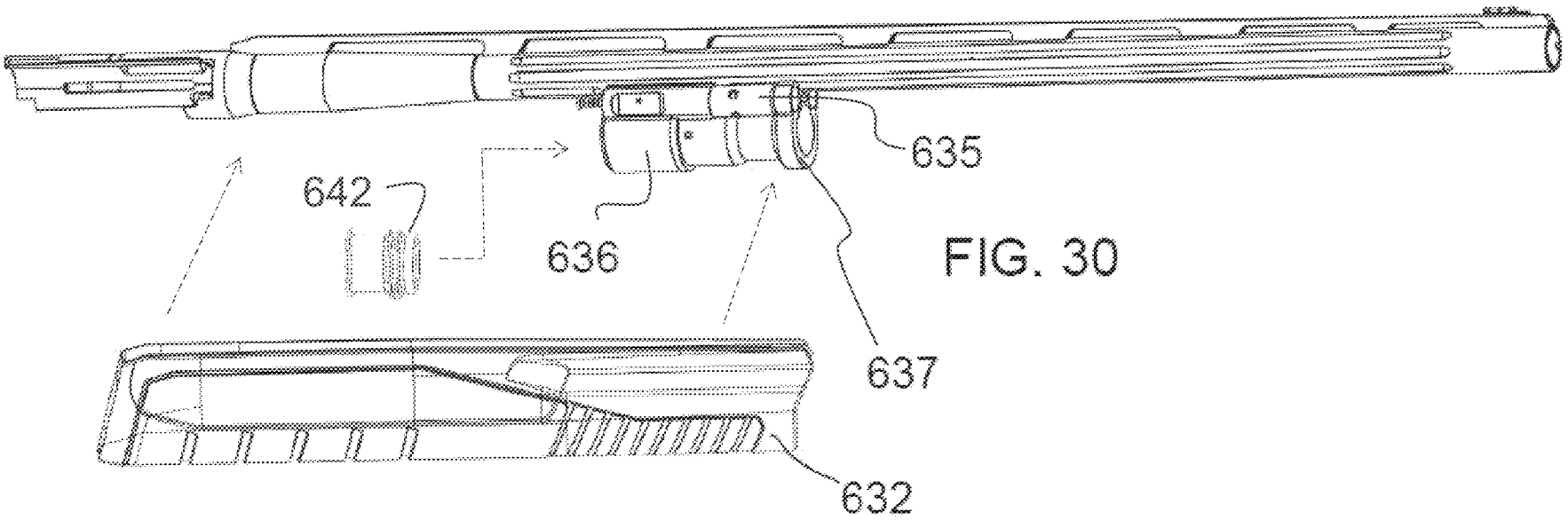
FIG. 30 is the barrel and fore stock of FIG. 28 after the fore stock is removed revealing the forward dual regulator assembly attached to the barrel.
Figure 31:
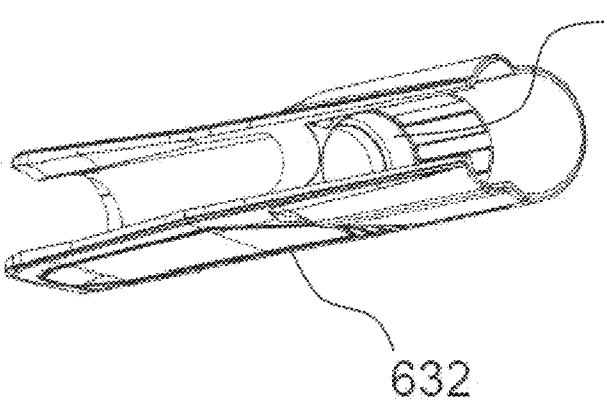
FIG. 31 is another view of the fore stock piece showing the piston stop.
Figure 32:
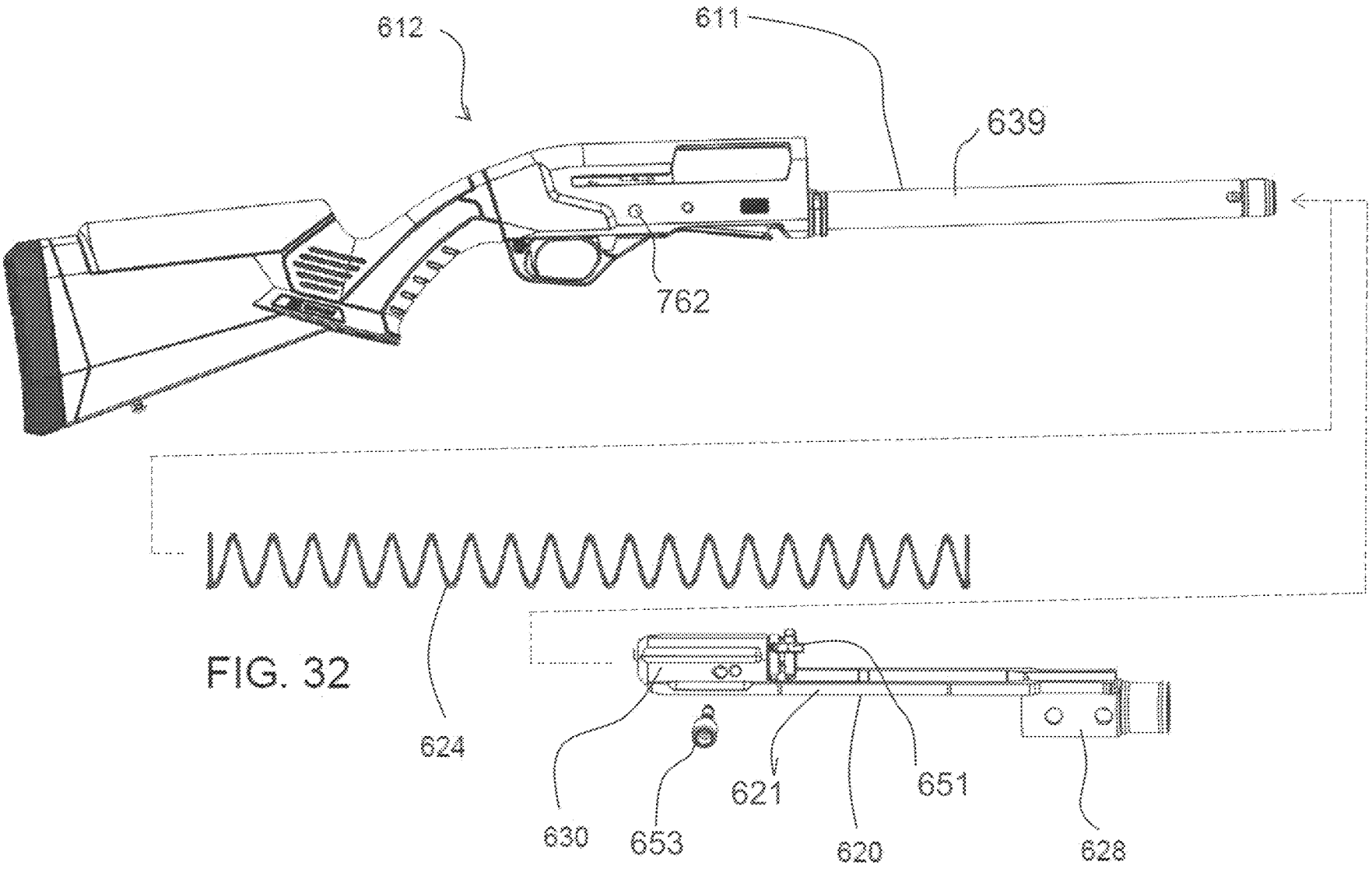
FIG. 32 is illustrates the removal of the one piece action bar assembly from the magazine tube.

The fore stock 632 of FIG. 28 may be pulled rearwardly from the barrel to be removed revealing the gas block assembly 635 as illustrated in FIG. 30. The gas block assembly 635 includes a gas block 636 welded to the barrel that defines an internal cylindrical surface 638 that along with the exterior surface 639 of the magazine tube defines the piston chamber 639. The annular piston 642 seals with the gas block and magazine tube and moves rearwardly when the piston cylinder is charged with the propellant gas after a cartridge is fired. The fore stock provides a stop surface 644 for the annular piston as shown best in FIG. 31. As the piston moves rearwardly is engages the slider 628 as previously discussed. A spacer sleeve 637 is positioned forward of the gas block and is secured thereto.

Figure 15A:
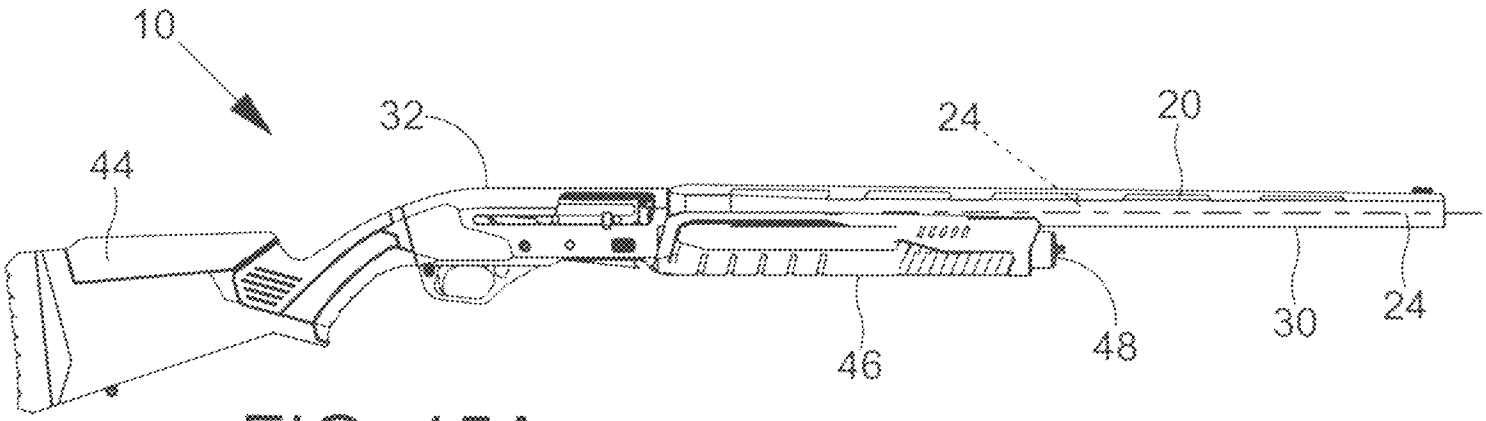
FIG. 15A is a side elevation view showing a shotgun in accordance with an embodiment described in the detailed description.
Figure 15B:
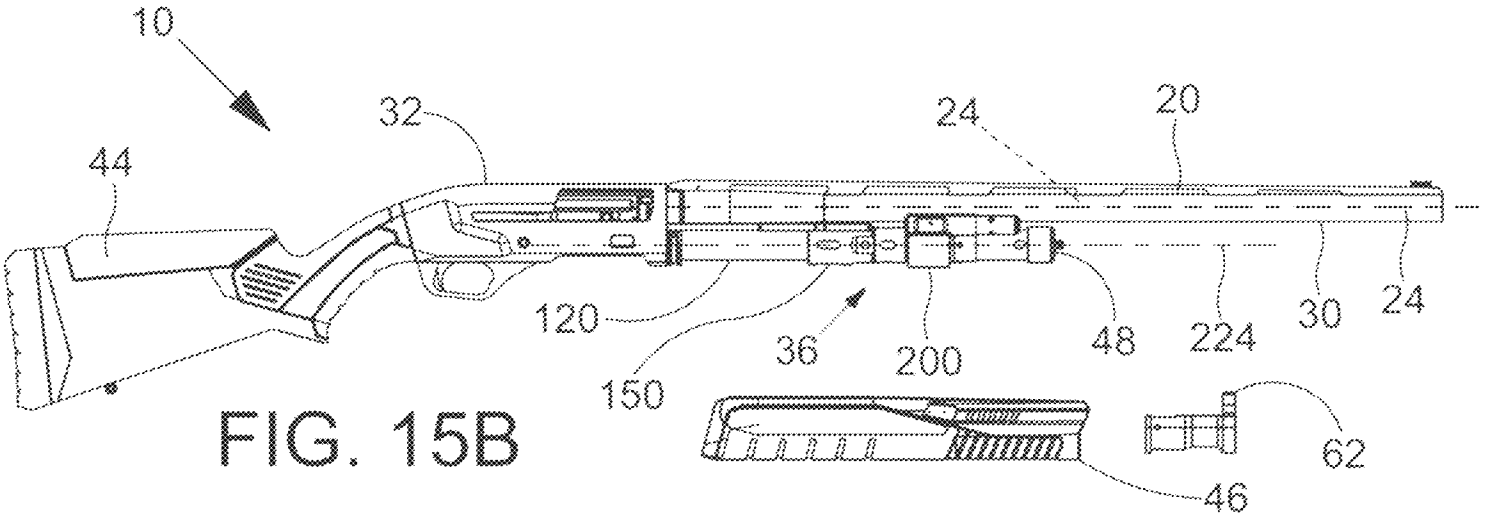
FIG. 15B is a partially exploded side view of the shotgun shown in FIG. 1A.
Figure 16A:
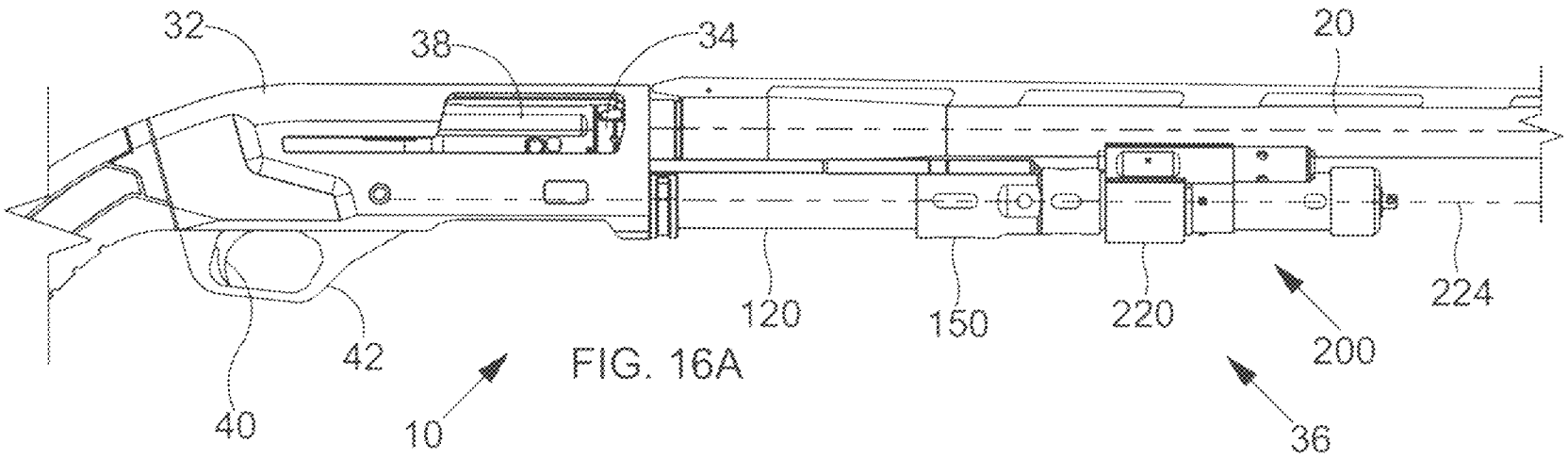
FIG. 16A is an enlarged side view of the shotgun shown in FIG. 15B.
Figure 16B:
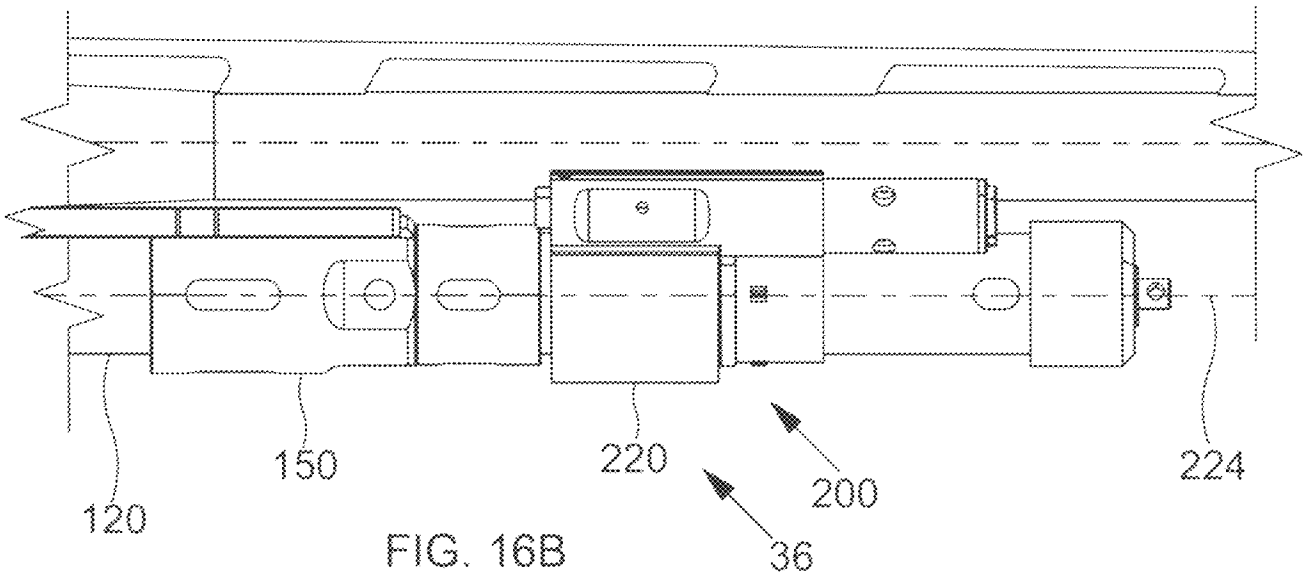
FIG. 16B is an enlarged side view further illustrating a portion of the shotgun shown in FIG. 16A.
Figure 17:
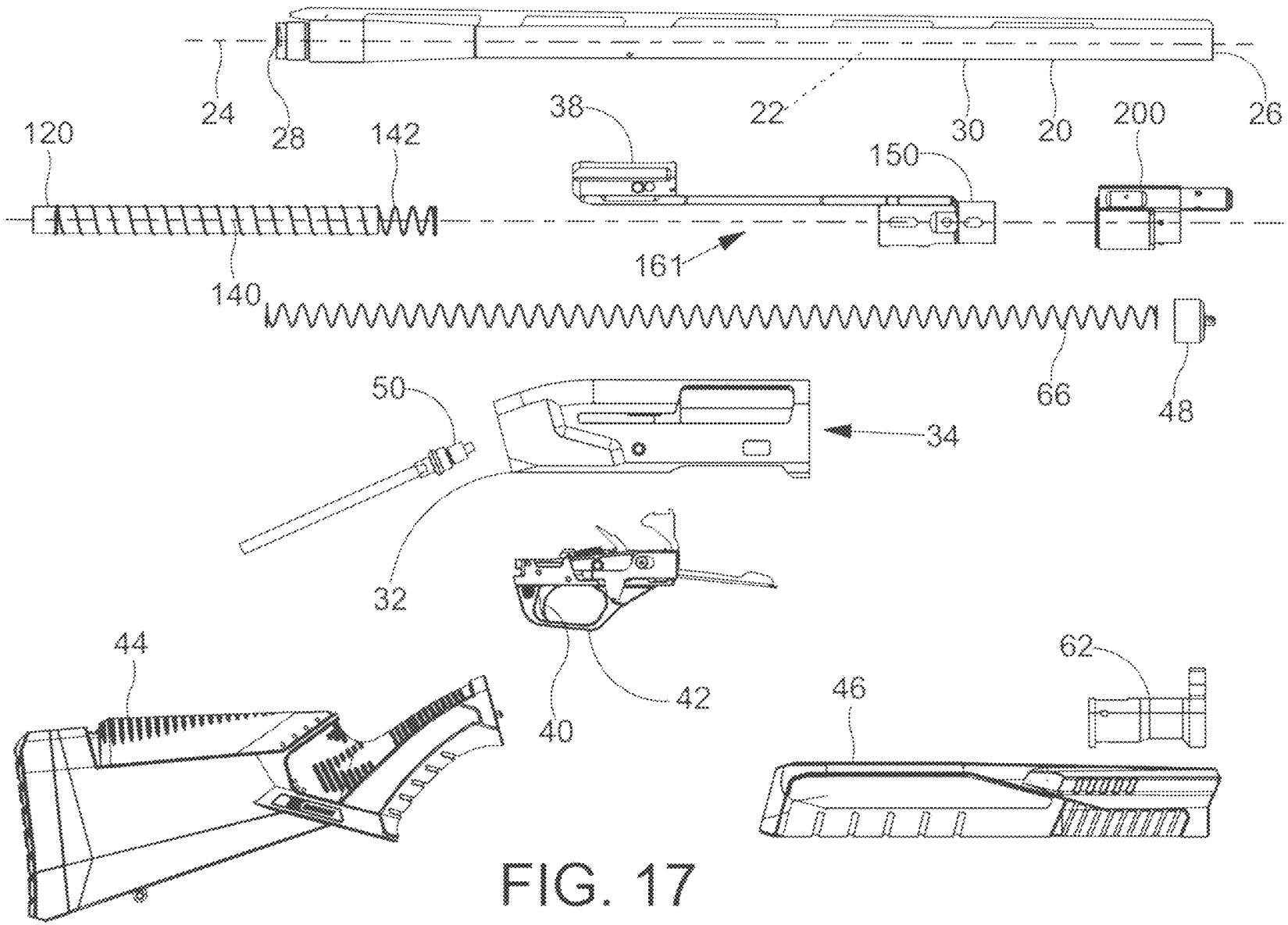
FIG. 17 is an exploded side view of the shotgun shown in FIG. 15A and FIG. 15B.
Figures 18A, 18B:
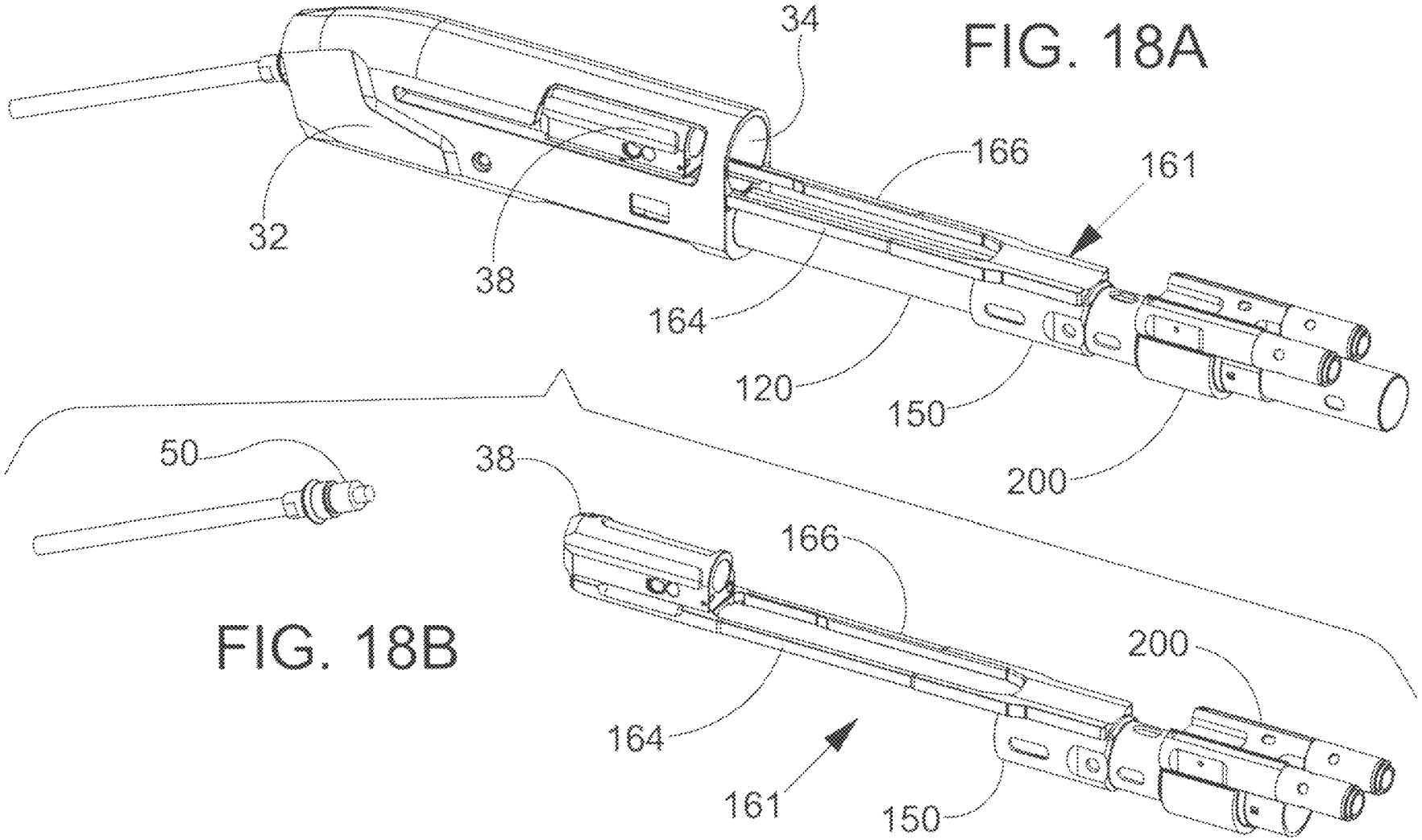
FIG. 18A is a perspective view of an assembly including a receiver and a breech block.
FIG. 18B is a perspective view of the assembly of FIG. 18A with the breech block removed.
Figure 19A:
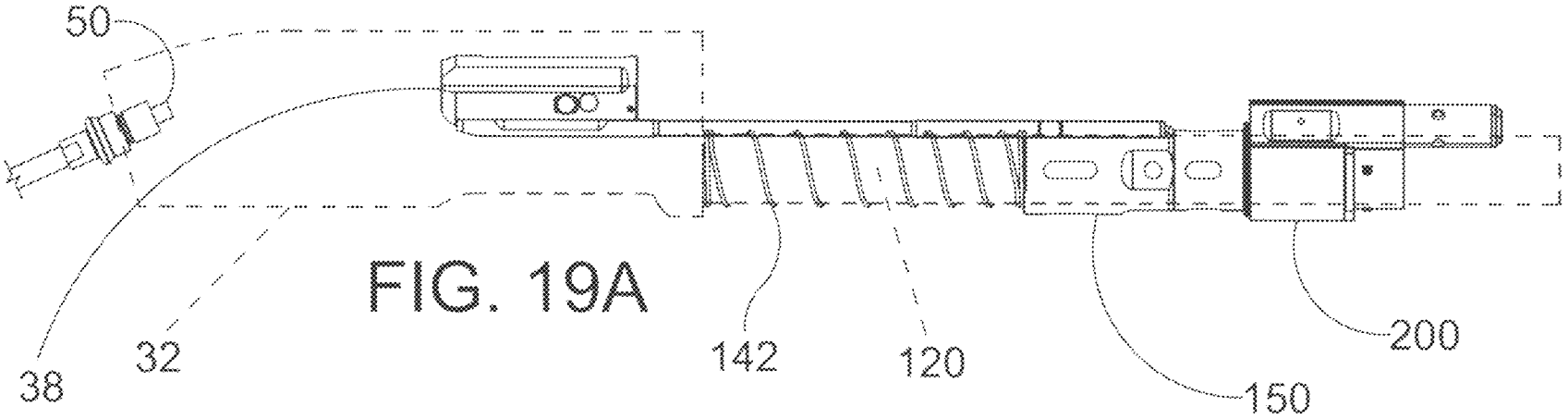
FIG. 19A is a side view of an assembly including a receiver and a breech block. The breech block is disposed in a forward position in the embodiment of FIG. 19A.
Figure 19B:
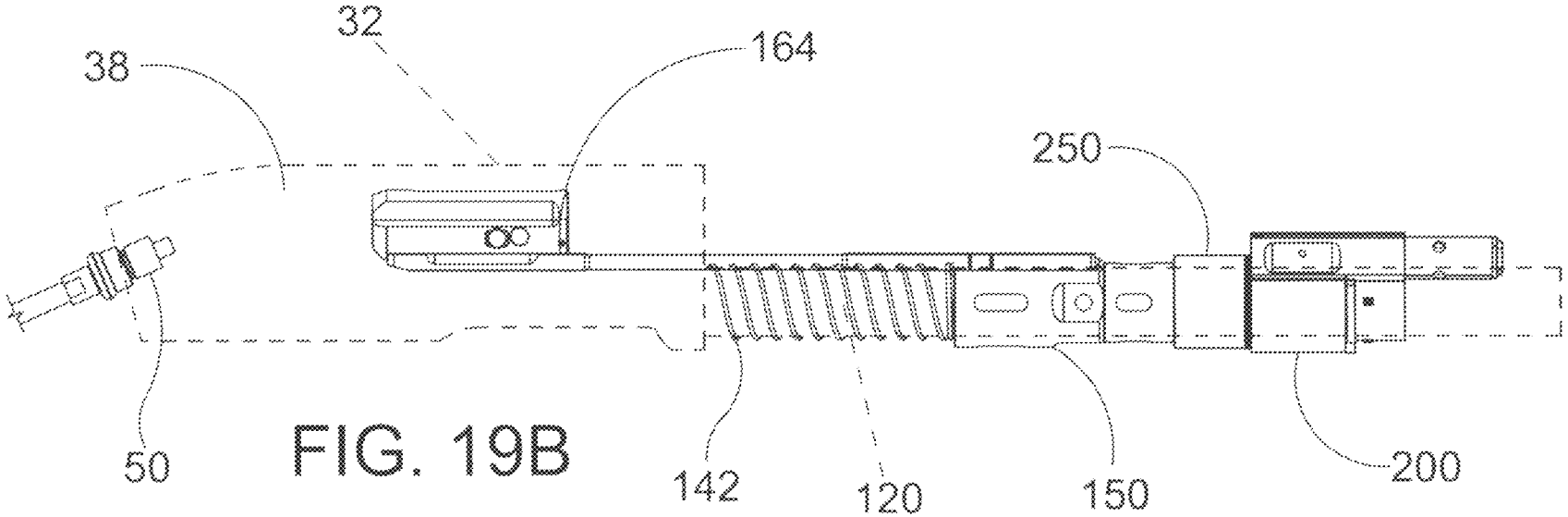
FIG. 19B is a side view of an assembly including a receiver and a breech block. The breech block is shown in an intermediate position in FIG. 19C. The intermediate position is between the forward position and the rearward position.
Figure 19C:
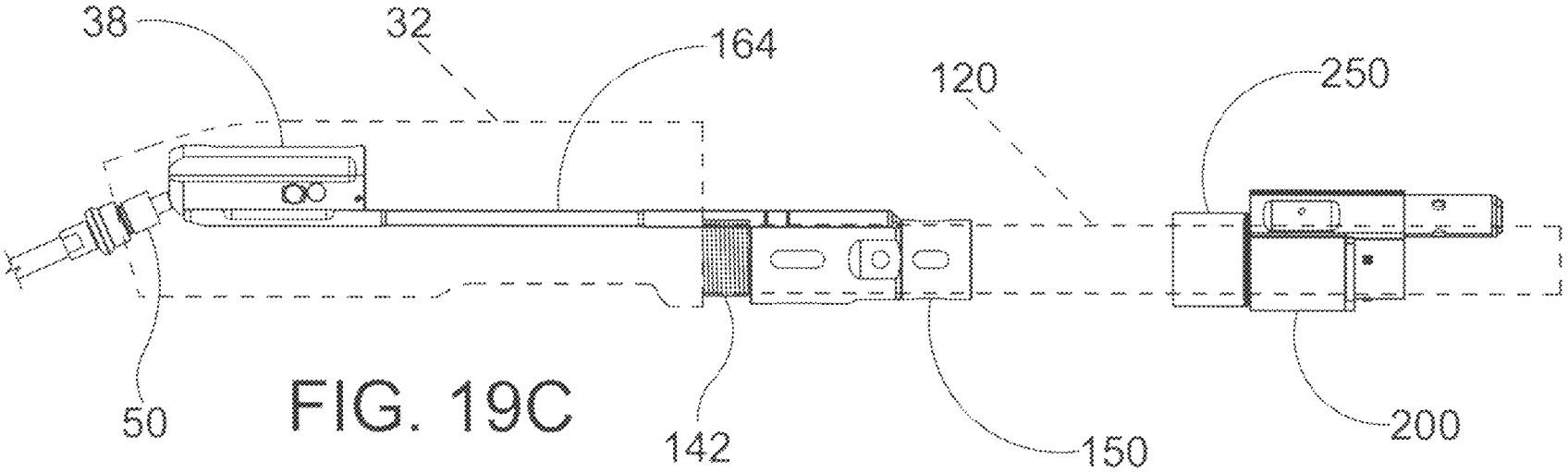
FIG. 19C is a side view of an assembly including a receiver and a breech block. The breech block is disposed in a rearward position in the embodiment of FIG. 19C.
Figure 19D:
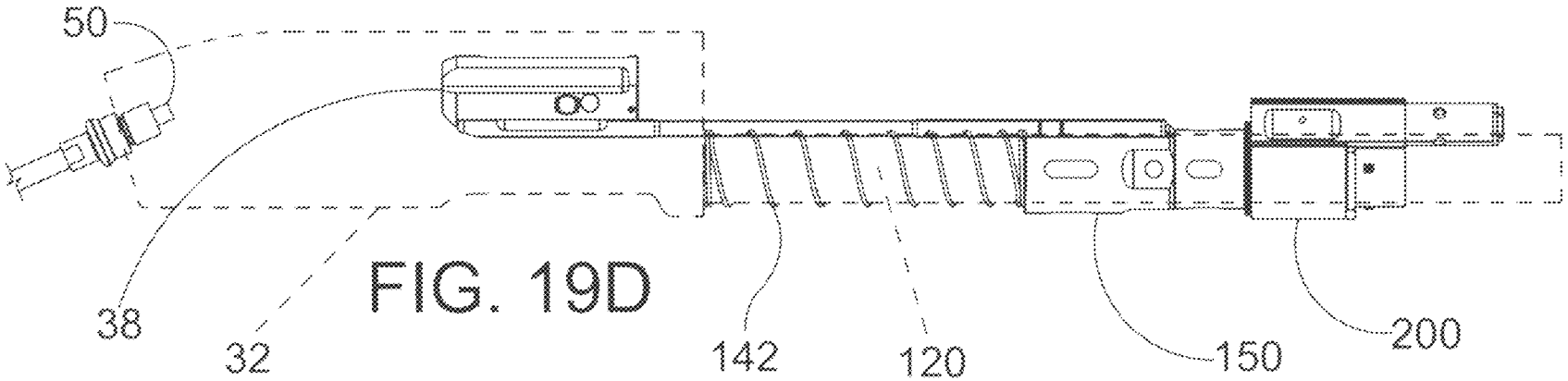
FIG. 19D is a side view of an assembly including a receiver and a breech block. The breech block is disposed in a forward position in the embodiment of FIG. 19D.

The annular piston 642 returns to the full-in position in the gas block when the action arm assembly returns to the forward normal in-battery position, such as show in, for example, FIG. 15B. The piston 642 has an internal and an external piston ring for sealing on the magazine tube and against the inside surface of the gas block.

Figures 33A, 33B:
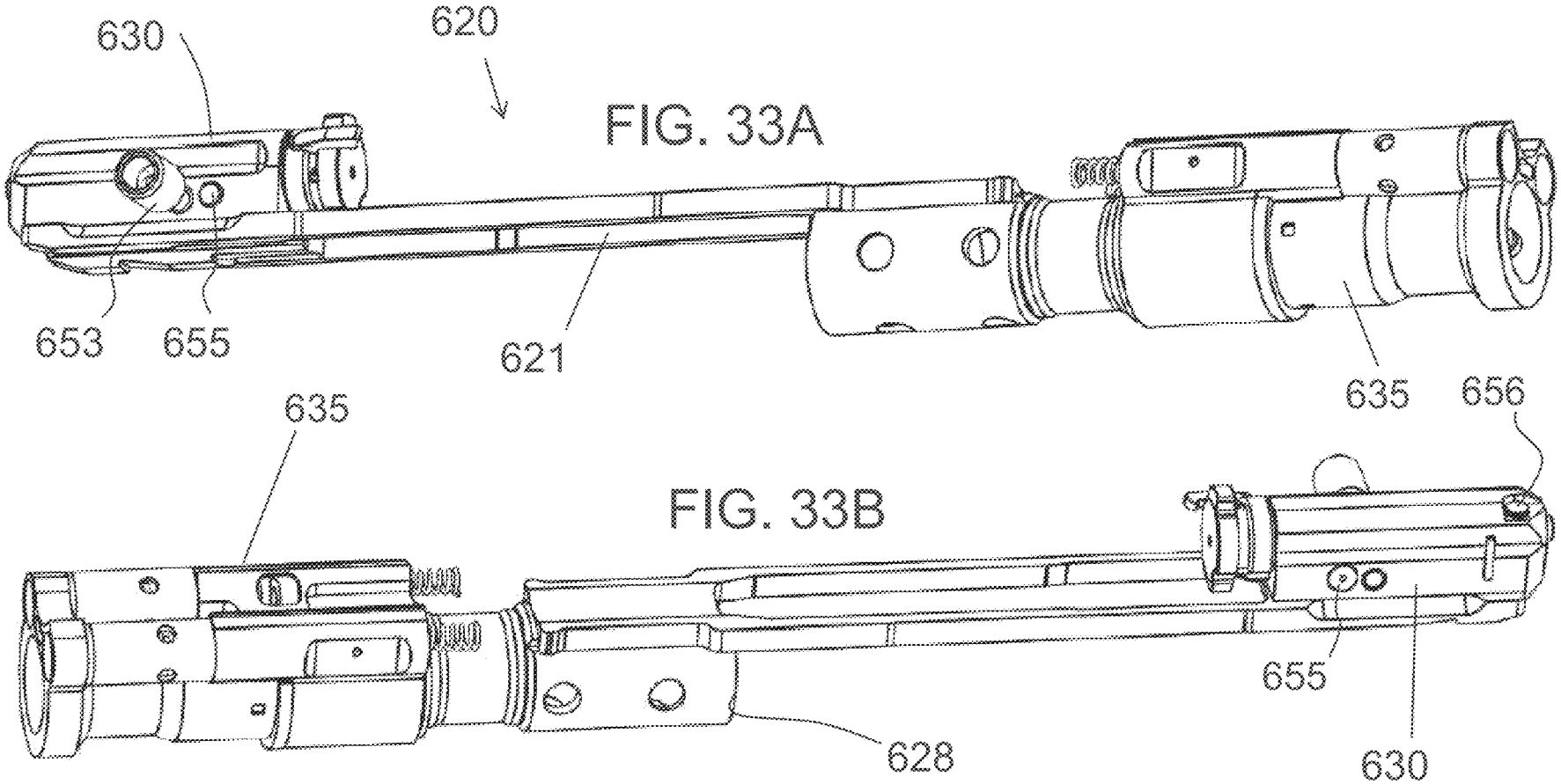
FIG. 33A-33B are side views of the one piece action bar assembly engaged with the dual regulator assembly.
Figure 34A:
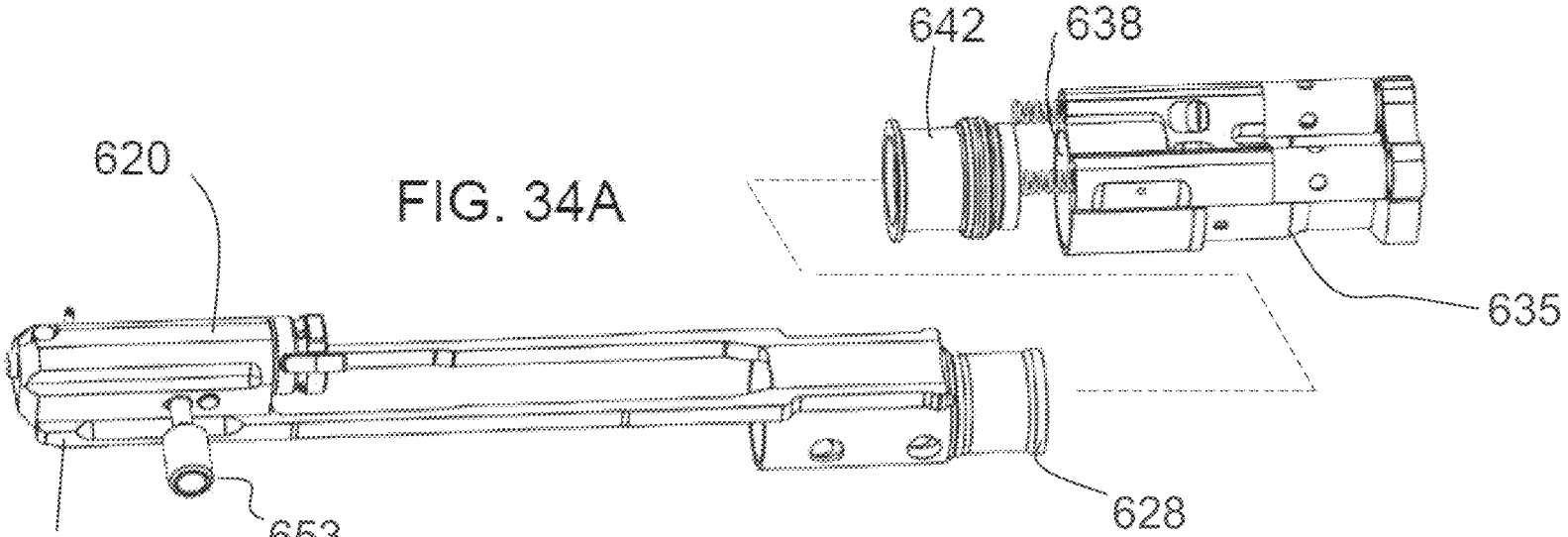
FIG. 34A is a view of the dual regulator assembly separated from the action bar assembly with the annular piston pulled out of the regulator block.
Figure 34B:
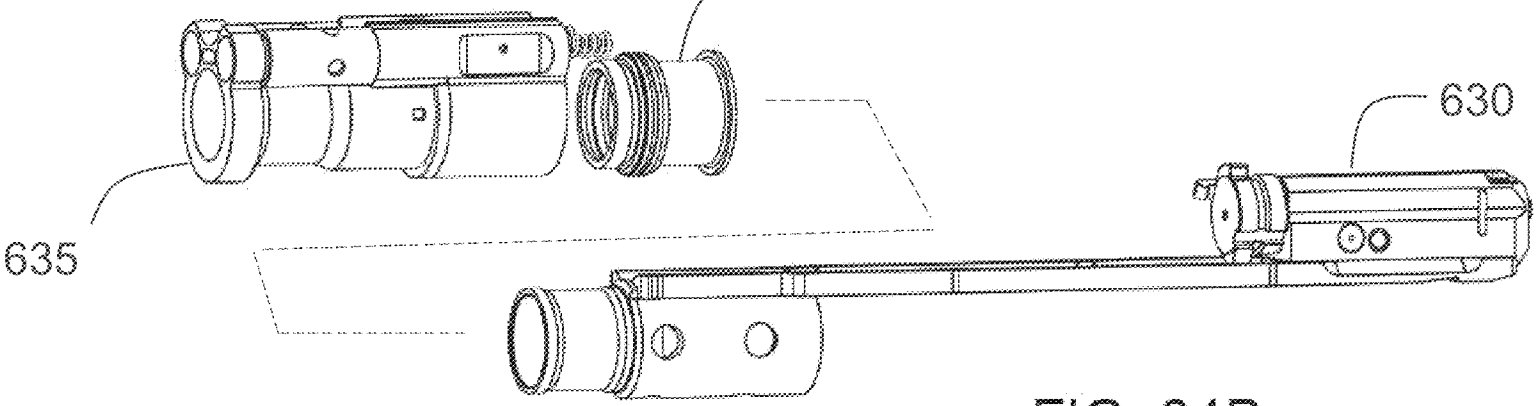
FIG. 34B is the dual regulator assembly and action bar assembly of FIG. 34A viewed from the opposite side.

Details of the action bar assembly 620 engaged with the gas operating assembly are illustrated in FIGS. 33A-33C. The action bar is in embodiments one-piece and comprises the bolt carrier 646 and the slider 628 unitary with arms 649, such as by welding.

FIGS. 35-38 illustrate the bolt assembly 630 that includes the bolt 651, firing pin 652, charging handle 653, bolt cam pin 655, firing pin retention pin 656, firing pin spring 657, extractor 658. Complex surfaces on the bolt provide rotation as it extends out of and retracts into the bolt carrier 646. The breech block as described above may be the bolt assembly depicted in FIGS. 35-38.

Figure 39:
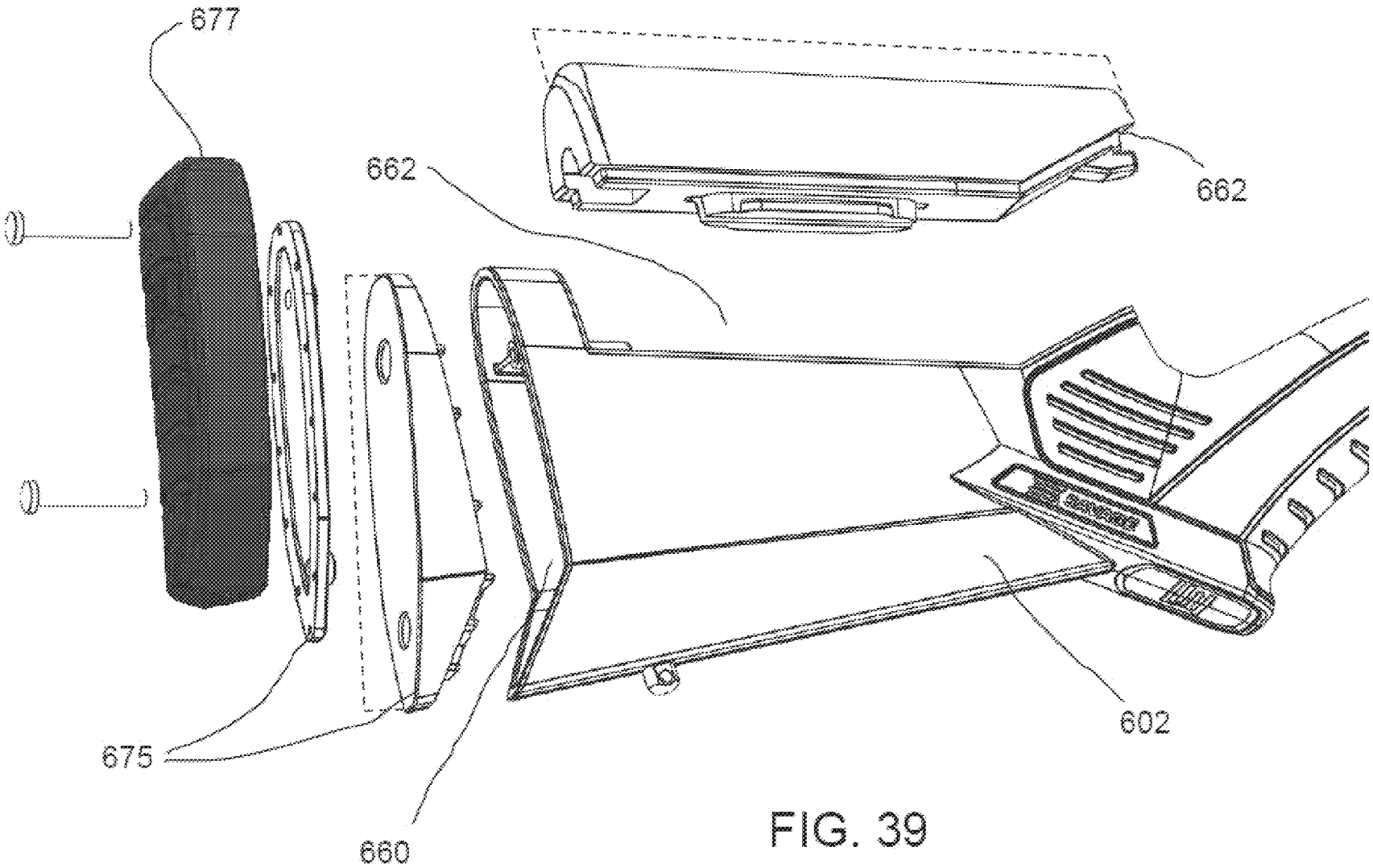
FIG. 39 is an exploded view of the rear stock with cheek pad and butt pad.
Figure 40:
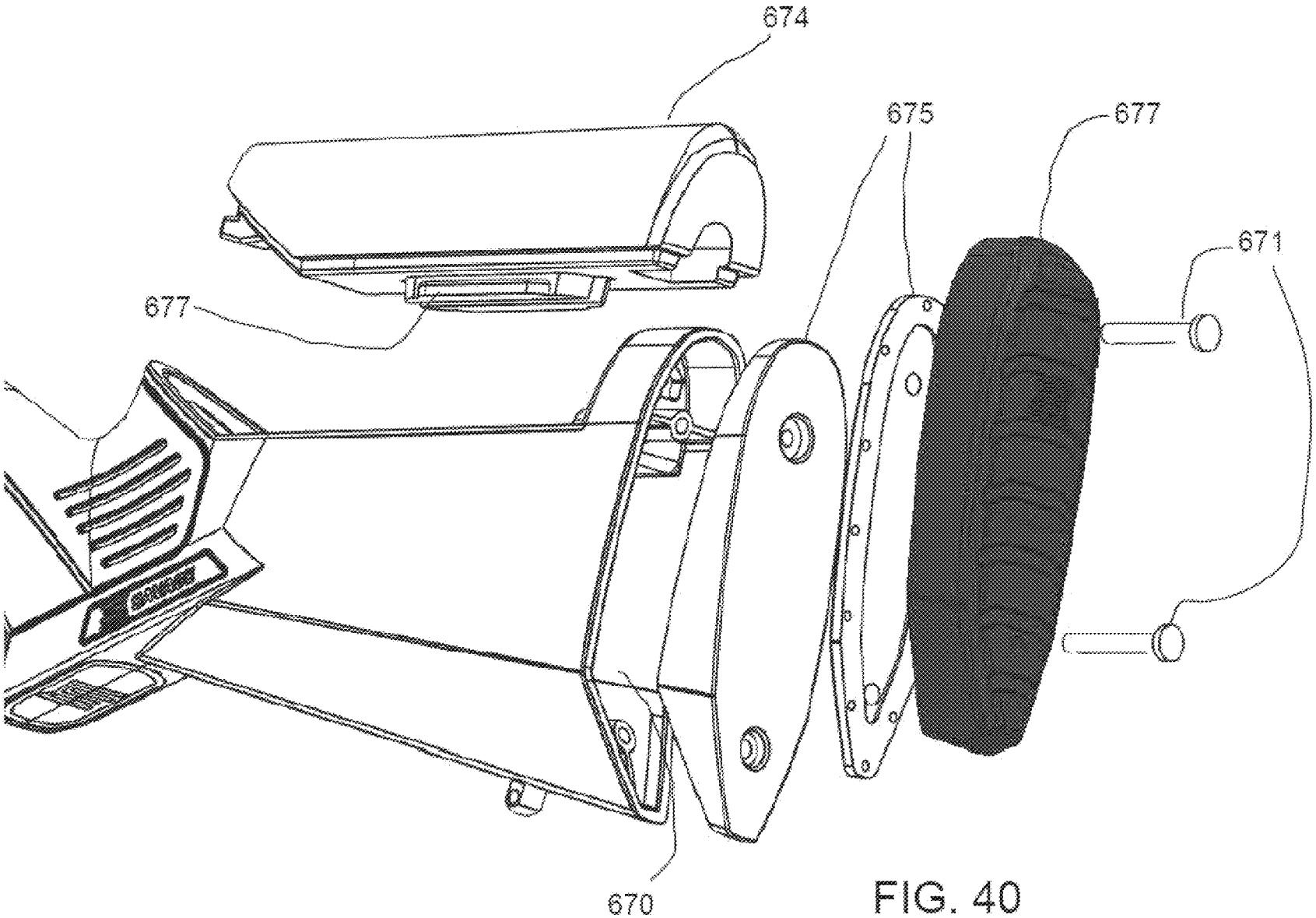
FIG. 40 is another exploded view of the rear stock with cheek pad and butt pad.
Figure 41:
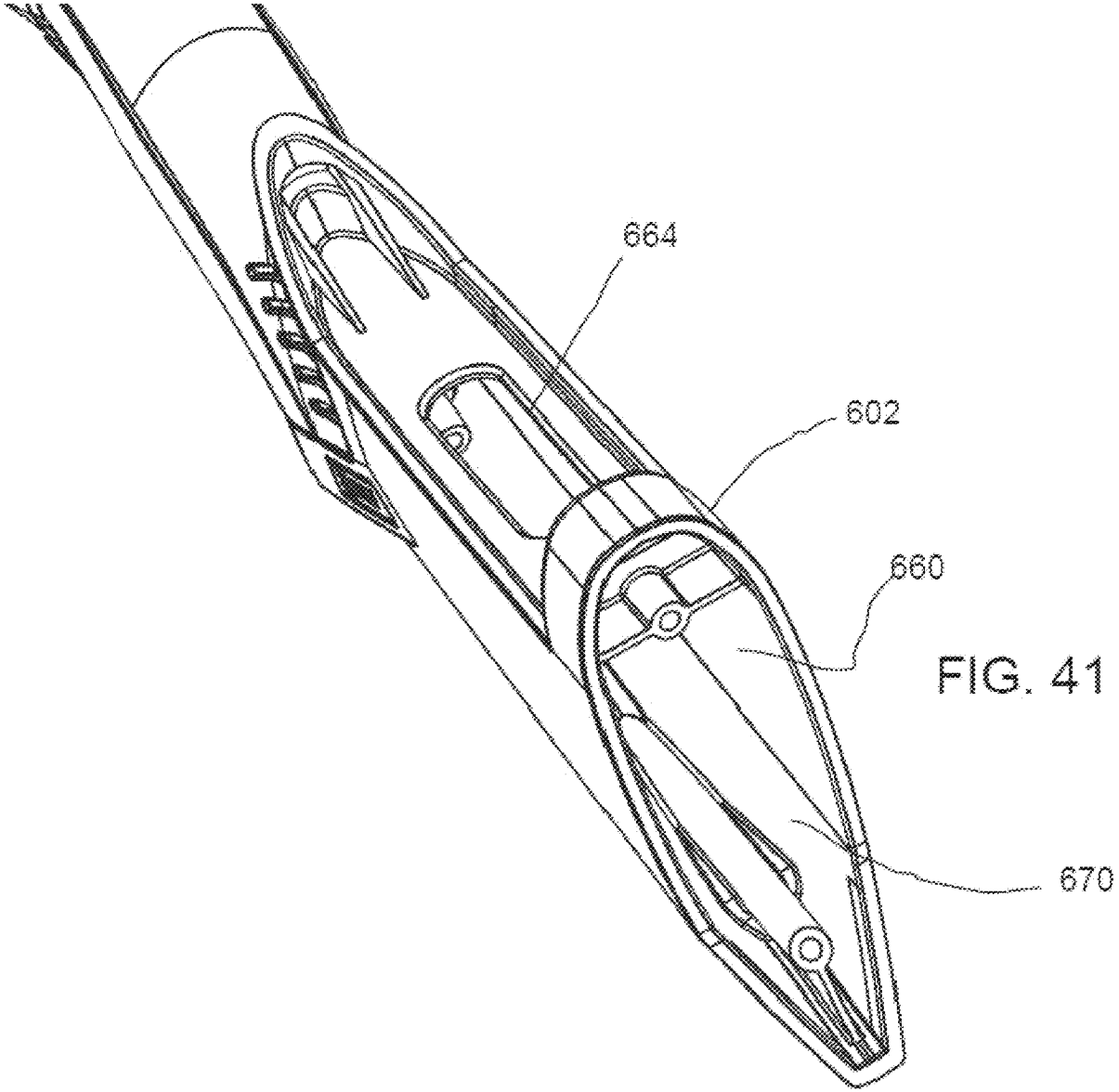
FIG. 41 is a view of the stock with the open end exposed.

Referring to FIGS. 39-40, a rear stock 602 is hollow with an open interior 660, an upper recess 662, with a slot 664 and an open rear end 670. A cheek pad 674 having a pair of downward wings 677 that are sized to fit into and be retained in the slot 664 are formed of resilient material. A rear butt pad 670 attaches with screws 671 to the bosses 673 in the rear open end. Spacers 675 provide custom positioning, of the rear butt pad 677, that is, the desired length of the shotgun. Different sizes and shaped of cheek pads and spacers as indicated by the dashed lines may be provided with the shotgun when sold in a retail sale assemblage. See U.S. Pat. No. 10,690,440, owned by the owner of this application, incorporated herein by reference for all purposes.

Figure 42:
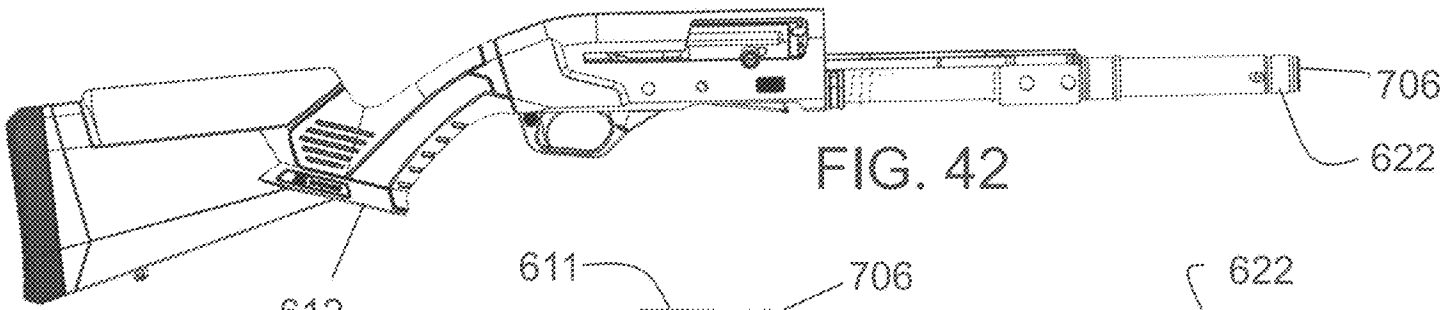
FIG. 42 is a side view of a receiver portion of a shotgun.
Figure 44:
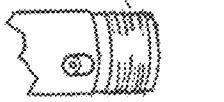
FIG. 44 is a side view of the distal end of the tubular magazine of FIG. 43 with the interior cap pushed inward.
Figure 43:
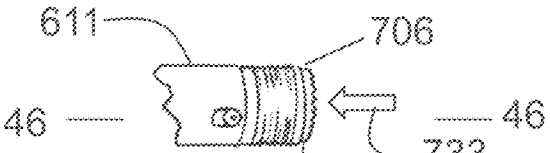
FIG. 43 is a side view of a distal end of the tubular magazine.
Figure 45:
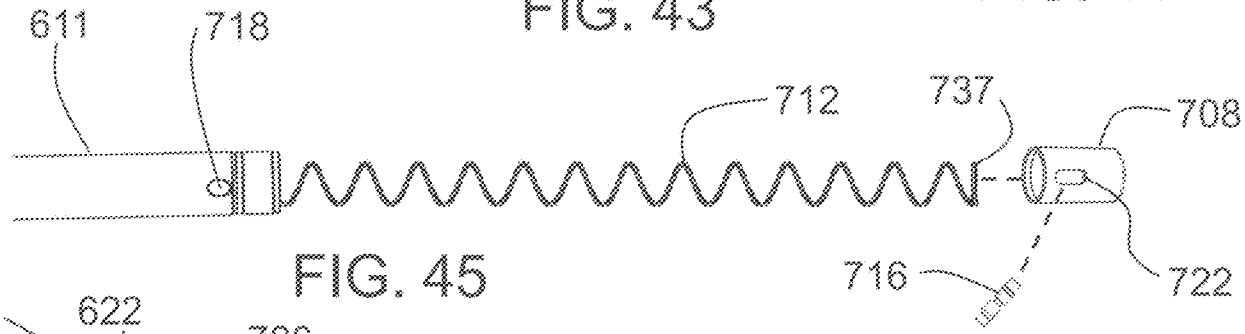
FIG. 45 is a view of the tubular magazine with the interior end cap removed exposing the magazine spring.
Figure 48:
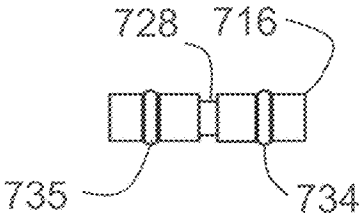
FIG. 48 is a view of the interior magazine end cap retention pin.
Figure 47:
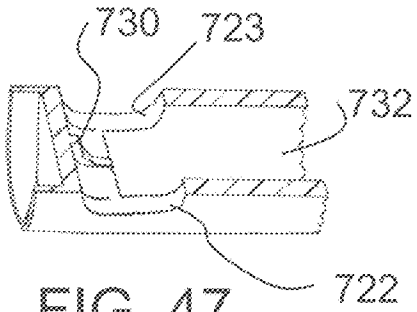
FIG. 47 is a view of the interior end cap of FIG. 46 in isolation.
Figure 46:
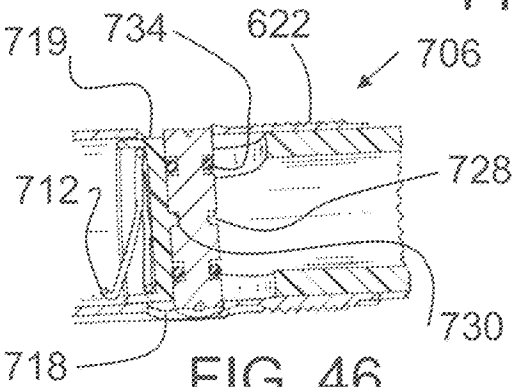
FIG. 46 is a cross sectional view of the distal end of the tubular magazine taken at line 46-46 of FIG. 43.

Referring to FIGS. 42-48, details of the magazine tube 611 and magazine tube interior cap assembly 706 are illustrated. FIG. 42 shows the receiver portion 612 of the shotgun after removal of the barrel portion as discussed above. The threaded end 622 of the magazine tube 611 has an axially movable magazine tube end cap 708 projecting therefrom, the end plug being spring loaded outwardly by the magazine spring 712. A magazine tube interior end cap retention pin 716 extends through opposing elongated apertures 718, 719 in the magazine tube 611 and also through opposing elongated openings 722, 723 in the tube 708 end cap 708. The end cap is sized to be slidingly received in the interior of the magazine tube. When the interior end cap is in the projecting position as illustrated by FIGS. 43 and 46, the end cap retention pin is pressed against the forward surfaces of the elongated apertures 718, 719 of the magazine tube and rearward surfaces of the elongated openings 722, 723 of the tube interior end cap 708. The retention pin 716 has a central circumferential groove 728 that mates with a central axially extending projection 730 in the interior 732 of the end cap 708. The projection 730 is held in the groove 728 by the force from the magazine spring 712 and such retention locks the retention pin 716 in place. To remove the end cap, such as for the purpose of adding a magazine plug for restricting the number of cartridges that the magazine can receive, the magazine tube interior end cap is pushed inwardly as indicated by the arrow 733 of FIG. 43, such that the end cap is retracted within the magazine tube as illustrated in FIG. 44, which dislocates the central axially extending projection 730 of the end cap 708 from the central circumferential groove 728 at which point the pin can be pushed out of the magazine tube in an axially direction with some soft resistance provided by the O-rings 734, 735. The interior end cap 708 can then be removed and a magazine plug, not shown, inserted into the distal end 737 of the magazine spring 712. The plug, the spring, and the interior end cap 708 may be reinserted into the magazine tube and then the retention pin 716 reinstalled.

Figure 35:
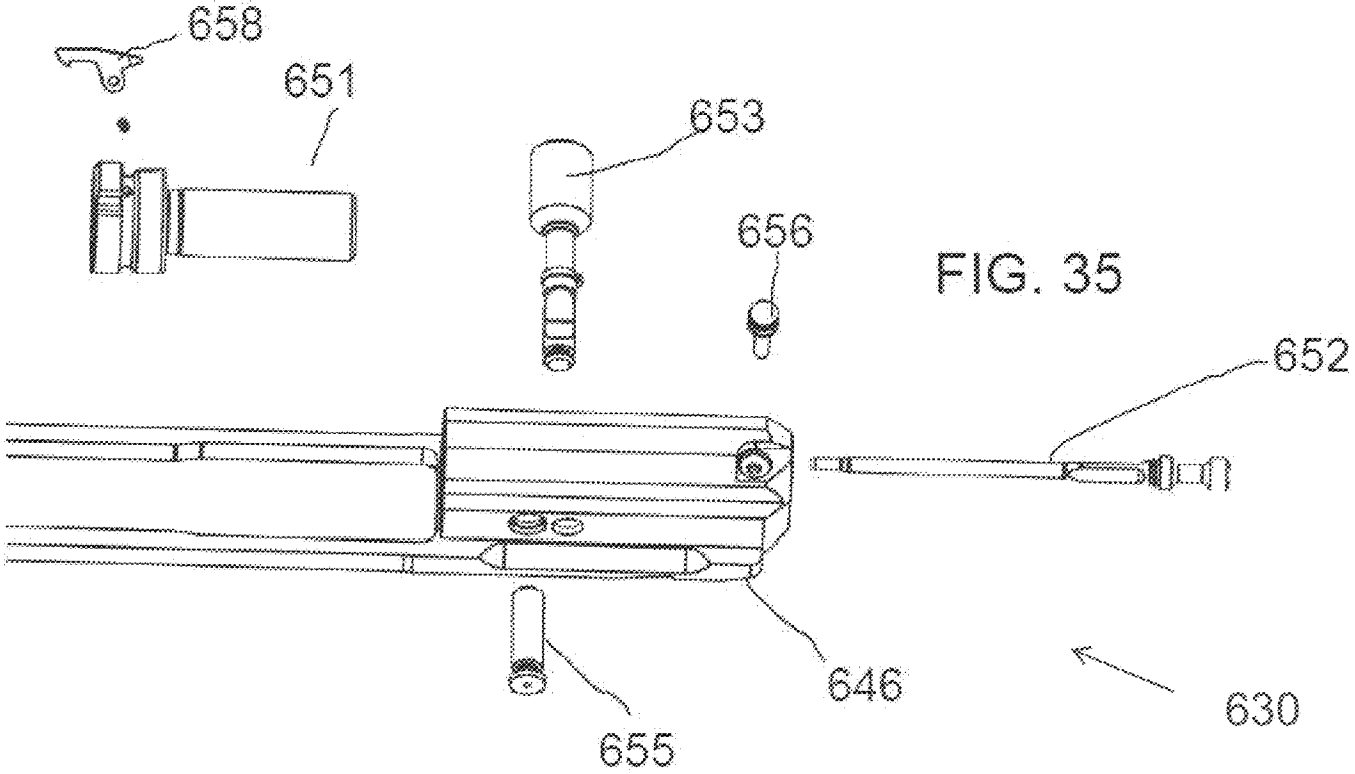
FIG. 35 is an exploded view of the bolt assembly.
Figure 36:
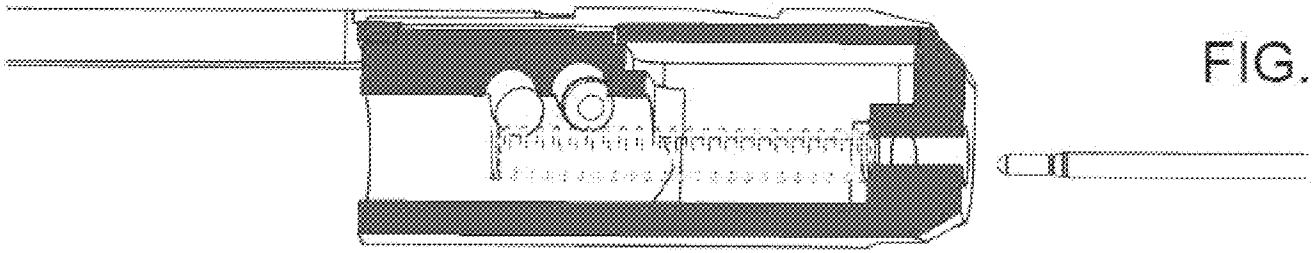
FIG. 36 is a cross sectional view of the bolt carrier.
Figure 37:
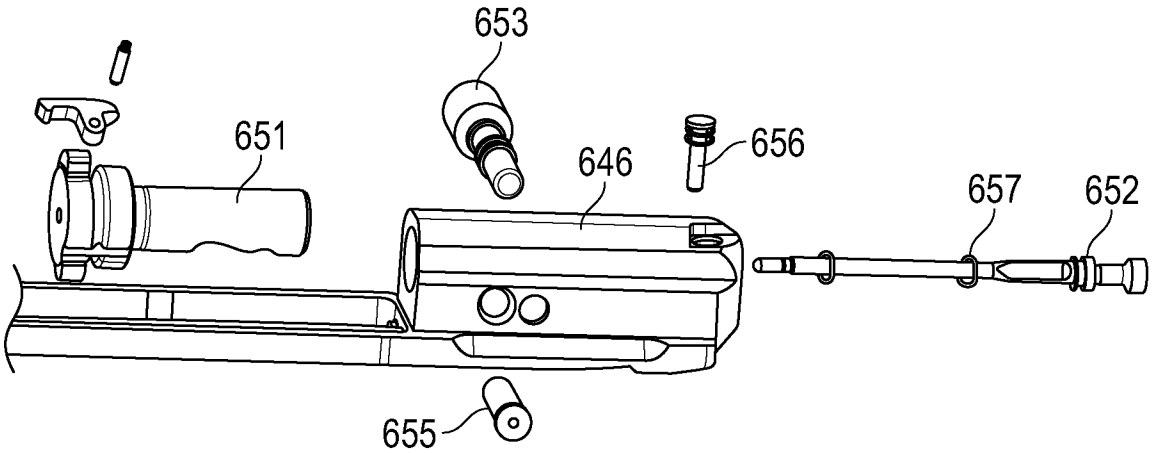
FIG. 37 is another exploded view of the bolt assembly.
Figure 38:
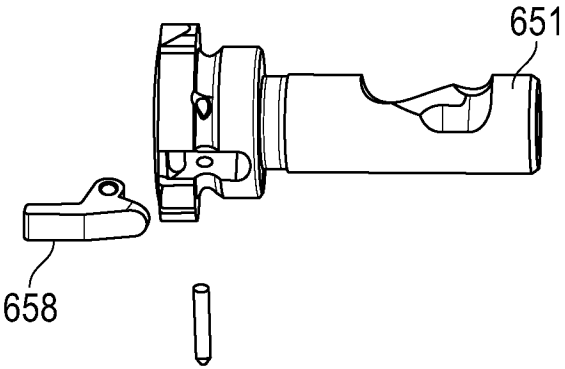
FIG. 38 is a perspective view of the bolt.

Referring to FIGS. 49-53, pins with retention O-rings 760 utilized for easy essentially tool-less disassembly and assembly of the shotgun in accord with embodiments are depicted. The pins may be machined or otherwise formed of metal and each have a groove for receiving an O-ring. The O-ring engages specific surfaces of the assembled components for inhibiting removal of the pin without a moderate amount of force with can readily be applied manually with for example a pointed or flat bladed object to push or pry the pin head. The O-rings may seat in cooperating grooves undercut into the componenty or may seat against cylindrical surfaces. Specifically, FIG. 49 illustrates the cam pin 655 received by the bolt carrier as illustrated in FIGS. 35 and 37. FIG. 50 illustrates a trigger mechanism retention pin 762 that extend from one side of the receiver to the other side and through an aperture in the trigger mechanism. One side of the receiver side wall has an undercut for receiving and retaining the O-ring with a smaller hole that receives the tip 764 of the trigger mechanism retention pin. The side of the receiver that receives the head 766 has a counter bore sized to receive the head so that the exterior surface of the head is flush with the exterior surface of the receiver wall. FIG. 51 depicts the charging handle 653, also depicted in FIGS. 34-37. The charging handle has a gripping portion 771, a shaft 772, a key portion 773, a frusto-conical tip 775, and the O-ring 760 seated in a groove adjacent the tip. The O-ring seats adjacent the side of the bolt carrier opposite the side that it is inserted that has a recess for receiving the key portion 773. The O-ring may seat in a cylindrical surface or a slightly undercut region.

FIG. 52 illustrates the interior magazine tube cap retention pin 716 discussed with reference to FIGS. 42-48 above. FIG. 53 depicts the firing pin retention pin 656 also shown in FIGS. 33A-38. Advantageously, each of the retention pins of FIGS. 49-53 may utilize the same sized and type of O-ring 760. A supply of extra O-rings may be provided with the shotgun in a retail assemblage. The interchangeable O-rings make disassembly and assembly simplified and reduces the cost of high toleranced convention pins used for assembly. The O-rings may be formed of elastomeric materials such as polymers.

"Non-removably attached", "nonremovable", and "not dissassembleable by the user" when used herein means secured by welding, or can mean secured with high strength thread lock such that extraordinary means such as heating with a torch is necessary for removal without damage to the components. When used herein a retail sale assemblage means a packaged assembly of firearm components mass produced for retail sale and includes manuals and packaging and typically includes a lock for the firearm. Additionally it may contain a case that includes all components and written material such as manuals/instructions/warnings.

Figure 4:
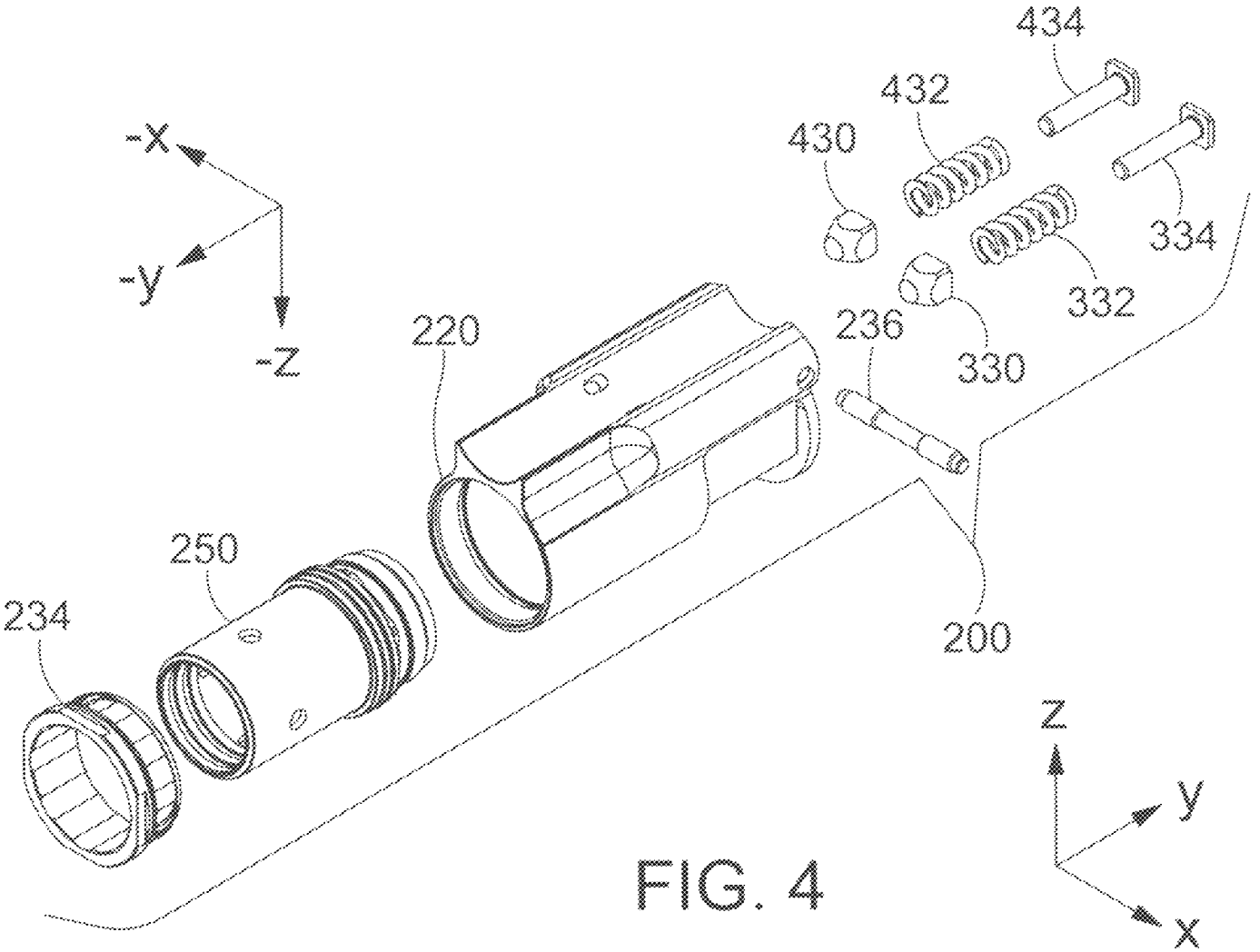
FIG. 4 is a perspective, exploded view of a gas block assembly in accordance with an embodiment described in the detailed description.
Figure 5:
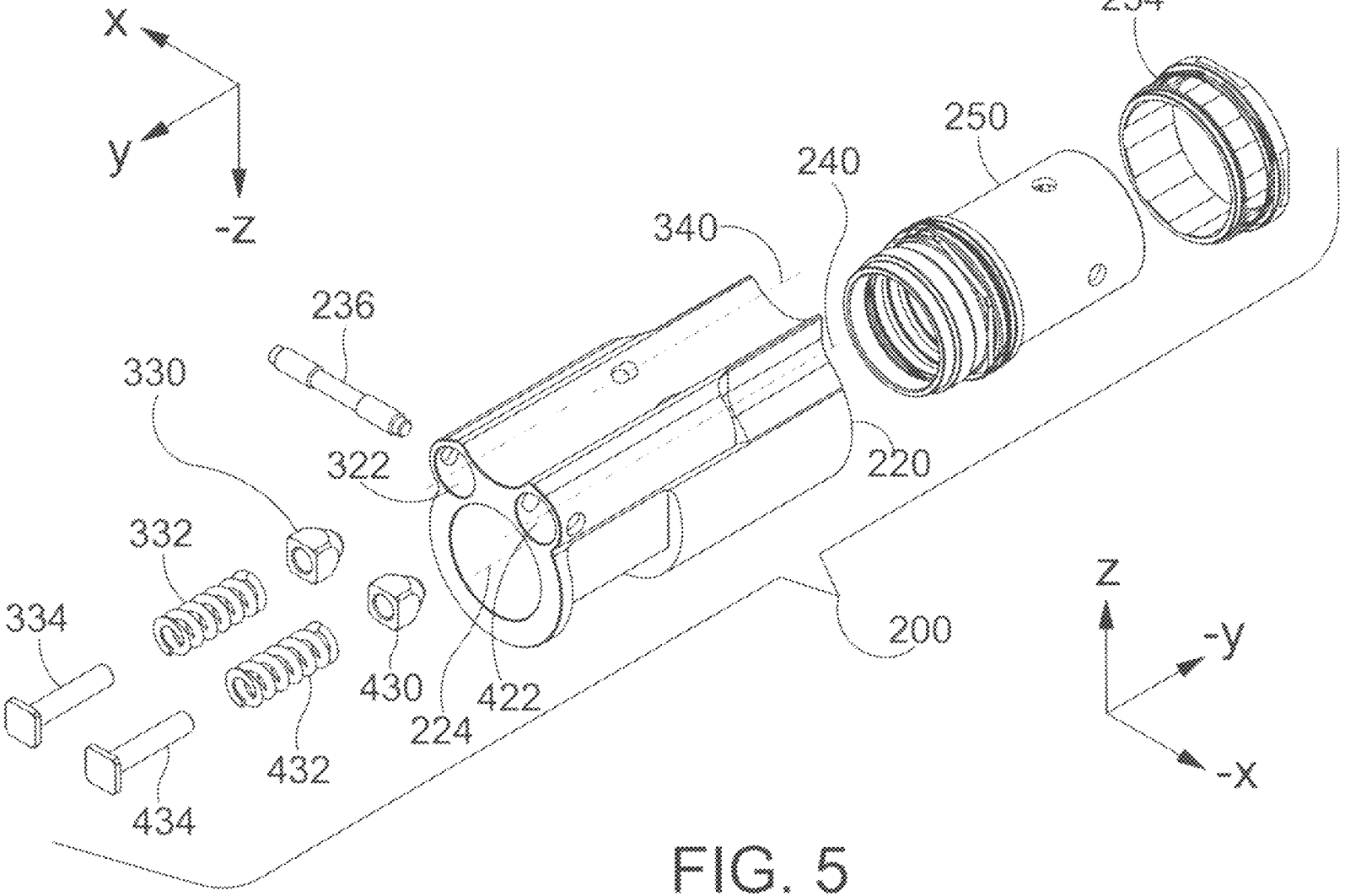
FIG. 5 is an additional perspective, exploded view of the gas block assembly shown in FIG. 4.
Figures 6A, 6B:
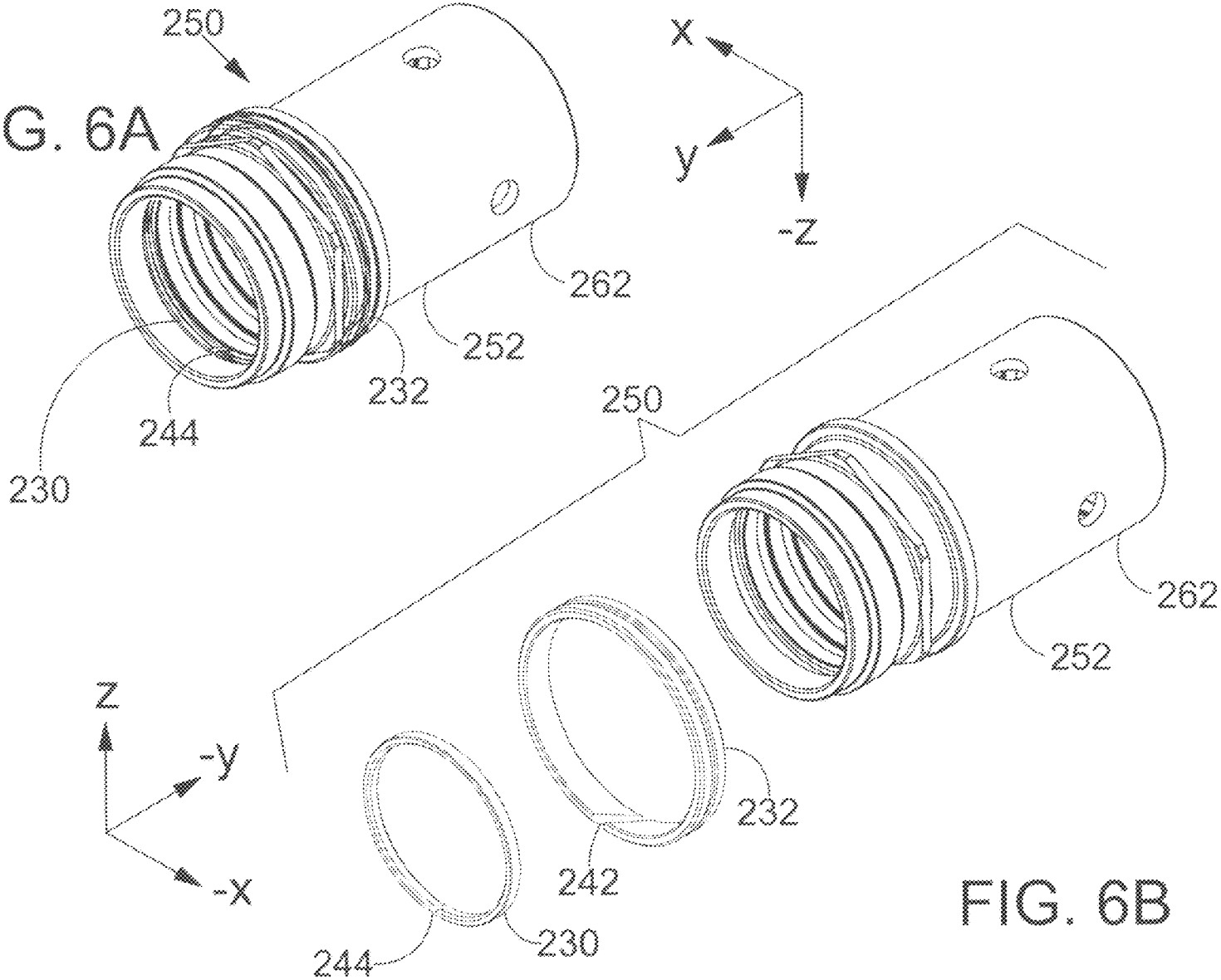
FIG. 6A is a perspective view of a sleeve assembly in accordance with an embodiment described in the detailed description.
FIG. 6B is a perspective, exploded view of the sleeve assembly shown in FIG. 6A.
Figure 7:
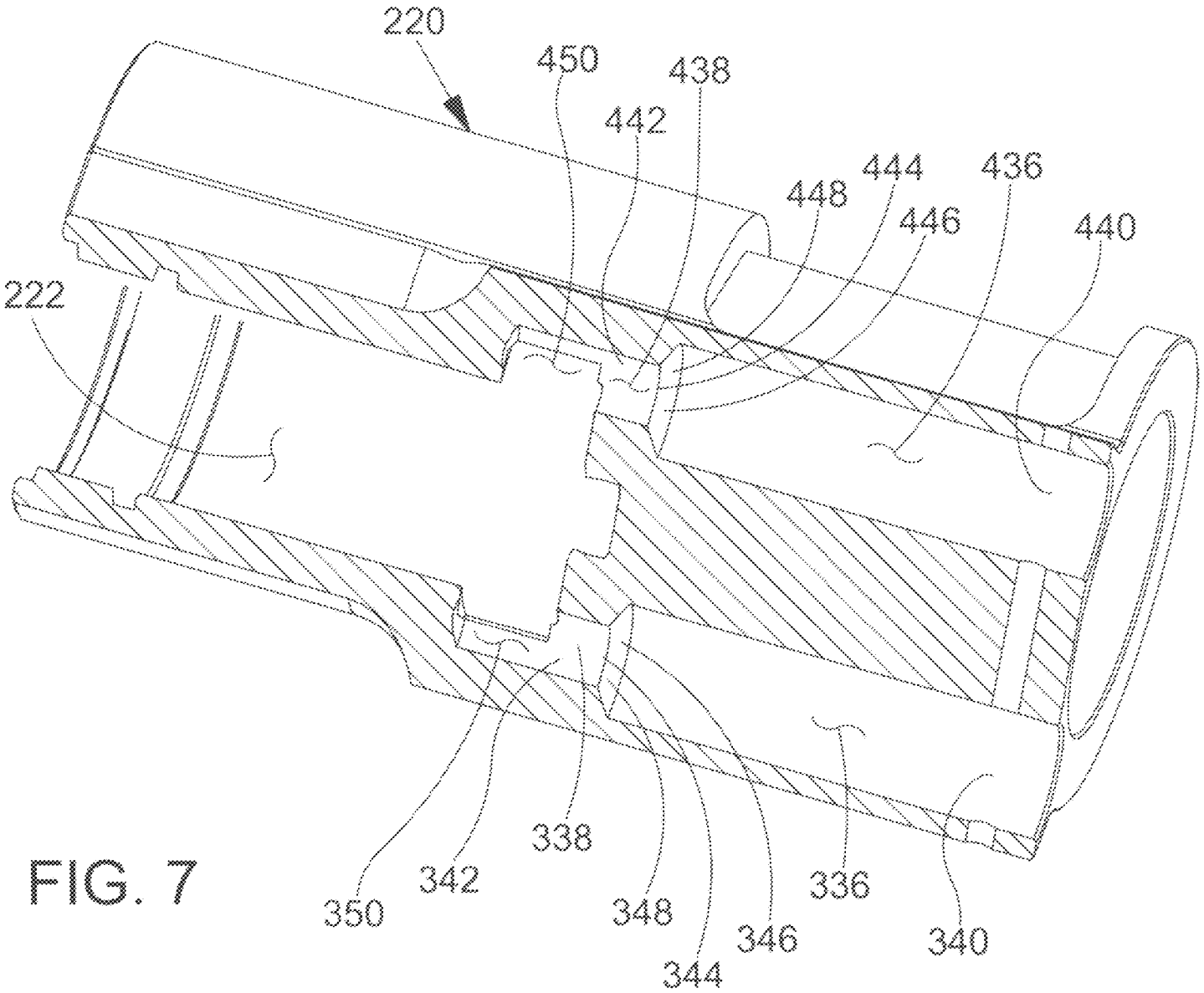
FIG. 7 is a cross-sectioned perspective view of a gas block in accordance with an embodiment described in the detailed description.
Figure 8B:
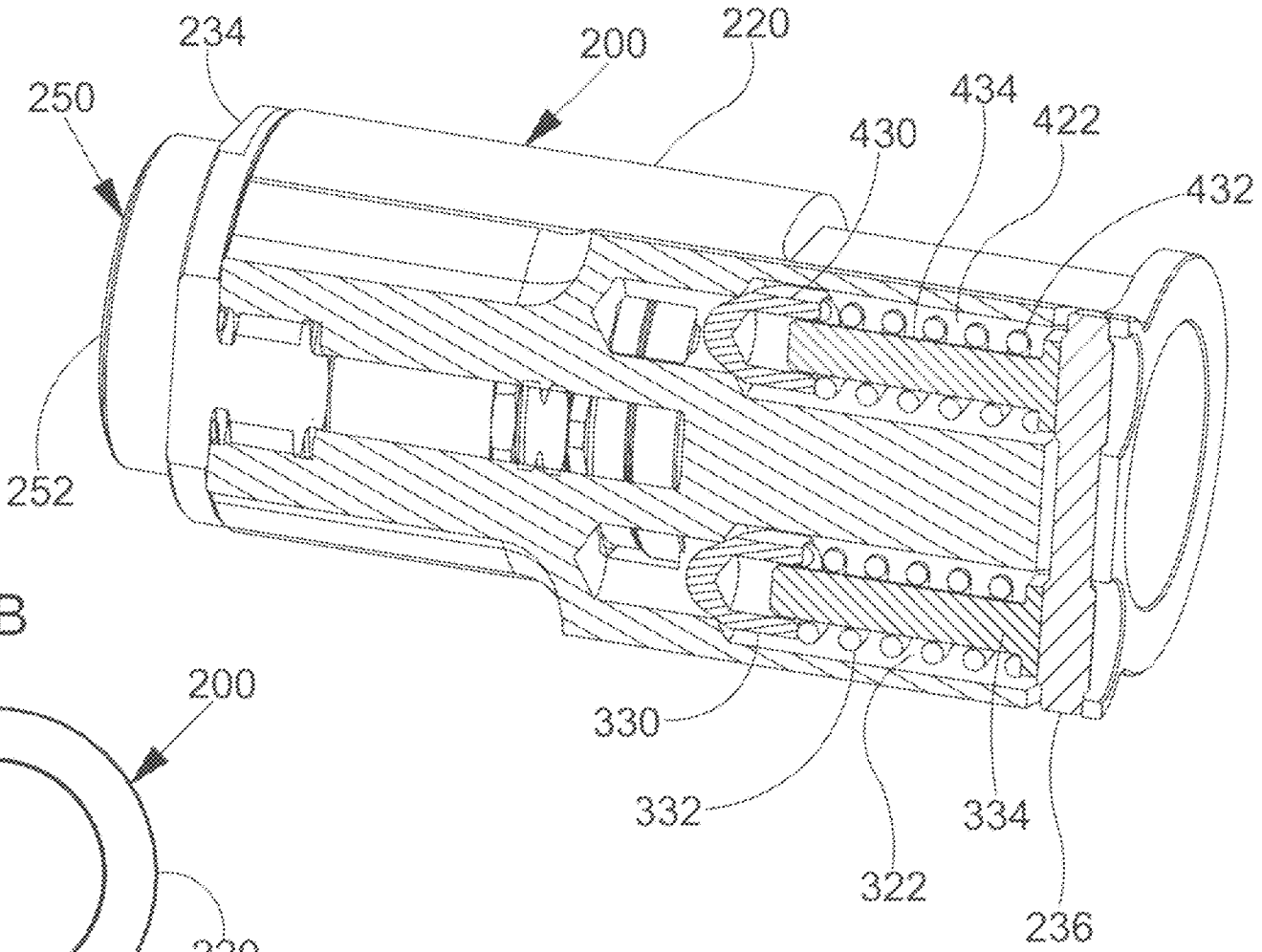
FIG. 8B is a cross-sectioned perspective view of a gas block assembly in accordance with an embodiment described in the detailed description.
Figure 8A:
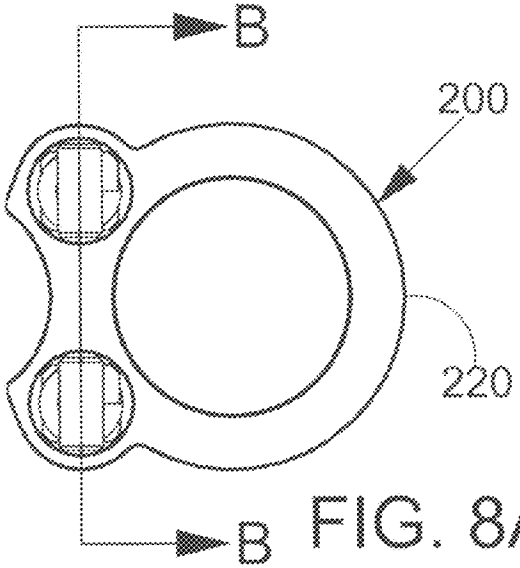
FIG. 8A is an end view showing a gas block assembly and a section line.
Figure 9:
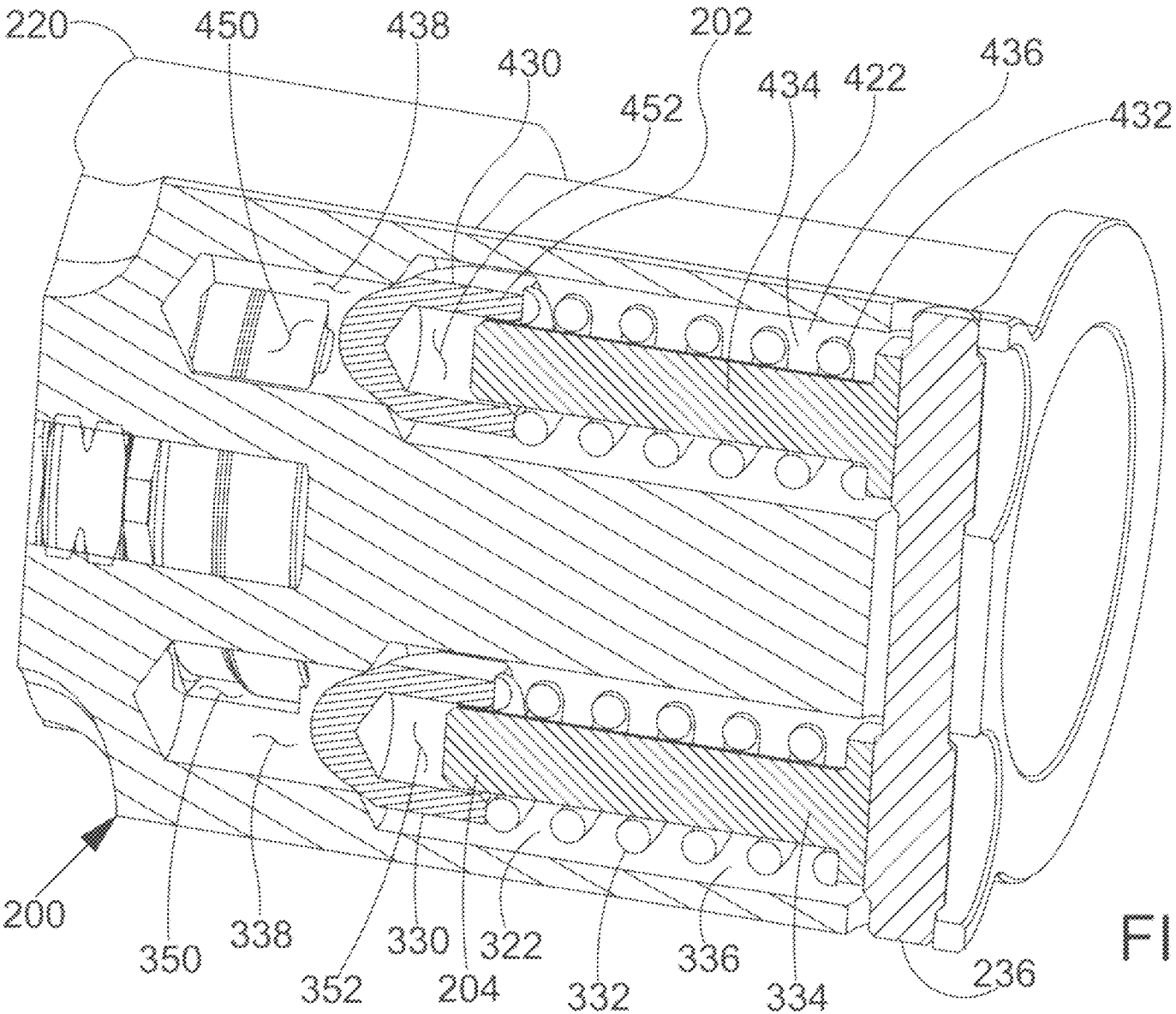
FIG. 9 is an enlarged cross-sectioned perspective view further illustrating a portion of the gas block assembly shown in FIG. 8B.
Figure 10A:
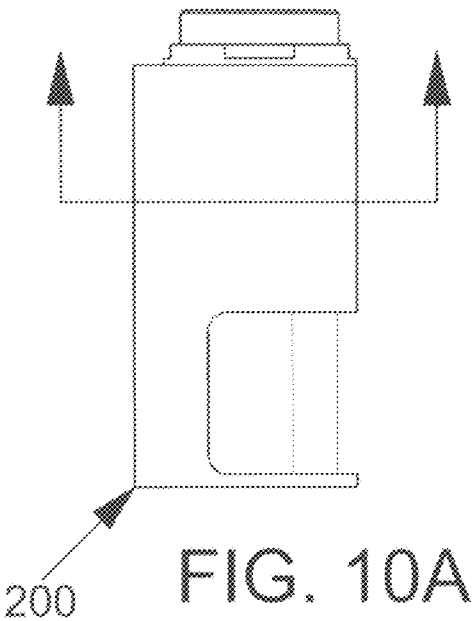
FIG. 10A is a side view showing a gas block assembly and a section line.
Figure 10B:
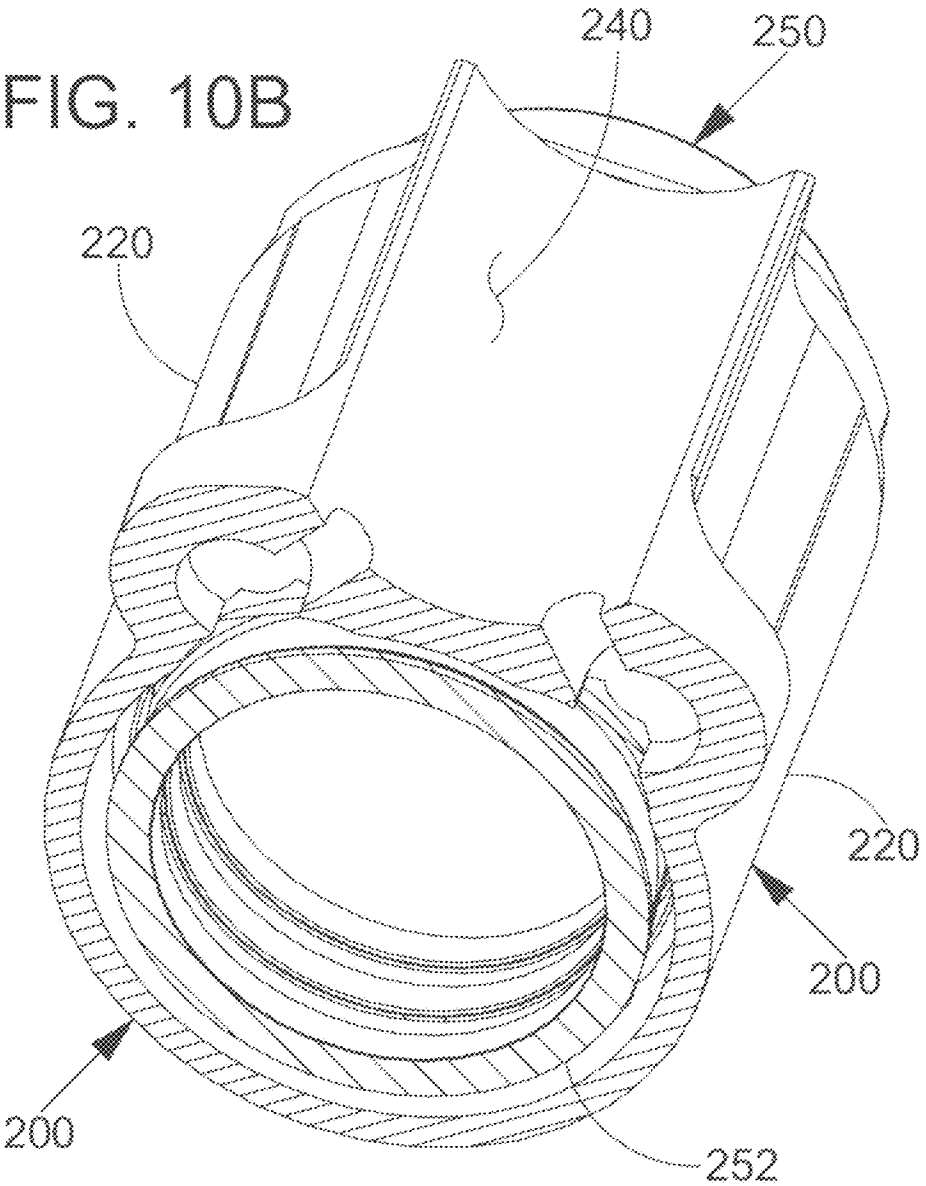
FIG. 10B is a cross-sectioned perspective view of a gas block assembly in accordance with an embodiment described in the detailed description.
Figure 11:
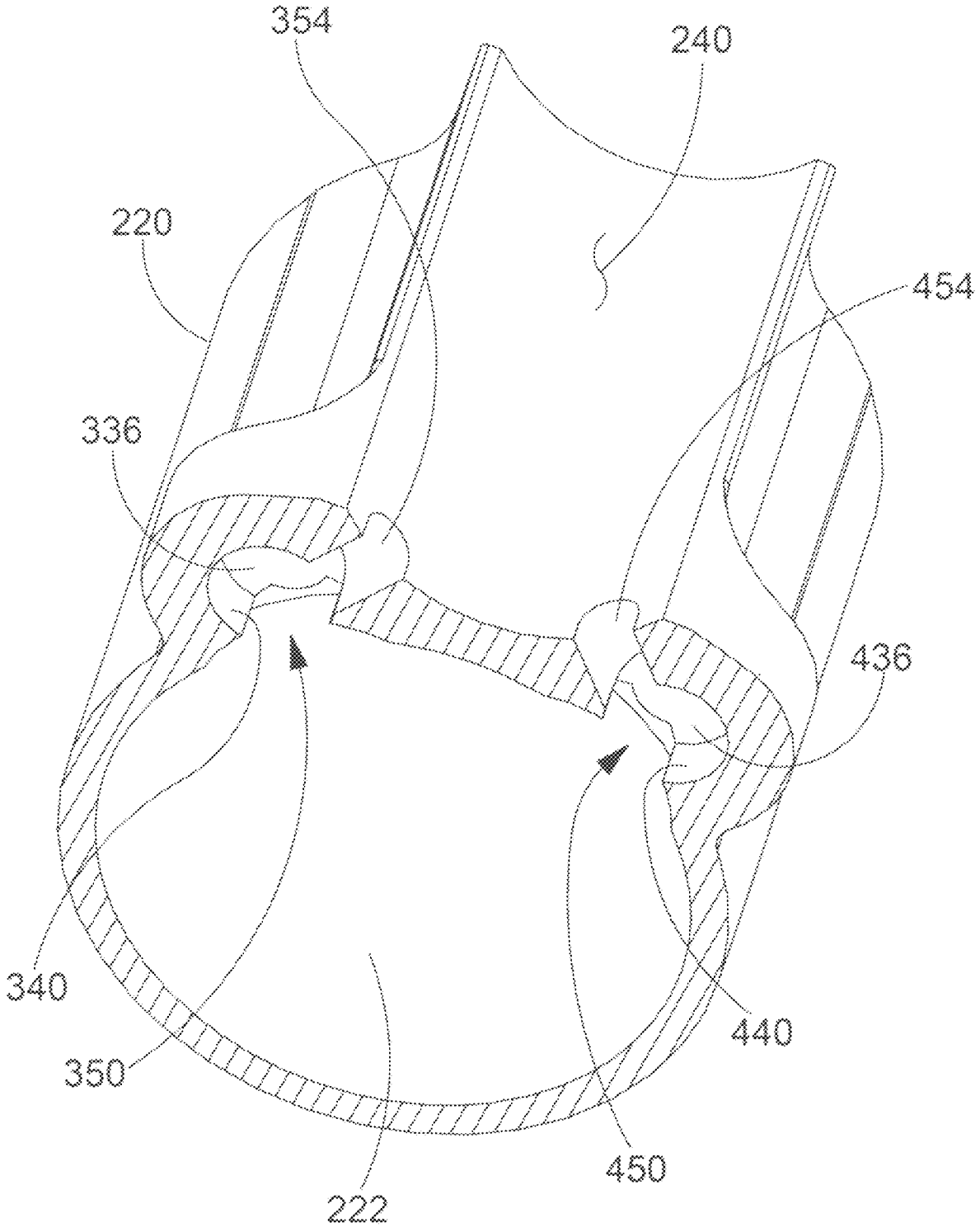
FIG. 11 is a cross-sectioned perspective view of a gas block in accordance with an embodiment described in the detailed description.

Referring, for example, to FIGS. 4 and 5, an upward direction Z and a downward or lower direction-Z are illustrated using arrows labeled "Z" and "−Z," respectively. A forward direction Y and a rearward direction-Y are illustrated using arrows labeled "Y" and "−Y," respectively. "Forward" is the shooting direction of the shotgun. A starboard direction X and a port direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZY plane defined by the upward direction and the starboard direction. In one or more embodiments, the starboard direction is generally opposite the port direction. In one or more embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

The following United States patents are hereby incorporated by reference herein: 4601122, 4702146, 4856217, 4872392, 4901623, 5429034, 5867928, 5872323, 5918401, 5959234, 6347569, 6382073, 6470614, 6508160, 6564691, 6619592, 7467581, 7775149, 7946214, 7963061, 8056280, 8065949, 8079168, 8109194, 8230632, 8245625, 8250964, 8312656, 8443712, 8528458, 8850731, 8939060, 9097475, 9212856, and 9383149.

The above references in all sections of this application are herein incorporated by references in their entirety for all purposes. Components illustrated in such patents may be utilized with embodiments herein. Incorporation by reference is discussed, for example, in MPEP section 2163.07 (B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the 10 invention herein disclosed will occur to those skilled in the respective arts and all such modifications are deemed to be within the scope of the invention.

What is claimed is:

1. A semiautomatic shotgun, comprising:

a receiver defining a receiver interior;

a breech block positioned in the receiver interior, the breech block having an in-battery position and an open position;

a barrel attached to a forward portion of the receiver, the barrel having a barrel wall extending forwardly from the receiver, the barrel wall defining a barrel bore with a barrel axis;

a piston and a piston cylinder defining a piston chamber, the piston chamber being fluidly connected to the barrel bore and the piston being operatively coupled to the breech block for selectively moving the breech block between the in-battery position and the open position; and a pair of pressure regulators fluidly connected to the piston chamber by way of respective clusters of holes through the barrel wall, each hole having a diameter of less than .070 inches.

2. The semiautomatic shotgun of claim 1, wherein each cluster of holes comprises at least four holes.

3. The semiautomatic shotgun of claim 2, wherein each hole has a diameter between 0.050 inches and 0.067 inches.

4. The semiautomatic shotgun of claim 1, wherein the pair of pressure regulators are positioned on opposite sides of a vertical plane defined by the barrel axis.

5. The semiautomatic shotgun of claim 1, further comprising a magazine tube attached to a forward portion of the receiver below the barrel, wherein the piston is an annular piston disposed around the magazine tube.

6. The semiautomatic shotgun of claim 5, further comprising:

a first ring disposed between an inner surface of the annular piston and an outer surface of the magazine tube; and a second ring disposed between an outer surface of the annular piston and an inner surface of the piston cylinder.

7. The semiautomatic shotgun of claim 1, wherein each hole is drilled on center with the axis of the barrel.

8. The semiautomatic shotgun of claim 1, wherein the holes are not at a forward or rearward angle with respect to the barrel wall.

9. A semiautomatic shotgun, comprising:

a receiver defining a receiver interior;

a breech block positioned in the receiver interior, the breech block having an in-battery position and an open position;

a barrel attached to a forward portion of the receiver, the barrel having a barrel wall extending forwardly from the receiver, the barrel wall defining a barrel bore with a barrel axis;

a piston and a piston cylinder defining a piston chamber, the piston chamber being fluidly connected to the barrel bore and with pressure regulation provided thereto, the barrel having a cluster of holes providing operating gas to the piston chamber, each of the holes being less than 0.100 inches in diameter, each hole extending through the barrel wall and being on center.

10. The semiautomatic shotgun of claim 9, wherein the pressure regulation is provided by a pair of pressure regulators, each pressure regulator having a cluster of holes associated therewith, each cluster having at least four holes.

11. The semiautomatic shotgun of claim 10, wherein each hole is less than.70 inches in diameter.

12. The semiautomatic shotgun of claim 9, wherein each cluster of holes is arranged in a matrixical arrangement.

13. The semiautomatic shotgun of claim 9, wherein each of the holes are at least six inches from the rearward end of the firing chamber.

14. The semiautomatic shotgun of claim 9, wherein the piston being operatively coupled to the breech block for selectively moving the breech block between the in-battery position and the open position.

15. A semiautomatic shotgun, comprising:

a receiver defining a receiver interior;

a breech block positioned in the receiver interior, the breech block having an in-battery position and an open position;

a plurality of barrels of different lengths, each barrel attachable to a forward portion of the receiver, each barrel having a barrel wall extending forwardly from the receiver when attached, each barrel wall defining a barrel bore with a barrel axis;

a piston and a piston cylinder defining a piston chamber, the piston chamber being fluidly connected to the barrel bore and the piston being operatively coupled to the breech block for selectively moving the breech block between the in-battery position and the open position; and a pair of pressure regulators fluidly connected to the piston chamber, the regulators fluidly connectable to each of the plurality of barrels of different lengths by way of respective clusters of holes through the respective barrel wall of each respective barrel, each hole having a diameter of less than .070 inches, wherein a longer of the plurality of barrels having less holes in the respective clusters of holes than a shorter of the plurality of barrels.

16. The semiautomatic shotgun of claim 15, wherein the barrels of the plurality of barrels may be interchanged without adjusting the pair of pressure regulators.

17. The semiautomatic shotgun of claim 15, wherein each hole has a diameter between 0.050 inches and 0.067 inches.

18. The semiautomatic shotgun of claim 15, wherein the pair of pressure regulators are positioned on opposite sides of a vertical plane defined by the barrel axis.

19. The semiautomatic shotgun of claim 15, further comprising a magazine tube attached to a forward portion of the receiver below the barrel, wherein the piston is an annular piston disposed around the magazine tube.

* * * * *